US010787007B2

(12) United States Patent
Mizutani et al.

(10) Patent No.: US 10,787,007 B2
(45) Date of Patent: Sep. 29, 2020

(54) PRINTING DEVICE

(71) Applicant: Brother Kogyo Kabushiki Kaisha, Nagoya-shi, Aichi-ken (JP)

(72) Inventors: Hiromitsu Mizutani, Ichinomiya (JP); Takamichi Kitauke, Seto (JP)

(73) Assignee: Brother Kogyo Kabushiki Kaisha, Nagoya-shi, Aichi-ken (MS)

( * ) Notice: Subject to any disclaimer, the term of this patent is extended or adjusted under 35 U.S.C. 154(b) by 0 days.

(21) Appl. No.: 16/359,376

(22) Filed: Mar. 20, 2019

(65) Prior Publication Data

US 2019/0299664 A1 Oct. 3, 2019

(30) Foreign Application Priority Data

Mar. 30, 2018 (JP) ..... 2018-066366

(51) Int. Cl.
*B41J 11/04* (2006.01)
*B41J 11/00* (2006.01)

(52) U.S. Cl.
CPC ..... *B41J 11/04* (2013.01); *B41J 11/0095* (2013.01)

(58) Field of Classification Search
CPC ..... B41J 11/04; B41J 11/0095
See application file for complete search history.

(56) References Cited

U.S. PATENT DOCUMENTS

2001/0048830 A1* 12/2001 Nose ..... G03G 15/23 399/374
2012/0048079 A1 3/2012 Mitsuhashi et al.
2018/0104969 A1* 4/2018 Nakata ..... B65H 75/285

FOREIGN PATENT DOCUMENTS

JP 2012-046299 A 3/2012

* cited by examiner

*Primary Examiner* — Lamson D Nguyen
(74) *Attorney, Agent, or Firm* — Banner & Witcoff, Ltd.

(57) ABSTRACT

A printing device includes a discharging roller, opposing rollers opposing the discharging roller, a discharge motor, a first coupling mechanism, a moving mechanism, and a second coupling mechanism. The first coupling mechanism rotates the discharging roller in a direction where a tape is transported downstream when the discharge motor rotates forward (arrow R1). The moving mechanism moves the discharging roller to a nip position to hold the tape with the opposing rollers and a release position spaced from the tape. The second coupling mechanism includes a one-way clutch that couples the discharge motor and the moving mechanism in a manner drivable together when the discharge motor rotates reversely (arrow R2) and decouples the discharge motor from the moving mechanism when the discharge motor rotates forward (arrow R1).

14 Claims, 35 Drawing Sheets

Fig.24

30

| Rotation determination table | |
|---|---|
| Tape type | Preset rotation amount of discharging roller |
| Receptor tape | Large |
| Die-cut tape | None |
| Thermal tape | Large |
| Stencil tape | Small |
| Laminate tape | Intermediate |
| ⋮ | ⋮ |

PRINTING DEVICE

CROSS-REFERENCE TO RELATED APPLICATION

This application claims priority from Japanese Patent Application No. 2018-066366 filed on Mar. 30, 2018, the contents of which are incorporated herein by reference in their entirety.

TECHNICAL FIELD

Aspects of the disclosure relate to a printing device.

BACKGROUND

A known printing device prints on a print medium being transported. One example is a recording device described in Japanese Unexamined Patent Application Publication No. 2012-46299, which transports a sheet with a transport device and prints on the transported sheet with a recording head. The recording device includes a first roller and a second roller downstream from the recording head in a sheet transport direction. The first roller is coupled to a discharge motor, and the second roller is coupled to a clamping motor. The recording device drives the clamping motor to move the second roller toward the first roller until the sheet is held between the first and second rollers. In this state, the recording device drives the discharge motor to rotate the first roller. The first and second rollers thus transport the sheet.

SUMMARY

This known recording device accommodates the clamping motor and the discharge motor, and thus must be sized accordingly.

One or more aspects of the present disclosure are directed to a printing device that avoids upsizing requirements associated with known printing devices.

A printing device according to one aspect of the present disclosure includes a transporting unit that transports a print medium, a printing unit that prints on the print medium that is transported by the transporting unit, a roller located downstream from the printing unit in a transport direction of the print medium, an opposing member opposing the roller, a motor rotatable in a forward direction and a reverse direction opposite to the forward direction, a first coupling mechanism that couples the motor and the roller in a manner drivable together, and rotates the roller in a first direction, which is a rotation direction in which the print medium is transported downstream in the transport direction, when the motor rotates in the forward direction, a moving mechanism that moves the roller to a first position at which the roller holds the print medium between the roller and the opposing member, and a second position at which the roller is spaced from the print medium, and a second coupling mechanism that couples the motor and the moving mechanism in a manner drivable together, and includes a first switching mechanism that couples the motor and the moving mechanism in a manner drivable together when the motor rotates in the reverse direction and decouples the motor from the moving mechanism when the motor rotates in the forward direction.

In the printing device according to the above aspect, the roller does not move between the first position and the second position when the motor rotates in the forward direction. The printing device may thus rotate the roller in the first direction while maintaining the roller at a predetermined position. More specifically, the printing device controls the rotation direction of the single motor to control rotation of the roller in the first direction and movement of the roller between the first position and the second position. The sizing requirements of the printing device may therefore be reduced.

In the printing device according to one aspect of the present disclosure, the first coupling mechanism may include a first gear coupled to and drivable together with the motor, and a second gear located on a rotation shaft of the roller and meshable with the first gear. The moving mechanism may move the rotation shaft of the roller along a toothed peripheral surface of the first gear to move the roller to the first position and the second position. In this aspect, when the roller is moved to the first or second position, the rotation shaft of the roller moves along the peripheral surface of the first gear. The second gear remains meshed with the first gear. The driving force of the motor is thus transmitted to the roller at the first or second position via the first and second gears in this order. The printing device may thus rotate the roller at the first or second position in the first direction by driving the motor.

The printing device according to one aspect of the present disclosure may further include a first guide having a guide hole extending along the peripheral surface or a guide groove to receive the rotation shaft of the roller. In this aspect, when the roller is moved to the first or second position, the guide hole or the guide groove guides the rotation shaft of the roller along the peripheral surface of the first gear. The printing device may reliably have the second gear meshing with the first gear when the roller is moved to the first or second position.

In the printing device according to one aspect of the present disclosure, the moving mechanism may include a rotator coupled to the motor by the second coupling mechanism, an eccentric member fixed to the rotator in a manner eccentric to a rotation shaft of the rotator, and a holder including a first support supporting the eccentric member and a second support rotatably supporting the rotation shaft of the roller. In this aspect, the eccentric member moves the holder as the motor rotates the rotator. Thus, the moving mechanism may move the roller to the first or second position.

In the printing device according to one aspect of the present disclosure, the first support may have a hole to support the eccentric member in a manner movable in a second direction perpendicular to a direction in which the rotation shaft of the rotator extends and to a direction in which the holder moves, and the second support may have a hole to support the rotation shaft of the roller in a manner movable in the second direction. In this aspect, the printing device may not rotate the holder as the eccentric member rotates about the rotation shaft of the rotator and the rotation shaft of the roller rotates about the rotation shaft of the first gear. Thus, the printing device may be provided with a holder with increased freedom of design.

The printing device according to one aspect of the present disclosure may further include a second guide that guides the holder to move linearly when the roller moves between the first position and the second position. In this aspect, the printing device may reduce the distance by which the holder moves when the roller moves to the first or second position. The sizing requirements of the printing device may therefore be reduced.

The printing device according to one aspect of the present disclosure may further include a first urging member that urges the rotator to maintain the roller at the first position. In this aspect, the motor rotates in the reverse direction to transmit a driving force to the rotator. The printing device may maintain the roller at the first position under the urging force of the first urging member when receiving the driving force of the motor transmitted to the rotator.

The printing device according to one aspect of the present disclosure may further include a second urging member that urges the rotator to maintain the roller at the second position. In this aspect, the motor rotates in the reverse direction to transmit a driving force to the rotator. The printing device may maintain the roller at the second position under the urging force of the second urging member when receiving the driving force of the motor transmitted to the rotator.

In the printing device according to one aspect of the present disclosure, the first urging member may urge the rotator to maintain the roller at the second position. In this aspect, the motor rotates in the reverse direction to transmit a driving force to the rotator. The printing device may maintain the roller at the second position under the urging force of the first urging member when receiving the driving force of the motor transmitted to the rotator.

In the printing device according to one aspect of the present disclosure, the holder may include a first member including the first support, a second member including the second support, and supported by the first member in a manner movable toward and away from the opposing member, and a third urging member located between the first member and the second member to urge the first member toward the opposing member. In this aspect, the printing device may adjust, in accordance with the thickness of the print medium, the holding load with which the roller and the opposing member hold the print medium between them under the urging force of the third urging member.

The printing device according to one aspect of the present disclosure may further include a detection unit that detects the roller at the first position or at the second position. In this aspect, the printing device may reliably detect the roller at the first or second position.

The printing device according to one aspect of the present disclosure may further include a detection unit that detects the roller at the first position or at the second position. The detection unit may detect the roller at the first position or at the second position by detecting a position of the first member. In this aspect, the printing device may reliably detect the roller at the first or second position. When the roller moves to the first or second position, the first member moves by a longer distance than the roller. Thus, the printing device may more easily detect the position of the roller by detecting the position of the first member than when directly detecting the position of the roller.

In the printing device according to one aspect of the present disclosure, the first coupling mechanism may include a second switching mechanism that couples the motor and the roller in a manner drivable together when the motor rotates in the forward direction, and decouples the motor from the roller when the motor rotates in the reverse direction. In this aspect, the roller does not rotate as the motor rotates in the reverse direction. Thus, the printing device may move the roller to the first or second position while the roller is not rotating.

BRIEF DESCRIPTION OF THE DRAWINGS

FIG. 24 is a conceptual diagram of a rotation determination table.

DETAILED DESCRIPTION

One embodiment of the present disclosure will now be described with reference to the drawings. The drawings are referred to in describing technical features in one or more embodiments of the present disclosure. The illustrated components of the printing device are mere examples, and do not limit the present disclsoure to those components. To simplify the drawings, the gears are shown without teeth.

Figure 1:
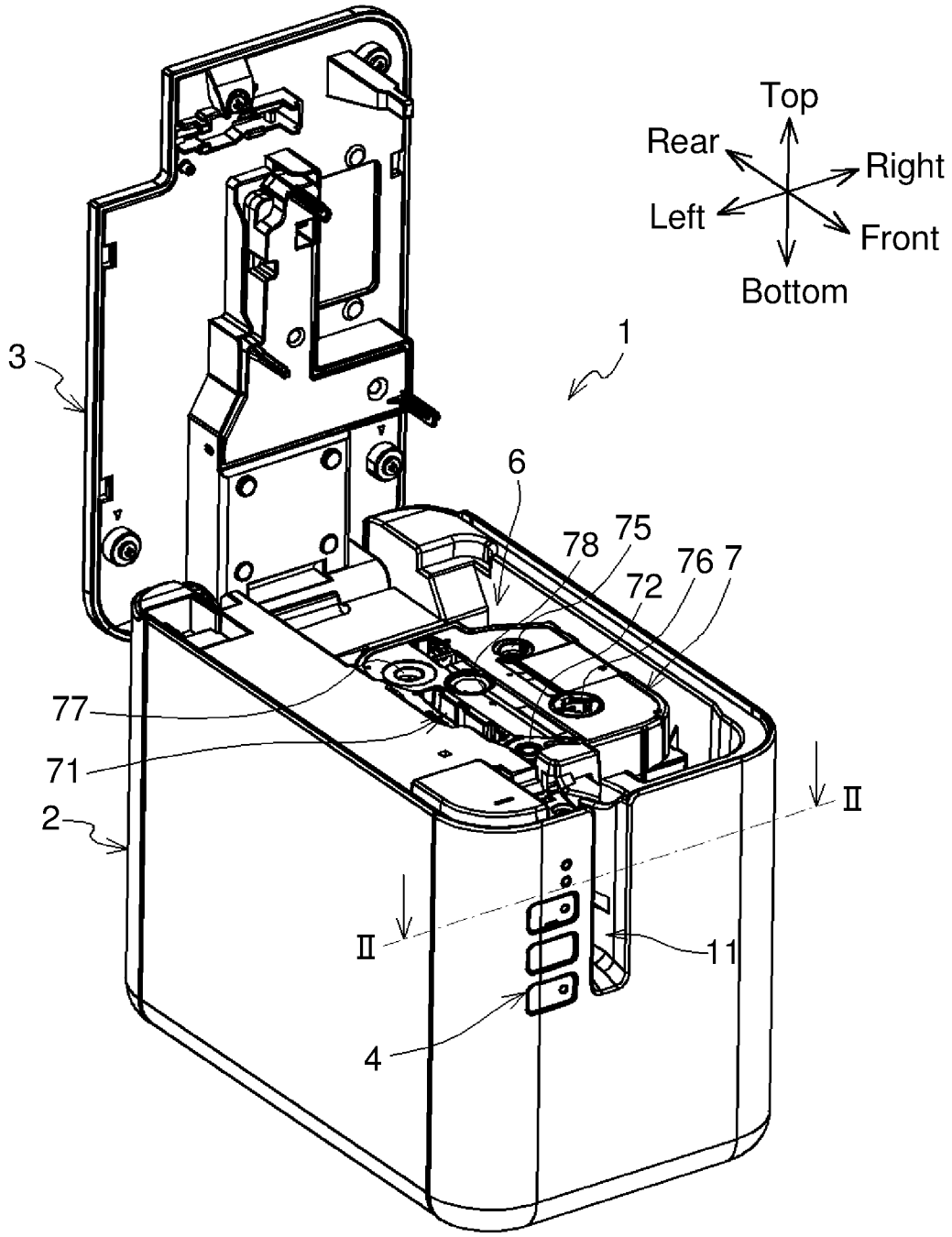
FIG. 1 is a perspective front view of a printing device as viewed from left above.
Figure 2:
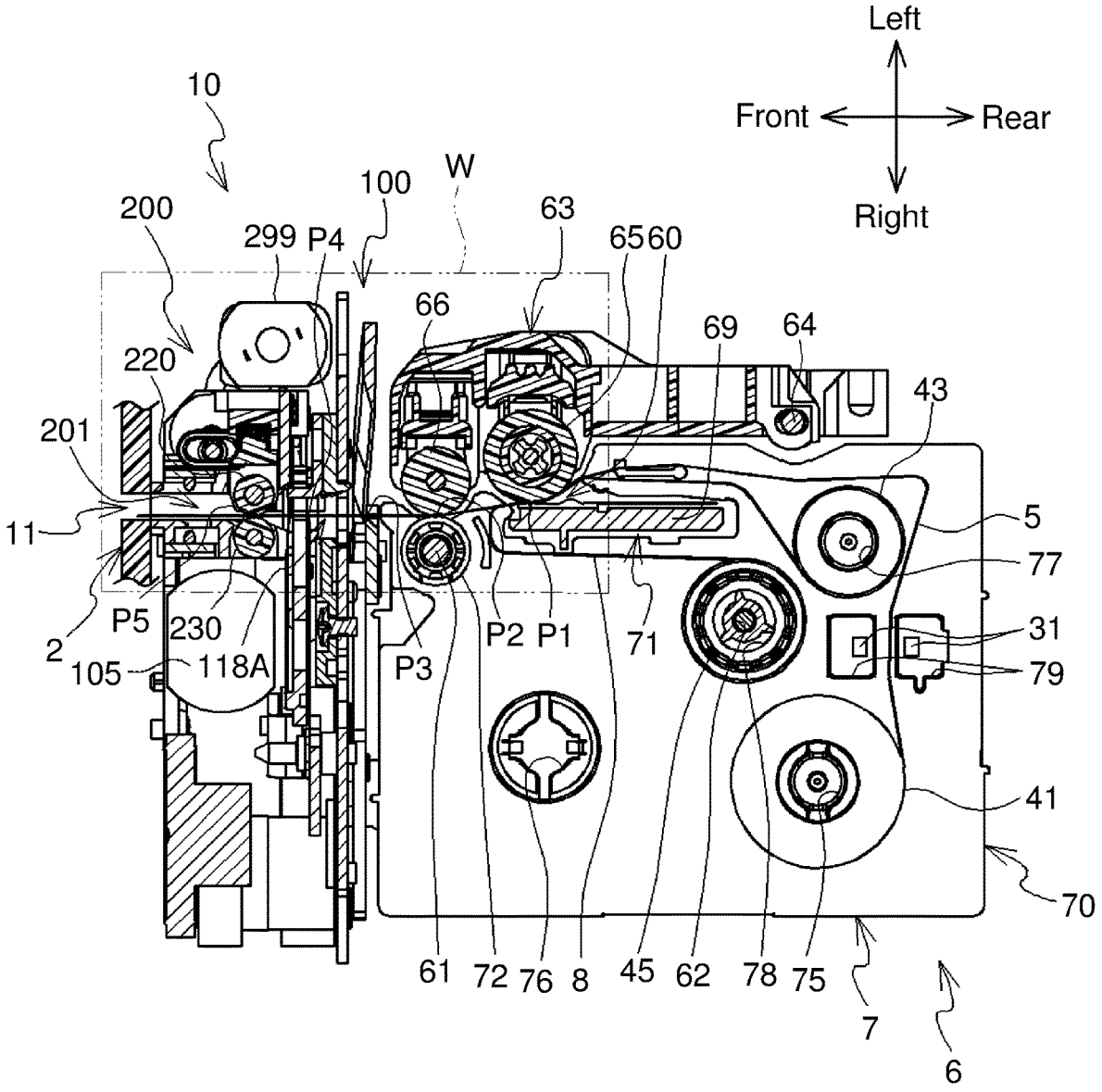
FIG. 2 is a sectional view taken along line II-II in FIGS. 1 and 13 as viewed in the direction of the arrows.

The schematic structure of a printing device 1 will now be described with reference to FIGS. 1 and 2. In FIG. 1, the lower left, upper right, lower right, upper left, top, and bottom are defined as the left, right, front, rear, and upper and lower sides of the printing device 1. The printing device 1 is a general-purpose printing device that can receive a variety of cassettes (e.g., receptor, thermal, and laminate cassettes). FIG. 2 schematically shows a receptor cassette 7. The cassette can accommodate an elongated print medium selected from, for example, a receptor tape 5, a die-cut tape 9, a thermal tape, a stencil tape, a double-sided adhesive tape, and a transparent film tape, which are collectively referred to as tapes. The printing device 1 is connectable to an external terminal (not shown) through, for example, a network or a cable (not shown). Examples of the external terminal include a personal computer and a smartphone. For example, the printing device 1 prints characters on a tape based on print data transmitted from the external terminal. Examples of the characters include letters, numerals, symbols, and figures.

As shown in FIG. 1, the printing device 1 includes a casing 2 and a cover 3. The casing 2 is a substantially rectangular prism. The cover 3 is pivotably supported at a rear end portion of the upper surface of the casing 2 to open or close at the upper surface of the casing 2. The printing device 1 includes an input unit 4 at an upper left corner on the front surface of the casing 2. The input unit 4 includes buttons with which various items of information are input into the printing device 1. The printing device 1 has an outlet slit 11 in the front surface of the casing 2 on the right of the input unit 4. The outlet slit 11 extends vertically, and allows communication inside and outside the casing 2. The printing device 1 includes a receiving unit 6 in the upper surface of the casing 2. The receiving unit 6 is recessed from the upper surface of the casing 2 to receive the cassette 7 in a removable manner.

As shown in FIG. 2, the receiving unit 6 includes a thermal head 60, a tape driving shaft 61, a ribbon winding shaft 62, and a mark sensor 31. The thermal head 60 is on the left surface of a head holder 69, and includes a plurality of heating elements arranged vertically. The head holder 69 is a plate extending perpendicularly in the lateral direction in a left portion of the receiving unit 6. The tape driving shaft 61, which is rotatable, extends vertically in front of the head holder 69. The ribbon winding shaft 62, which is rotatable, extends vertically on the right of the head holder 69. The mark sensor 31, which is a transmission photosensor, detects marks 99 (refer to FIG. 3B) on the die-cut tape 9 (described later).

The receiving unit 6 further includes a platen holder 63 in its left portion. The platen holder 63 has its rear end portion rotatably supported by a shaft 64, which extends vertically. The platen holder 63 supports a platen roller 65 and a transport roller 66 in a manner rotatable clockwise and counterclockwise in a plan view. The platen roller 65 opposes the thermal head 60 from the left. The transport roller 66 is located in front of the platen roller 65 and opposes the tape driving shaft 61 from the left. As a front end portion of the platen holder 63 swings about the shaft 64 in substantially the lateral direction, the platen roller 65 moves toward (as shown in FIG. 2) and away from (not shown) the thermal head 60, and the transport roller 66 toward and away from the tape driving shaft 61.

The tape driving shaft 61, the ribbon winding shaft 62, the platen roller 65, and the transport roller 66 are coupled to a transport motor 68 (refer to FIG. 18) via gears (not shown). The transport motor 68 can be driven to rotate in the forward and reverse directions. The forward direction and the reverse direction are the rotation directions opposite to each other.

The casing 2 has an internal unit 10 around the rear of the outlet slit 11. The internal unit 10 includes a cutter unit 100 and a discharging unit 200. The cutter unit 100 cuts a tape across its width at least partially in the thickness direction. The discharging unit 200 holds the tape that is cut by the cutter unit 100 and discharges the tape out of the printing device 1 through the outlet slit 11. The cutter unit 100 and the discharging unit 200 will be described in detail later.

The cassette 7 will now be described with reference to FIG. 2. The cassette 7 includes a case 70 as a box. The case 70 includes a tape driving roller 72 and support holes 75 to 78. The tape driving roller 72 is cylindrical and extends vertically at a left front corner of the case 70, and is rotatably supported by the case 70. The tape driving roller 72 has its left end portion exposed outside from the case 70.

The support hole 75 extends vertically through the case 70 to rotatably support a first tape spool 41. The first tape spool 41 extends vertically, and receives a first tape wound around the spool. The support hole 77 extends vertically through the case 70 to rotatably support a ribbon spool 43. The ribbon spool 43 extends vertically, and receives an ink ribbon 8 wound around the spool before printing. The support hole 78 extends vertically through the case 70 to rotatably support a ribbon winding spool 45. The ribbon winding spool 45 is cylindrical and extends vertically, and receives the ink ribbon 8 wound around the spool after printing. The support hole 76 extends vertically through the case 70 to rotatably support a second tape spool (not shown). The second tape spool extends vertically, and receives a second tape wound around the spool.

The case 70 has a head opening 71 and a pair of holes 79. The head opening 71 extends vertically through a left portion of the case 70. The tape is exposed in a left front portion of the head opening 71. The pair of holes 79 extend vertically through the case 70. The holes 79 oppose each other to have the tape fed from the first tape spool 41 between them.

The cassette 7 may accommodate a selected one of the tapes in the case 70 and contain or remove the ink ribbon 8 to be any of the above thermal, receptor, laminate, and tube cassettes.

For the receptor cassette 7, the support hole 75 supports the first tape spool 41 around which the receptor tape 5 or the die-cut tape 9 as a first tape is wound. The receptor cassette 7 does not use a second tape, and thus the support hole 76 does not support the second tape spool. The support hole 77 supports the ribbon spool 43.

For a thermal cassette (not shown), the support hole 75 supports the first tape spool 41 around which a thermal tape or a stencil tape as a first tape is wound. The support hole 76 does not support a second tape. The support hole 77 does not support the ribbon spool 43.

For a laminate cassette (not shown), the support hole 75 supports the first tape spool 41 around which a transparent film tape as a first tape is wound. The support hole 76 supports a second tape spool around which a double-sided adhesive tape as a second tape is wound. The support hole 77 supports the ribbon spool 43.

Figure 3A:
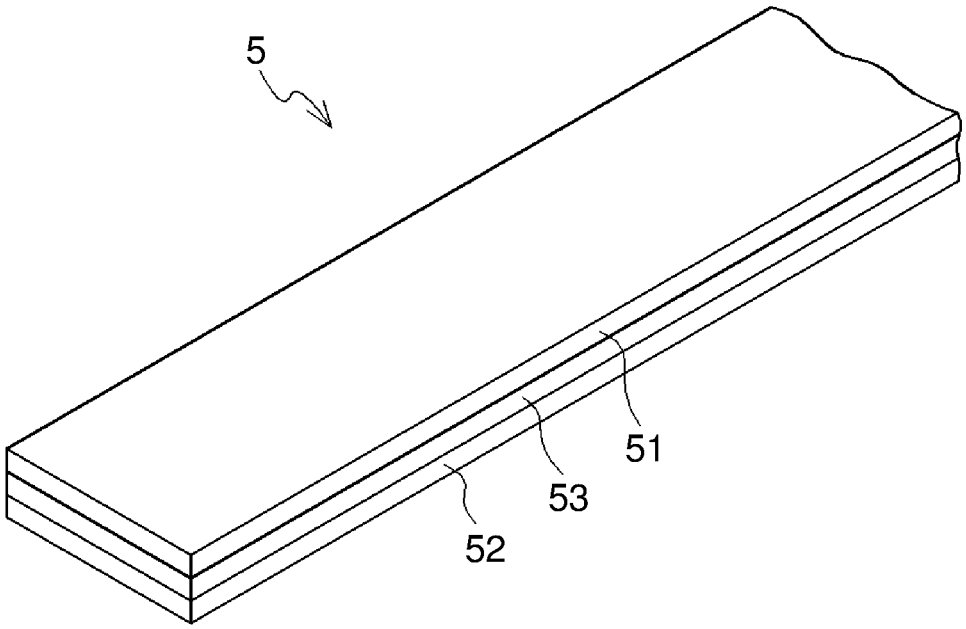
FIGS. 3A and 3B are perspective views of a receptor tape and a die-cut tape, respectively.

Such tapes including the receptor tape 5, the die-cut tape 9, the thermal tape (not shown), the transparent film tape (not shown), and the double-sided adhesive tape (not shown) will now be described with reference to FIGS. 3A and 3B. As shown in FIG. 3A, the receptor tape 5 includes a backing 51 and a release paper 52. The backing 51 includes an adhesive layer 53. The adhesive layer 53 is a layer of an adhesive (the same for an adhesive layer 93 described later). The surface of the backing 51 opposite to the adhesive layer 53 is a print surface on which characters are to be printed. The release paper 52 is releasably bonded to the backing 51 with the adhesive layer 53 between the release paper 52 and the backing 51.

Figure 3B:
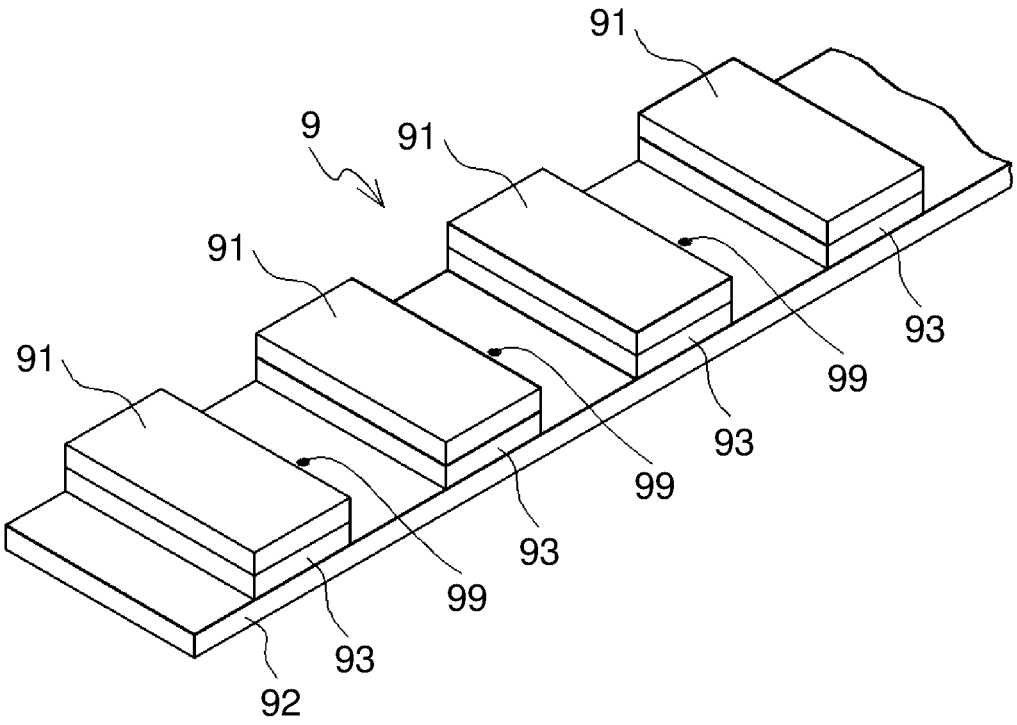

As shown in FIG. 3B, the die-cut tape 9 includes a plurality of backings 91 and a release paper 92. The plurality of backings 91 each include an adhesive layer 93. The release paper 92 is elongated. The backings 91, which are bonded to the release paper 92 in a releasable manner, are at regular intervals in the longitudinal direction of the release paper 92, with the adhesive layers 93 between the backings 91 and the release paper 92. The surface of each backing 91 opposite to the adhesive layer 93 is a print surface on which characters are to be printed. The marks 99 are on the release paper 92 without overlapping the backings 91. The marks 99 are through-holes at regular intervals in the longitudinal direction. The receptor tape 5 and the die-cut tape 9 have characters printed with the ink of the ink ribbon 8 thermally transferred to the print surfaces of the backings 51 and 91 by the thermal head 60.

The thermal tape (not shown) has characters printed with heat applied from the thermal head 60. The stencil tape (not shown) forms holes shaped as characters with heat applied by the thermal head 60. Printing in the present embodiment includes forming holes shaped as characters in the tape.

The transparent film tape has characters printed with the ink of the ink ribbon 8 thermally transferred to the print surface by the thermal head 60. A double-sided adhesive tape is bonded to the print surface of the printed transparent film tape. The tape including the double-sided adhesive tape bonded to the printed transparent film tape is hereafter also referred to as a laminate tape.

In the present embodiment, the die-cut tape 9 is more flexible than the receptor tape 5 and the thermal tape. The receptor tape 5 and the thermal tape are more flexible than the laminate tape. The laminate tape is more flexible than the stencil tape. The flexibility is determined by, for example, the thickness or the Young's modulus of the tape. For example, a tape with a larger thickness or a higher Young's modulus bends less. The receptor tape 5, the thermal tape, the stencil tape, and the laminate tape are more fragile than the die-cut tape 9. The fragility is determined by, for example, the surface material of the tape (including with or without a coating) or the surface profile of the tape (including with or without irregularity). For example, the tape with a harder surface is less fragile. The tape is not limited to those listed above, and may be, for example, a tube tape. The flexibility and the fragility of the tapes are described in mere examples.

For example, the printing of the printing device 1 with the receptor cassette 7 will now be described with reference to FIGS. 1 and 2. With the cover 3 open, the platen roller 65 is spaced from the thermal head 60 to the left, and the transport roller 66 from the tape driving shaft 61 to the left. In this state, a user attaches the cassette 7 to the receiving unit 6. When the cassette 7 is attached to the receiving unit 6, the ribbon winding shaft 62 is positioned in the ribbon winding spool 45. The tape driving shaft 61 is positioned in the tape driving roller 72. The head holder 69 is positioned in the head opening 71. A light emitter and a light receiver of the mark sensor 31 enter the case 70 through the holes 79. The light emitter and the light receiver of the mark sensor 31 oppose each other with the tape fed from the first tape spool 41 between them. The receptor tape 5 and the ink ribbon 8 are placed to have their width in the vertical direction.

With the cover 3 closed, the platen roller 65 moves toward the thermal head 60 and the transport roller 66 toward the tape driving shaft 61 from the left. Thus, the platen roller 65 places the ink ribbon 8 over the print surface of the backing 51 of the receptor tape 5 and presses the ink ribbon 8 against the thermal head 60. The transport roller 66 presses the receptor tape 5 against the tape driving roller 72. The state where the cassette 7 is attached to the receiving unit 6 with the cover 3 closed is referred to as a print ready state.

The position of the platen roller 65 holding the tape together with the thermal head 60 in a transport direction is referred to as a print position P1. The position of the transport roller 66 holding the tape together with the tape driving roller 72 in the transport direction is referred to as a first holding position P2. The load with which the platen roller 65 and the thermal head 60 hold the tape between them is referred to as a holding load at the print position P1. The load with which the transport roller 66 and the tape driving roller 72 hold the tape between them is referred to as a holding load at the first holding position P2. The first holding position P2 is downstream from the print position P1 in the transport direction. The holding load at the first holding position P2 is smaller than the holding load at the print position P1.

The printing device 1 can transport the tape by rotating the tape driving shaft 61, the platen roller 65, and the transport roller 66. To transport in the present embodiment includes forward transport and reverse transport. The forward transport refers to transporting the tape downstream in the transport direction. More specifically, the forward transport is to transport the tape by pulling it out of the first tape spool 41. The reverse transport refers to transporting the tape upstream in the transport direction.

To transport the tape forward, the printing device 1 drives the transport motor 68 (refer to FIG. 18) forward, to rotate the tape driving shaft 61 counterclockwise in a plan view, and to rotate the platen roller 65 and the transport roller 66 clockwise in a plan view. In this case, the tape driving roller 72 rotates counterclockwise in a plan view. The tape is transported forward between the transport roller 66 and the tape driving roller 72 (or transported downstream in the transport direction). The receptor tape 5 is transported forward between the platen roller 65 and the thermal head 60.

To transport the tape reversely, the printing device 1 drives the transport motor 68 reversely, to rotate the tape driving shaft 61 clockwise in a plan view, and to rotate the platen roller 65 and the transport roller 66 counterclockwise in a plan view. In this case, the tape driving roller 72 rotates clockwise in a plan view. The tape is reversely transported between the transport roller 66 and the tape driving roller 72 (or transported upstream in the transport direction). The receptor tape 5 is reversely transported between the platen roller 65 and the thermal head 60. Transporting the tape forward is hereafter also referred to as forward transport, and transporting the tape reversely is also referred to as reverse transport.

The printing device 1 detects the tape end before starting printing. To detect the tape end, the printing device 1 controls the transport motor 68 to at least transport the tape reversely, selectively from the forward and reverse transports. Thus, the tape end is detected.

The printing device 1 detecting the tape end starts printing. The printing device 1 prints on the tape while transporting the tape forward. More specifically, the printing device 1 heats the ink ribbon 8 with heat from the thermal head 60. The ink of the ink ribbon 8 is thermally transferred to the print surface of the backing 51 of the receptor tape 5 to print the characters at the print position P1. The printing device 1 drives the transport motor 68 forward to rotate the ribbon winding shaft 62, the tape driving shaft 61, the platen roller 65, and the transport roller 66. In response to rotation of the ribbon winding shaft 62, the ribbon winding spool 45 rotates to wind the ink ribbon 8 around the spool. In response to rotation of the tape driving shaft 61, the tape driving roller 72 rotates counterclockwise in a plan view. In response to rotation of the tape driving roller 72 and the transport roller 66, the receptor tape 5 is transported forward between the transport roller 66 and the tape driving roller 72 at the first holding position P2. In response to rotation of the platen roller 65, the receptor tape 5 is transported forward between the platen roller 65 and the thermal head 60.

The printed portion of the receptor tape 5 is discharged from the cassette 7, and cut by the cutter unit 100 (described later). The cut piece of the receptor tape 5 is discharged through the outlet slit 11 out of the printing device 1 by the discharging unit 200.

Figure 5:
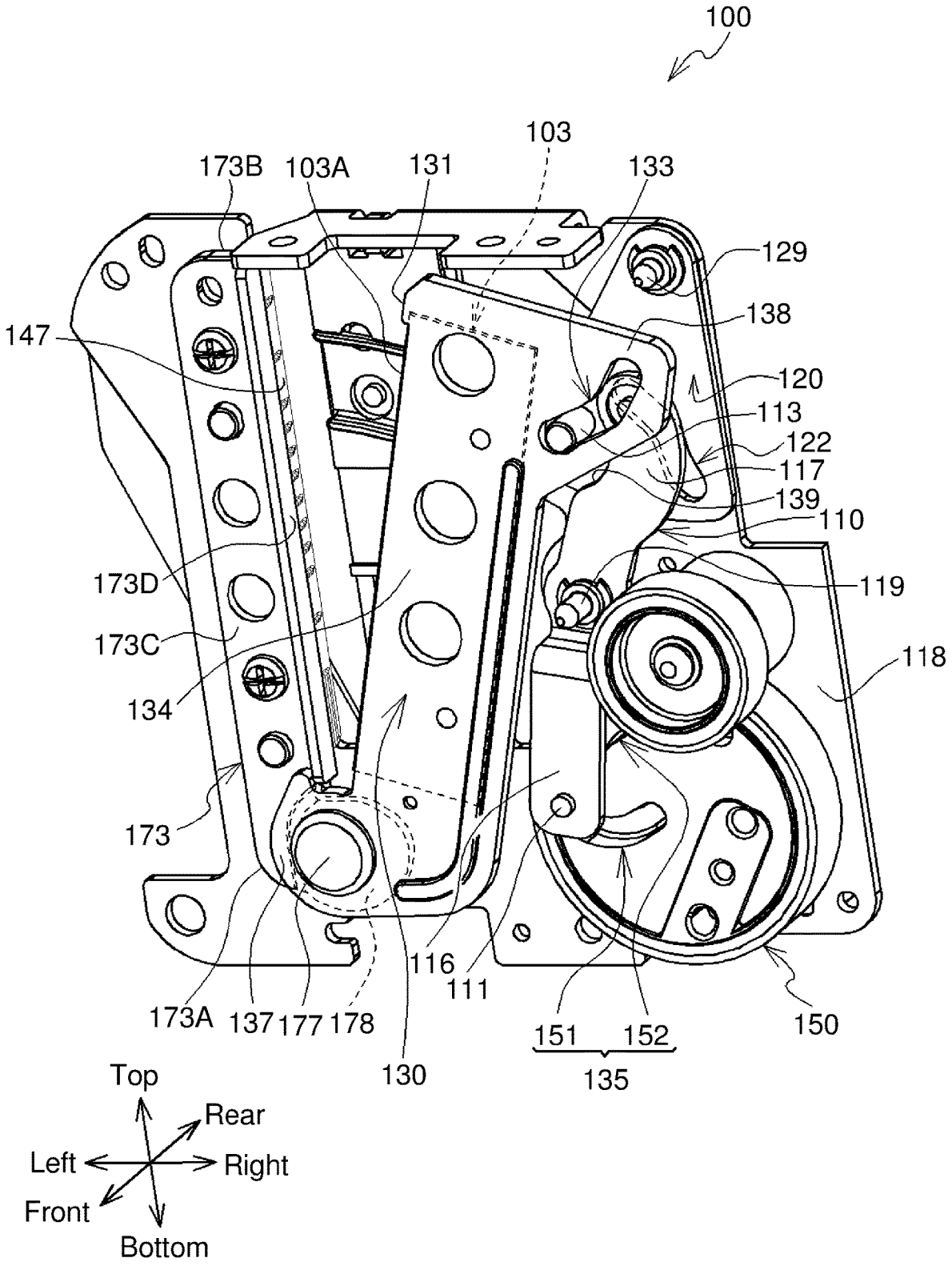
FIG. 5 is a perspective view of the cutter unit shown in FIG. 4 excluding a second frame, and coupling gears.
Figure 6:
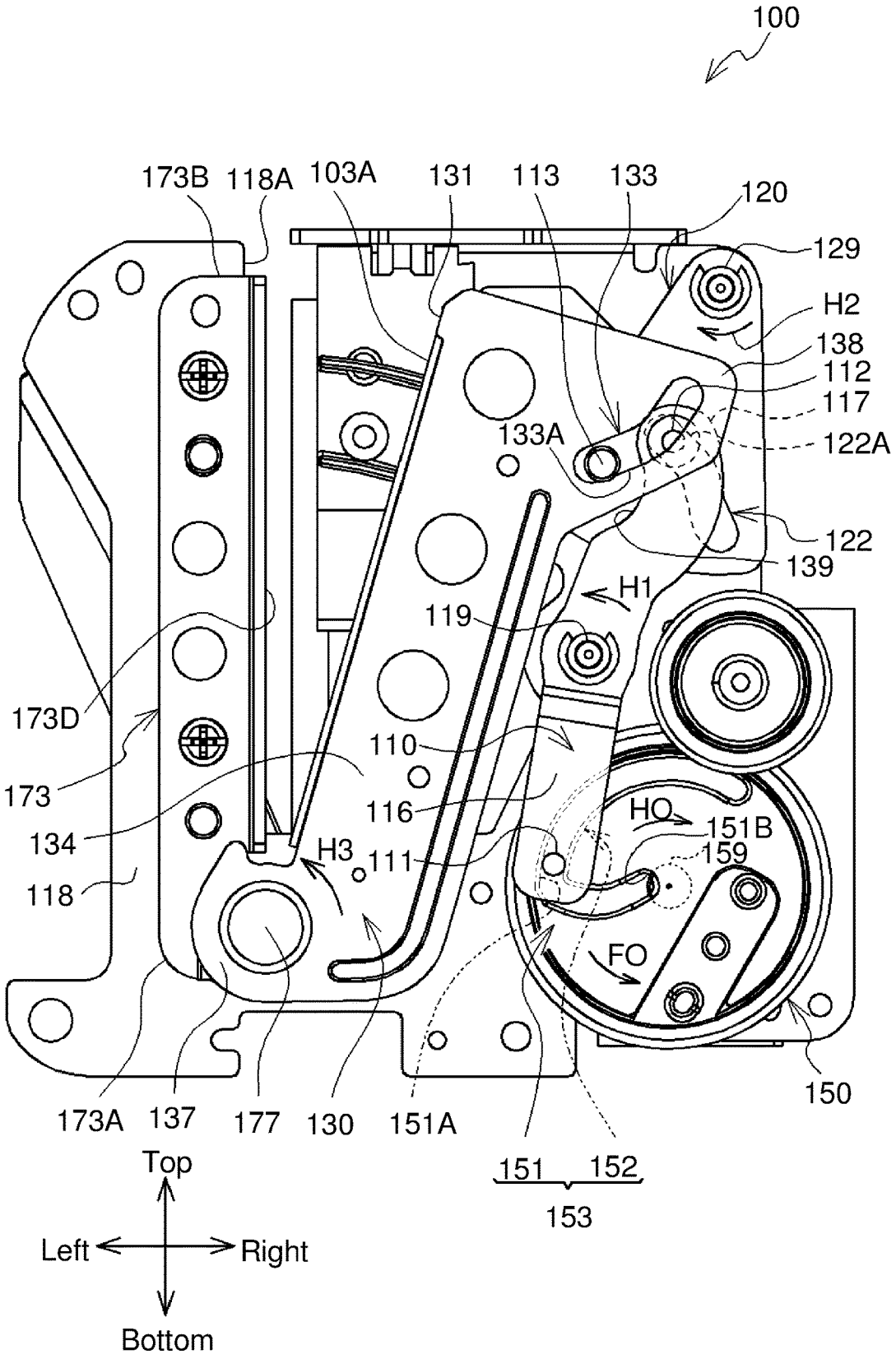
FIG. 6 is a front view of a cutter unit in the initial state.

The structure of the cutter unit 100 will now be described in detail with reference to FIGS. 4 to 8. In FIGS. 5 and 6, a second frame 109 and coupling gears 105B, 125, and 126 included in the cutter unit 100 are not shown (also in FIGS. 9 and 10). The cutter unit 100 is accommodated in the casing 2 at the rear of the outlet slit 11 and in front of the transport roller 66.

Figure 4:
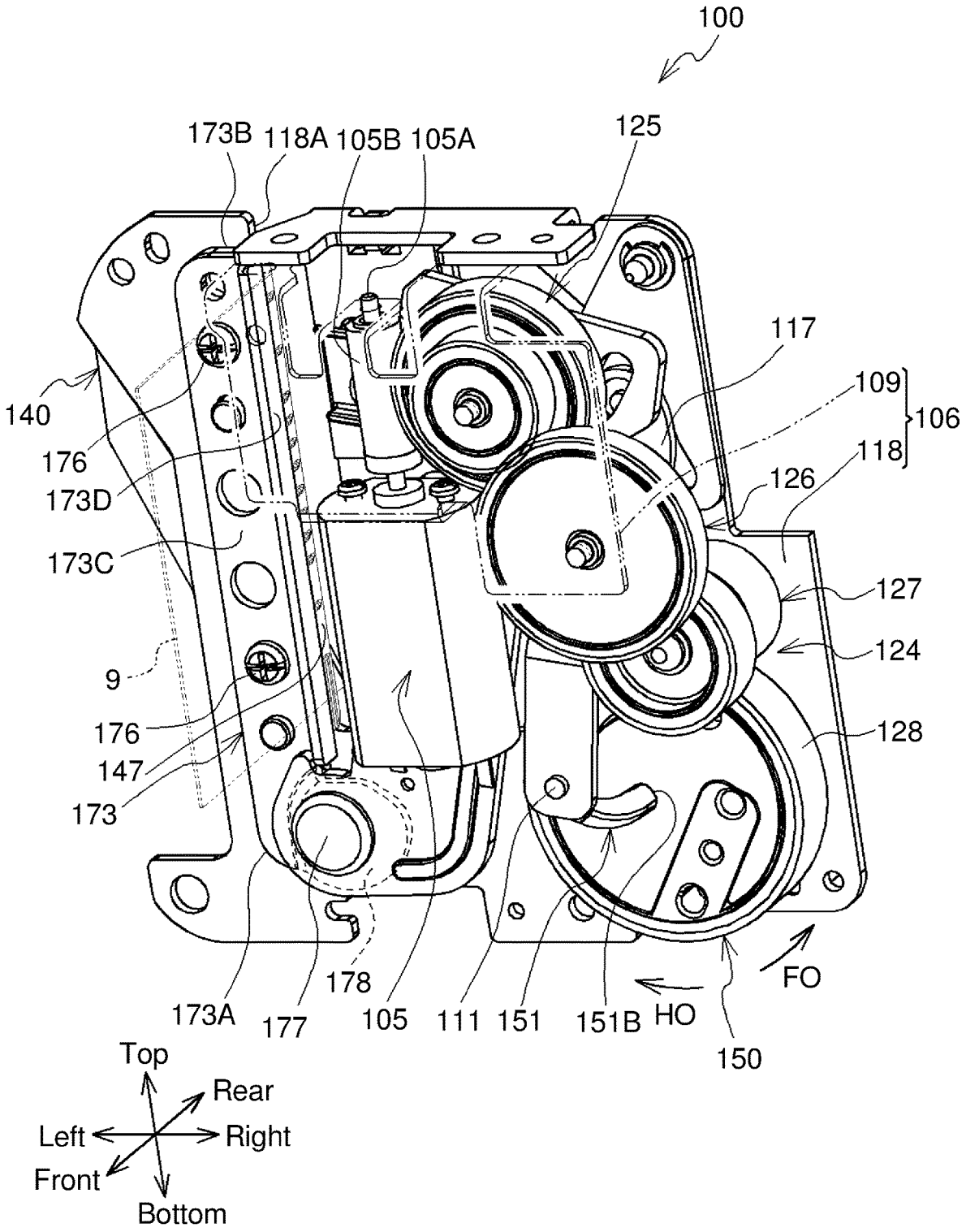
FIG. 4 is a perspective front view of a cutter unit in an initial state as viewed from right above.

As shown in FIG. 4, the cutter unit 100 includes a fixing frame 106. The fixing frame 106 is fixed inside the casing 2 (refer to FIG. 1). The fixing frame 106 includes a first frame 118 and a second frame 109. The second frame 109 is rectangular in a rear view, and drawn with two-dot chain lines. The first frame 118 is arranged in front of the second frame 109, and includes a first slit 118A. The first slit 118A extends through the first frame 118 in a front-rear direction, and is arranged behind a second slit 201 (described later). The tape passes through the first slit 118A. A guide 147 is arranged at a left opening end of the first slit 118A. The guide 147 includes a plurality of ribs protruding rightward and arranged vertically. The guide 147 guides the tape transported forward toward the second slit 201.

A mount base 173 is fixed to the first frame 118. The mount base 173 is a plate. The mount base 173 has a lower end 173A below the first slit 118A. The lower end 173A includes a protrusion 178. The protrusion 178 protrudes forward from the lower end 173A. The protrusion 178 has a fixing hole. The fixing hole is circular in a front view. A shaft 177 is fixed to the fixing hole. The shaft 177 extends in the front-rear direction. The mount base 173 includes an elongated portion 173C and a mount board 173D. The elongated portion 173C extends between the lower end 173A and an upper end 173B of the mount base 173. The elongated portion 173C is fixed to the first frame 118 with two screws 176 on the left of the first slit 118A. The mount board 173D protrudes forward from the right end of the elongated portion 173C, and is rectangular and long vertically in a right side view. The tape upstream from (or at the rear of) the guide 147 in the transport direction is placed on the mount board 173D.

A cutter motor 105 is fixed to the lower end of the second frame 109 on the right of the first slit 118A. The cutter motor 105 has an output shaft 105A extending upward in the cutter motor 105. A coupling gear 105B is fixed to the output shaft 105A.

A rotator 150 is located on the lower right and behind the cutter motor 105. The rotator 150 is located rightward from the shaft 177, and has a circular shape in a front view. The rotator 150 is rotatably supported by a shaft 159 (refer to FIG. 8). The shaft 159 extends through the first frame 118 in the front-rear direction, and is fixed to the first frame 118.

A gear train 124 is located rightward from the output shaft 105A. The gear train 124 includes coupling gears 125 to 127 and a cam gear 128. The coupling gears 125 to 127 and the cam gear 128 are arranged from the above vertically, and axially rotatable in the front-rear direction. The coupling gears 125 to 127 are double gears. The coupling gears 125 and 126 are rotatably supported by the second frame 109. The coupling gear 125 meshes with the coupling gear 105B. The coupling gear 127 is rotatably supported by the first frame 118. The cam gear 128 is driven lastly in the gear train 124, and integral with the peripheral surface of the rotator 150. The coupling gears 125 to 127 and the cam gear 128 mesh with one another. The driving force of the cutter motor 105 is thus transmitted to the rotator 150 via the coupling gear 105B and the gear train 124.

As shown in FIGS. 5 and 6, the rotator 150 has groove cams 151 and 152. The groove cams 151 and 152 are open to the front and are continuous and integral with each other. The groove cam 151 extends between its two ends, or from a starting end 151A to a terminal end 151B, toward the shaft 159. The groove cam 152 extends from the starting end 151A in an arc about the shaft 159 clockwise in a front view. The groove cams 151 and 152 are hereafter collectively referred to as a groove cam 153.

A support shaft 119 is located on the upper left of the rotator 150. The support shaft 119 protrudes forward from the first frame 118 to swingably support a first link 110. The first link 110 opposes the first frame 118 with a space in the front-rear direction, and extends vertically. The first link 110 has a portion extending forward, and then being bent downward below the support shaft 119. The first link member 110 has a vertically extending portion above the support shaft 119. The first link member 110 has a lower end portion 116 arranged in front of the rotator 150. A pin 111 is arranged on the lower end portion 116. The pin 111 protrudes rearward from the lower end portion 116 and is engaged with the groove cam 153. As the rotator 150 rotates, the groove cam 151 slides on the pin 111 to allow the first link 110 to swing about the support shaft 119.

A pin 112 and a recess 139 are arranged on an upper end portion 117 of the first link 110. The pin 112 protrudes rearward from the upper end portion 117 into a through-hole 197 (refer to FIG. 8). The through-hole 197 extends through the first frame 118 in the front-rear direction. The recess 139 is recessed clockwise about the support shaft 119 in a front view.

A second link 120 is arranged between the first link 110 and the first frame 118. The second link 120 is swingably supported by a support shaft 129. The support shaft 129 protrudes forward from the first frame 118 rightward from the upper end 173B. The second link 120, which is a sector-shaped plate about the support shaft 129, opposes and is in contact with the front of the first frame 118. An end portion 121 of the second link 120 away from the support shaft 129 opposes the rear of the upper end portion 117.

Figure 7:
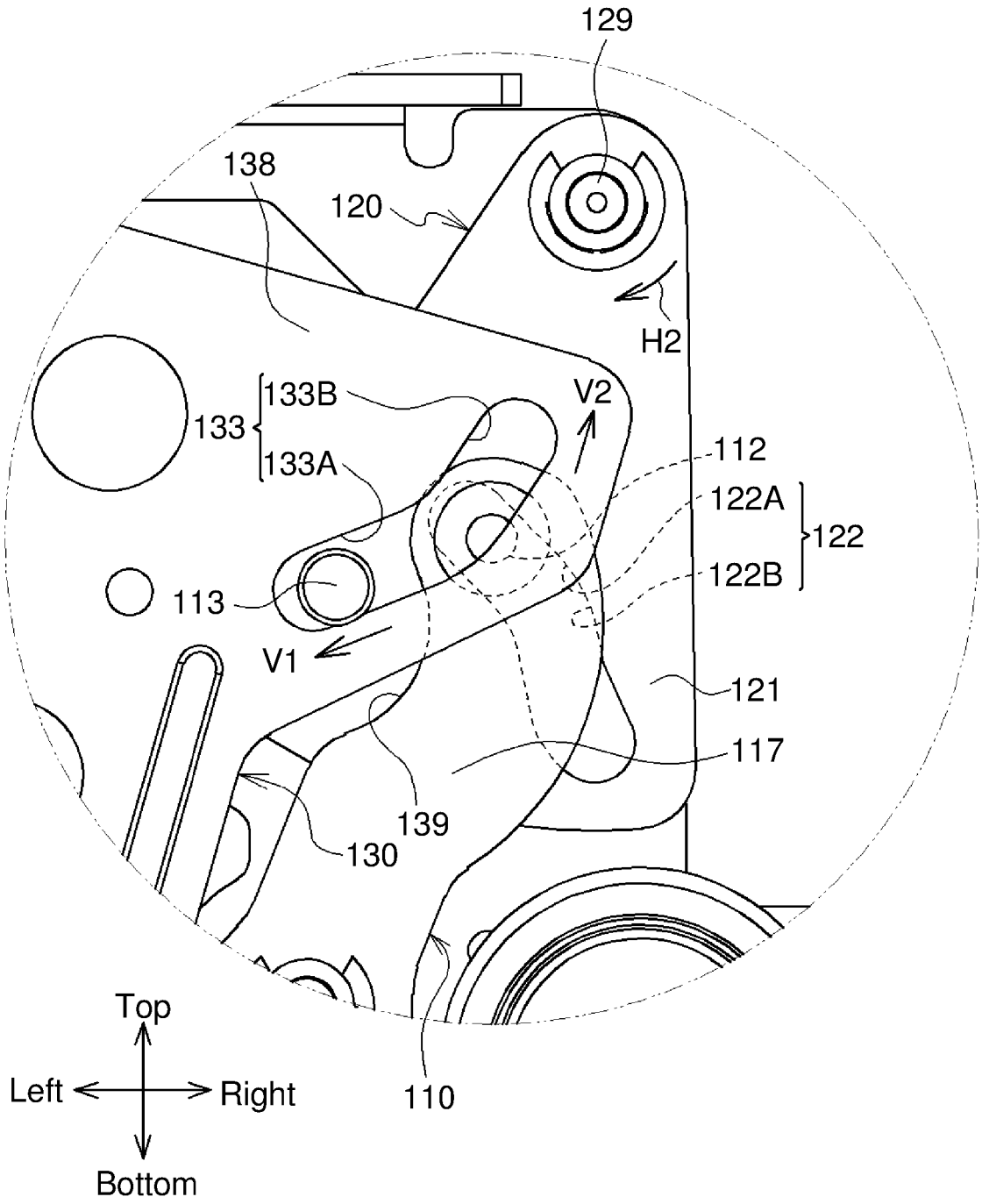
FIG. 7 is an enlarged front view of a second link with a cutter unit in the initial state.

As shown in FIG. 7, the end portion 121 has a groove cam 122. The groove cam 122 is engaged with the pin 112, and has cams 122A and 122B. The cams 122A and 122B are continuous and integral grooves and are arranged in this order from the support shaft 129. The cam 122A extends away from the support shaft 129, and the cam 122B extends from the cam 122A further away from the support shaft 129. The cams 122A and 122B extend in directions crossing each other. As the first link 110 swings, the pin 112 slides on the groove cam 122 to allow the second link 120 to swing about the support shaft 129. A pin 113 is arranged at the end portion 121. The pin 113 shown in FIG. 7 protrudes forward from the end portion 121 and is arranged inward from the recess 139.

As shown in FIGS. 5 and 6, a movable holder 130 is arranged in front of the second link 120. The movable holder 130 is swingably supported by the shaft 177. The movable holder 130 has a lower end portion 137 swingably coupled to the shaft 177 in front of the lower end 173A of the mount base 173. The movable holder 130 has an upper end portion 138 opposing the front of the upper end portion 117 of the first link 110.

The movable holder 130 includes a fastening portion 134, a partial-cut blade 103, and an extension 131. The fastening portion 134 extends between the lower end portion 137 and the upper end portion 138, and opposes the rear of the cutter motor 105 (refer to FIG. 4). The partial-cut blade 103 is a plate having a thickness in the front-rear direction, and fastened to the rear surface of the fastening portion 134. The left end of the partial-cut blade 103 is a sharp cutting edge 103A. The cutting edge 103A protrudes leftward in a swing direction of the movable holder 130 to protrude slightly from the elongated portion 173C. The cutting edge 103A opposes the mount board 173D of the mount base 173 in the swing direction of the movable holder 130. The extension 131 protrudes from the upper end portion 138 leftward in the swing direction of the movable holder 130, and opposes the mount board 173D in the swing direction of the movable holder 130. The distal end (or the left end) of the extension 131 slightly extends leftward from the cutting edge 103A.

As shown in FIG. 7, the upper end portion 138 has a groove cam 133. The groove cam 133 is engaged with the pin 113, and has grooves 133A and 133B. The grooves 133A and 133B are continuous and integral with each other. The groove 133A extends away from the shaft 177 (refer to FIG. 6). The groove 133B extends from the groove 133A further away from the shaft 177. The grooves 133A and 133B extend in different directions.

As the second link 120 swings, the pin 113 slides on the groove cam 133 to allow the movable holder 130 to swing about the shaft 177 between the partial-cut position (refer to FIG. 9) and a retracted position (refer to FIG. 5). The partial-cut position is a swing position of the movable holder 130 at which the distal end of the extension 131 abuts against the mount board 173D. The retracted position is a swing position of the movable holder 130 retracted rightward from the partial-cut position. At the retracted position, the movable holder 130 has its cutting edge 103A spaced to the right from the tape on the mount board 173D. The cutting edge 103A is rightward from the distal end of the extension 131. Thus, a gap forms between the cutting edge 103A and the mount base 173 when the movable holder 130 is at the partial-cut position. The gap in the swing direction of the movable holder 130 is smaller than the thickness of the tape.

Figure 8:
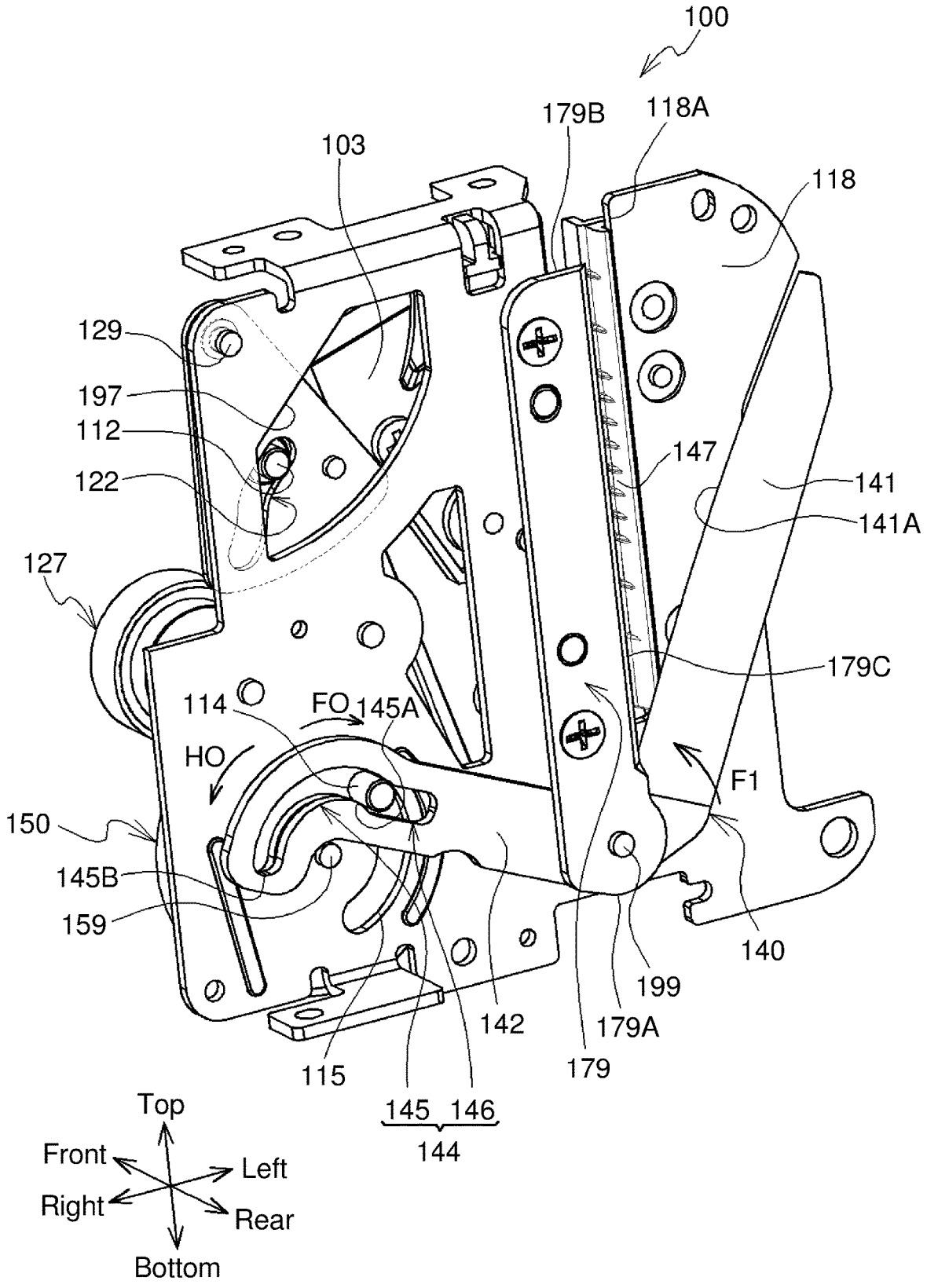
FIG. 8 is a perspective rear view of a cutter unit with a full-cut blade at a separate position as viewed from right above.

As shown in FIG. 8, a fixed blade 179 and a full-cut blade 140 are to at the rear of the first frame 118. The fixed blade 179 is fixed to the first frame 118 on the right of the first slit 118A. The fixed blade 179 is a rectangular plate extending vertically in a rear view. The fixed blade 179 has a lower end 179A to which a shaft 199 is fixed. The shaft 199 extends in the front-rear direction and protrudes rearward from the first frame 118. The fixed blade 179 includes an edge 179C. The edge 179C is at the left end of the fixed blade 179 and extends vertically. The tape is placed on the edge 179C between the lower end 179A and an upper end 179B of the fixed blade 179.

The full-cut blade 140 is swingably supported by the shaft 199 between the first frame 118 and the fixed blade 179 in the front-rear direction. The full-cut blade 140 is an L-shaped plate in a front view. The full-cut blade 140 includes arms 141 and 142. The arm 141 extends upward from the shaft 199. The arm 142 extends rightward from the shaft 199. A sharpened edge 141A extends in the longitudinal direction of the arm 141 at the end of the arm 141 in the direction counterclockwise about the shaft 199 in a rear view. The edge 141A opposes the edge 179C of the fixed blade 179 in the swing direction of the full-cut blade 140.

The arm 142 has a groove cam 144 in its right portion. The groove cam 144 is open in the front-rear direction and engaged with a pin 114. The pin 114 protrudes rearward from the rotator 150 into an insertion hole 115. The insertion hole 115 extends through the first frame 118 in the front-rear direction, and extends in an arc about the shaft 159.

The groove cam 144 has an arc-shaped cam 145 and an elongated cam 146. The arc-shaped cam 145 and the elongated cam 146 are continuous and integral grooves. The arc-shaped cam 145 extends between its two ends, or from a starting end 145A to a terminal end 145B counterclockwise in an arc about the shaft 159 in a rear view. The elongated cam 146 linearly extends toward the shaft 199 from the starting end 145A of the arc-shaped cam 145.

As the rotator 150 rotates, the pin 114 slides on the elongated cam 146 to allow the full-cut blade 140 to swing about the shaft 199 between the full-cut position (refer to FIG. 12) and a separate position (refer to FIG. 8). The full-cut position is a swing position of the full-cut blade 140 at which the edge 141A is located rightward beyond the edge 179C of the fixed blade 179. The separate position is a swing position of the full-cut blade 140 at which the edge 141A is spaced from the tape on the edge 179C leftward. The swing direction of the full-cut blade 140 is parallel to the swing direction of the movable holder 130.

Partial cutting by the cutter unit 100 will now be described with reference to FIGS. 6, and 9 to 11. Partial cutting is to cut a tape across its width at least partially in the thickness direction. Before partial cutting is started, the tape is placed on the mount board 173D after transported by a plurality of rollers of the printing device 1 to the position passing the first slit 118A. Before partial cutting is started, the cutter unit 100 is in an initial state (refer to FIGS. 6 and 8). When the cutter unit 100 is in the initial state, the pin 111 is in contact with the starting end 151A. The pin 112 is in contact with the upper end of the cam 122A. The pin 113 is in contact with the lower portion of the groove 133A. The movable holder 130 is at the retracted position. The pin 114 is in contact with the starting end 145A. The full-cut blade 140 is at the separate position.

When the cutter motor 105 (refer to FIG. 4) starts being driven, the coupling gear 105B rotates together with the output shaft 105A. The gear train 124 transmits the driving force of the cutter motor 105 to the rotator 150 to allow the rotator 150 to rotate clockwise in a front view (arrow H0). The groove cam 151 of the rotator 150 rotates while pressing the pin 111 rightward (refer to FIGS. 6 and 10). Thus, the first link 110 swings counterclockwise in a front view (arrow H1). As the first link 110 swings, the pin 112 swings while pressing the cam 122A of the groove cam 122 leftward. Thus, the second link 120 swings clockwise in a front view while sliding on the first frame 118 (arrow H2). The pin 112 swings relative to the second link 120 upward from the recess 139. As the second link 120 swings, the pin 113 presses the groove 133A of the groove cam 133 leftward. Thus, the movable holder 130 swings from the retracted position toward the partial-cut position (arrow H3). The pin 113 slides from one end of the groove cam 133 in the longitudinal direction (direction of arrow V1 in FIGS. 7 and 11) to another end in the longitudinal direction (direction of arrow V2).

While the movable holder 130 is swinging toward the partial-cut position, the pin 114 (refer to FIG. 8) slides from the starting end 145A to the terminal end 145B of the arc-shaped cam 145 without pressing the full-cut blade 140. Thus, the full-cut blade 140 remains stationary at the separate position.

Figure 9:
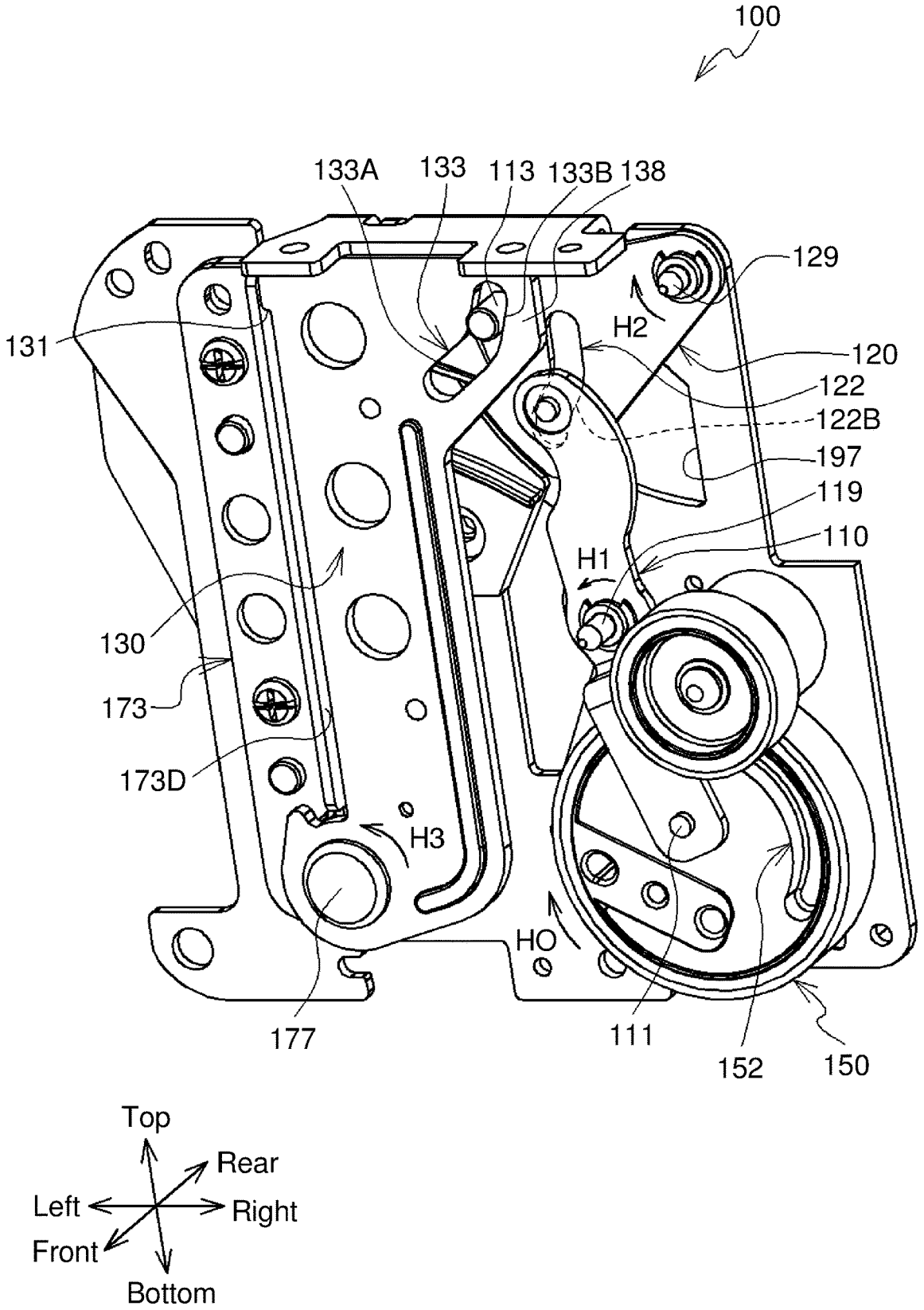
FIG. 9 is a perspective front view of a cutter unit during partial cutting as viewed from right above.
Figure 10:
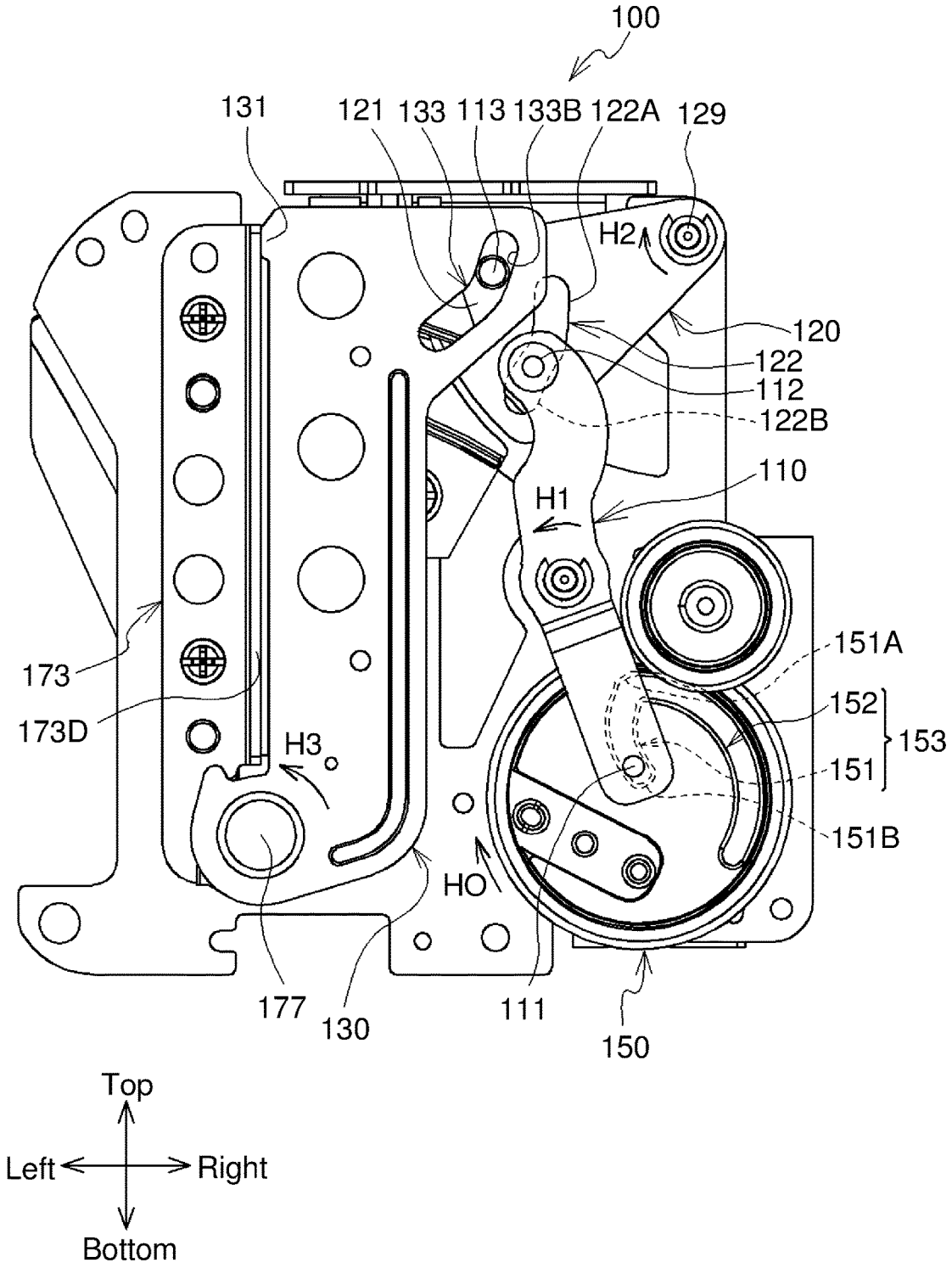
FIG. 10 is a front view of a cutter unit performing a partial cutting operation.
Figure 11:
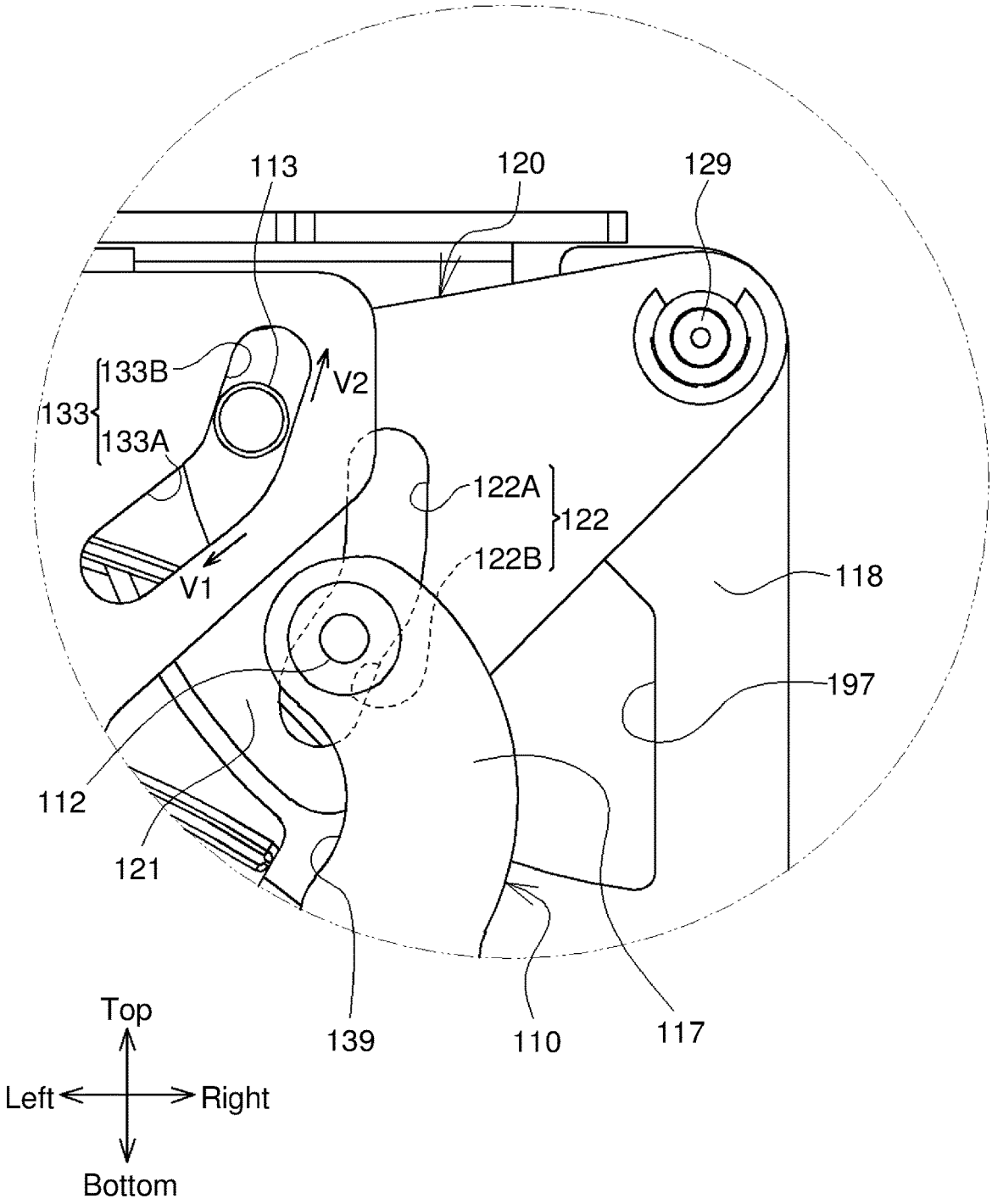
FIG. 11 is an enlarged front view of a second link during the partial cutting operation.

As shown in FIGS. 9 to 11, while the pin 111 is sliding toward the terminal end 151B as the rotator 150 rotates, the pin 112 slides on the cam 122B in place of the cam 122A, and the pin 113 slides on the groove 133B in place of the groove 133A. As the movable holder 130 swings continuously, the cutting edge 103A starts cutting the tape gradually from below.

When the cutting edge 103A starts cutting the tape, the sliding pin 112 slides on the cam 122B while swinging in the direction away from the support shaft 129. After the tape is cut up to the upper end and the extension 131 abuts against the mount board 173D, the movable holder 130 reaches the partial-cut position. The portion of the tape located in the clearance between the cutting edge 103A and the mount base 173 (or a portion of the tape in the width direction) remains uncut. Thus, the partial-cut blade 103 partially cuts the tape across the width with the cutting edge 103A. The cutter motor 105 stops being driven. The position in the transport direction at which the partial-cut blade 103 partially cuts the tape across the width is hereafter referred to as a second cut position P4 (refer to FIG. 2). The second cut position P4 is downstream from a first cut position P3 (described later) in the transport direction.

The cutter motor 105 is driven in the opposite direction from the start of partial cutting. The rotator 150, the first link 110, the second link 120, and the movable holder 130 operate in the opposite direction from the start of partial cutting. The pin 113 returns inward from the recess 139 of the upper end portion 117. The cutter unit 100 returns to the initial state. The partial cutting is complete when the cutter motor 105 stops being driven.

Figure 12:
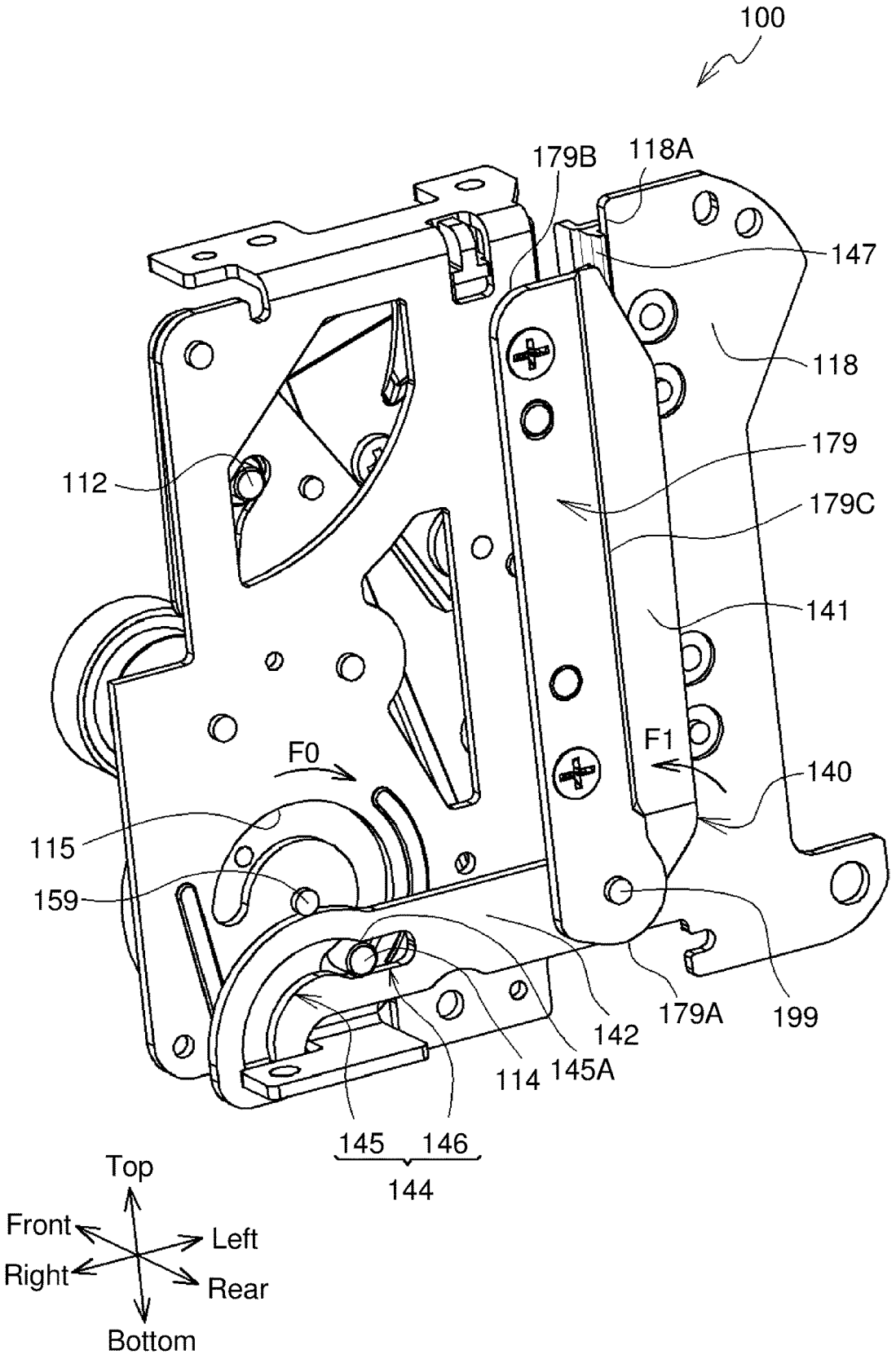
FIG. 12 is a perspective rear view of a full-cut blade at a full-cut position as viewed from right above.

Full cutting by the cutter unit 100 will now be described with reference to FIGS. 6, 8, and 12. Full cutting is to cut a tape across its width fully in the thickness direction. Before full cutting is started, the cutter unit 100 is in the initial state.

The cutter motor 105 starts rotating in the opposite direction from the start of partial cutting. Thus, the rotator 150 rotates counterclockwise in a front view (arrow F0). The pin 111 slides on the groove cam 152 in the groove cam 153 (refer to FIG. 6) without being pressed. The groove cam 153 has the groove cam 152 (refer to FIG. 6) sliding on the pin 111 without pressing the pin 111. Thus, the movable holder 130 remains stationary at the retracted position.

As the rotator 150 rotates, the pin 114 slides on the elongated cam 146 while pressing the elongated cam 146 downward. Thus, the full-cut blade 140 starts swinging toward the full-cut position (arrow F1). As the pin 114 slides on the elongated cam 146, the edge 141A of the full-cut blade 140 holds the tape gradually from below together with the edge 179C of the fixed blade 179 between the edges 141A and 179C. The tape is cut gradually from its lower edge into two pieces. After the tape is cut across in the vertical direction, the full-cut blade 140 reaches the full-cut position. The full-cut blade 140 fully cuts the tape with the edges 141A and 179C. The cutter motor 105 stops being driven. The position at which the full-cut blade 140 fully cuts the tape in the transport direction is hereafter referred to as a first cut position P3. The first cut position P3 is downstream from the first holding position P2 in the transport direction.

The cutter motor 105 is driven in the opposite direction from the start of full cutting. The rotator 150 and the full-cut blade 140 operate in the opposite direction from the start of full cutting, and the cutter unit 100 returns to the initial state. Full cutting is complete when the cutter motor 105 stops being driven.

The structure of the discharging unit 200 will now be described in detail with reference to FIGS. 13 to 17. FIG. 14 does not show a third frame 213, a guide frame 214, and a position sensor 295 included in the discharging unit 200. The discharging unit 200 is accommodated in the casing 2 at the rear of the outlet slit 11 and downstream from (or, in front of) the cutter unit 100 in the transport direction (refer to FIG. 2).

Figure 13:
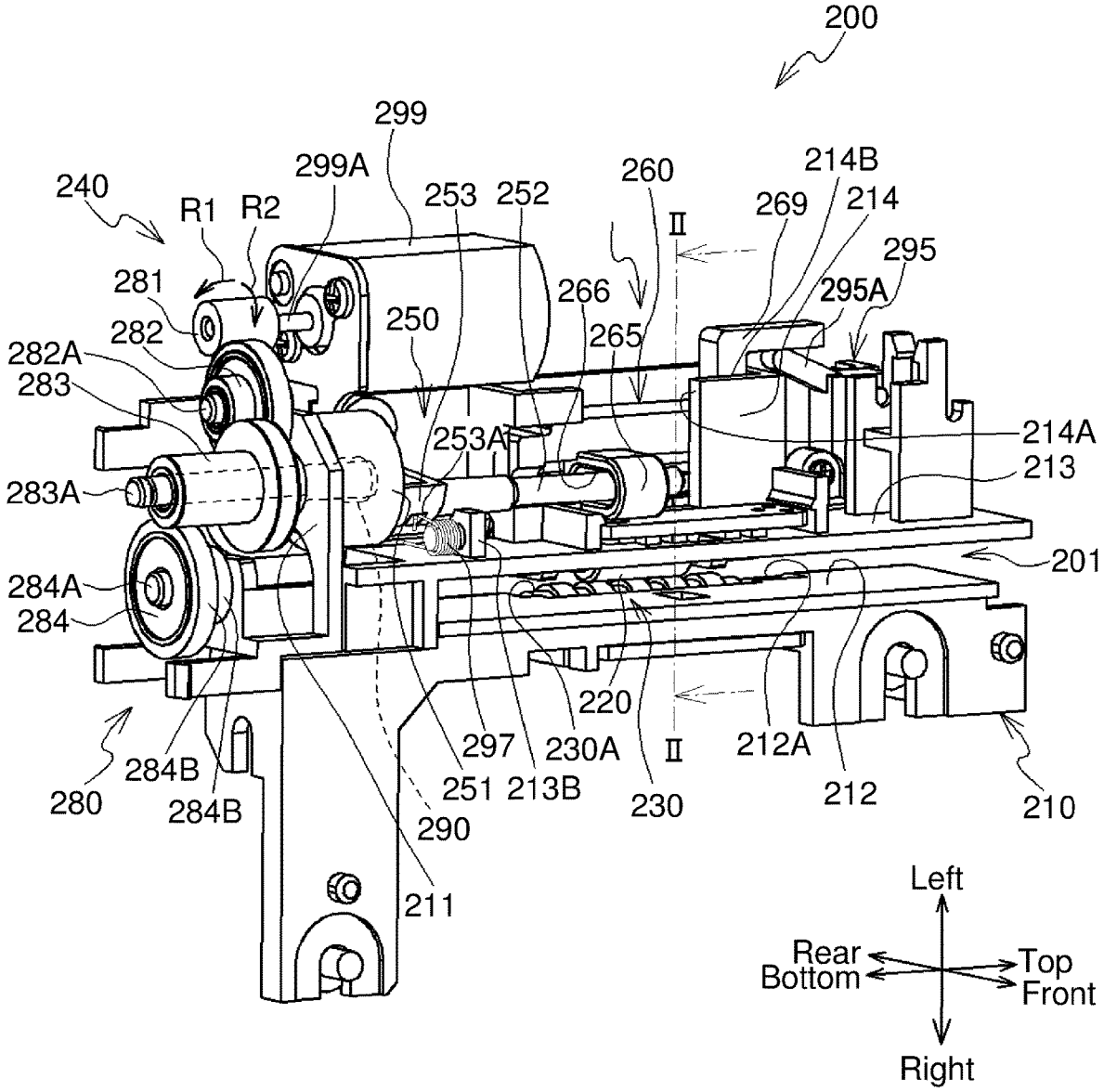
FIG. 13 is a perspective front view of a discharging unit with a discharging roller at a nip position as viewed from left below.
Figure 14:
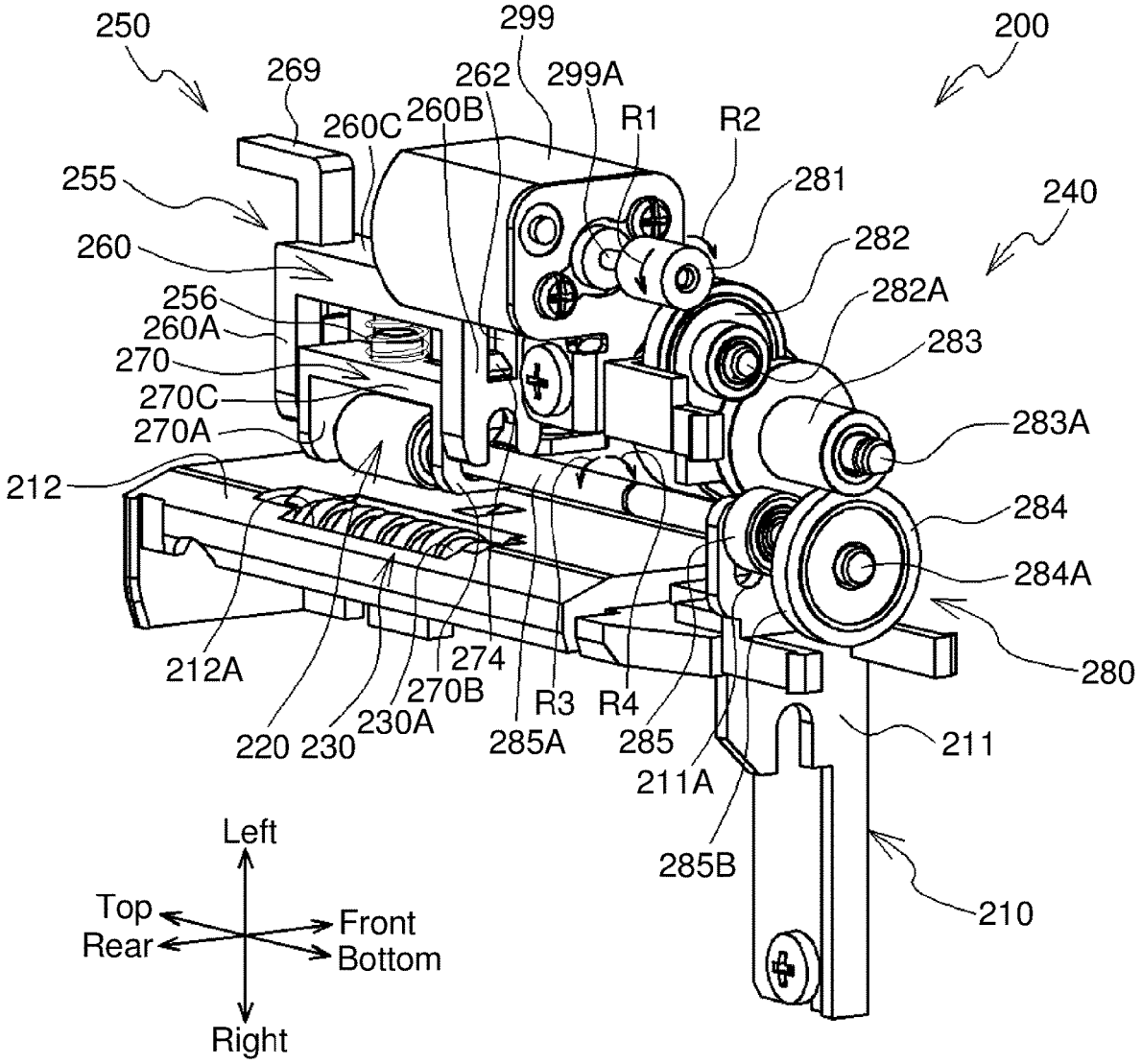
FIG. 14 is a perspective rear view of a discharging unit with a discharging roller at a release position as viewed from left below.

As shown in FIGS. 13 and 14, the discharging unit 200 includes a fixing frame 210, a discharging roller 220, opposing rollers 230, a discharge motor 299, a first coupling mechanism 280, a moving mechanism 250, a second coupling mechanism 240, and a position sensor 295. The fixing frame 210 is fixed inside the casing 2 at the rear of the outlet slit 11, and includes a first frame 211, a second frame 212, and a third frame 213.

The first frame 211 is arranged in a lower portion of the discharging unit 200, and extends in a direction perpendicular to the vertical direction. The second frame 212 and the third frame 213 extend upward from the first frame 211 in a direction perpendicular to the lateral direction. The third frame 213 is on the left of the second frame 212, and opposes the second frame 212 with a predetermined clearance between the frames 212 and 213. The clearance between the second frame 212 and the third frame 213 defines the second slit 201. The second slit 201 is arranged in front of the first slit 118A, and at the rear of the outlet slit 11 (refer to FIGS. 16 and 17). The tape is transported forward in the order of the first slit 118A, the second slit 201, and the outlet slit 11 from upstream (from the rear) to downstream (to the front) in the transport direction.

In one example, the receptor tape 5 passes through the first slit 118A, the second slit 201, and the outlet slit 11 with the backing 51 facing rightward and the release paper 52 facing leftward. In another example, the die-cut tape 9 passes through the first slit 118A, the second slit 201, and the outlet slit 11 with the backing 91 facing rightward and the release paper 92 facing leftward.

Figure 16:
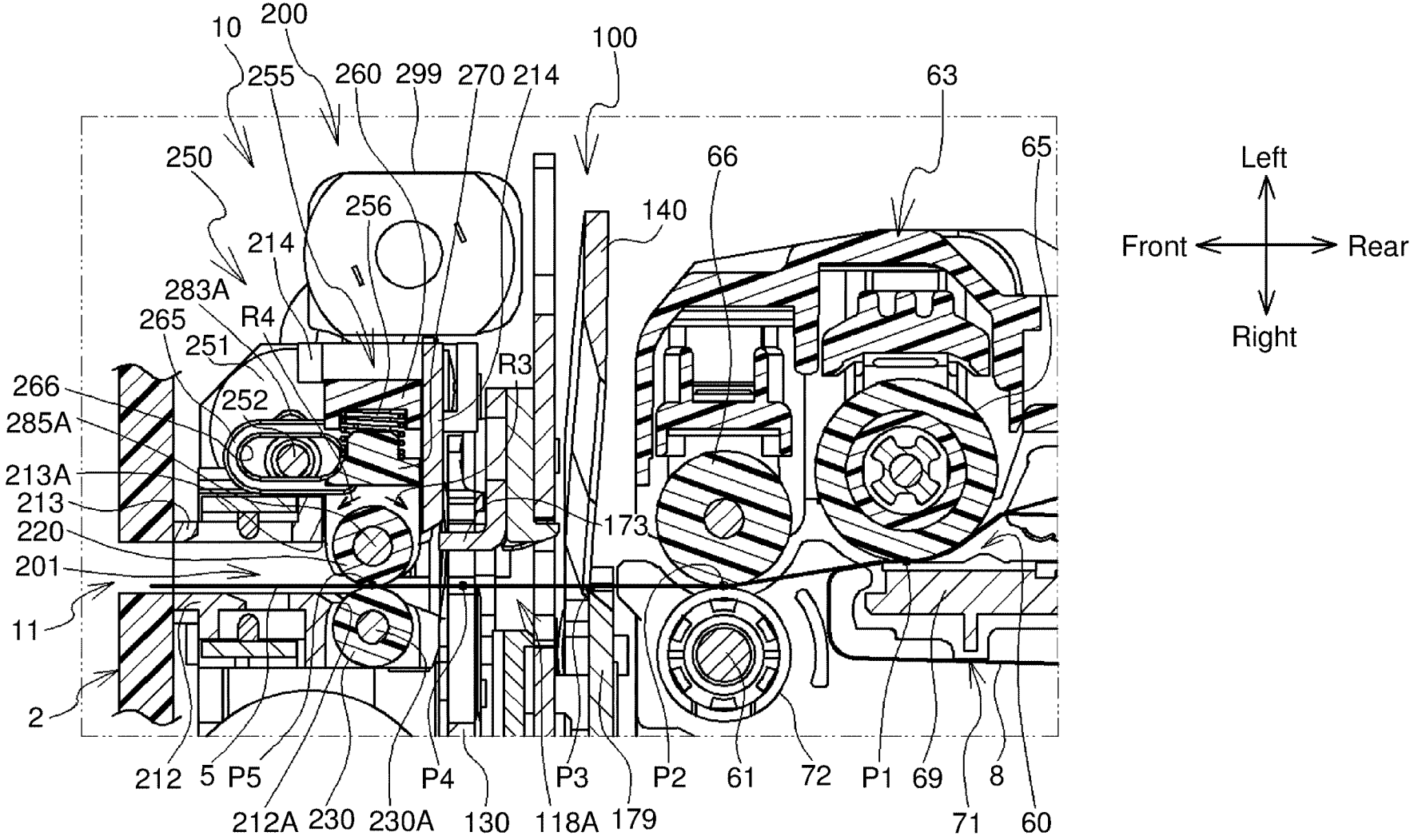
FIG. 16 is an enlarged view of an area W in FIG. 2 with the discharging roller at a nip position.
Figure 17:
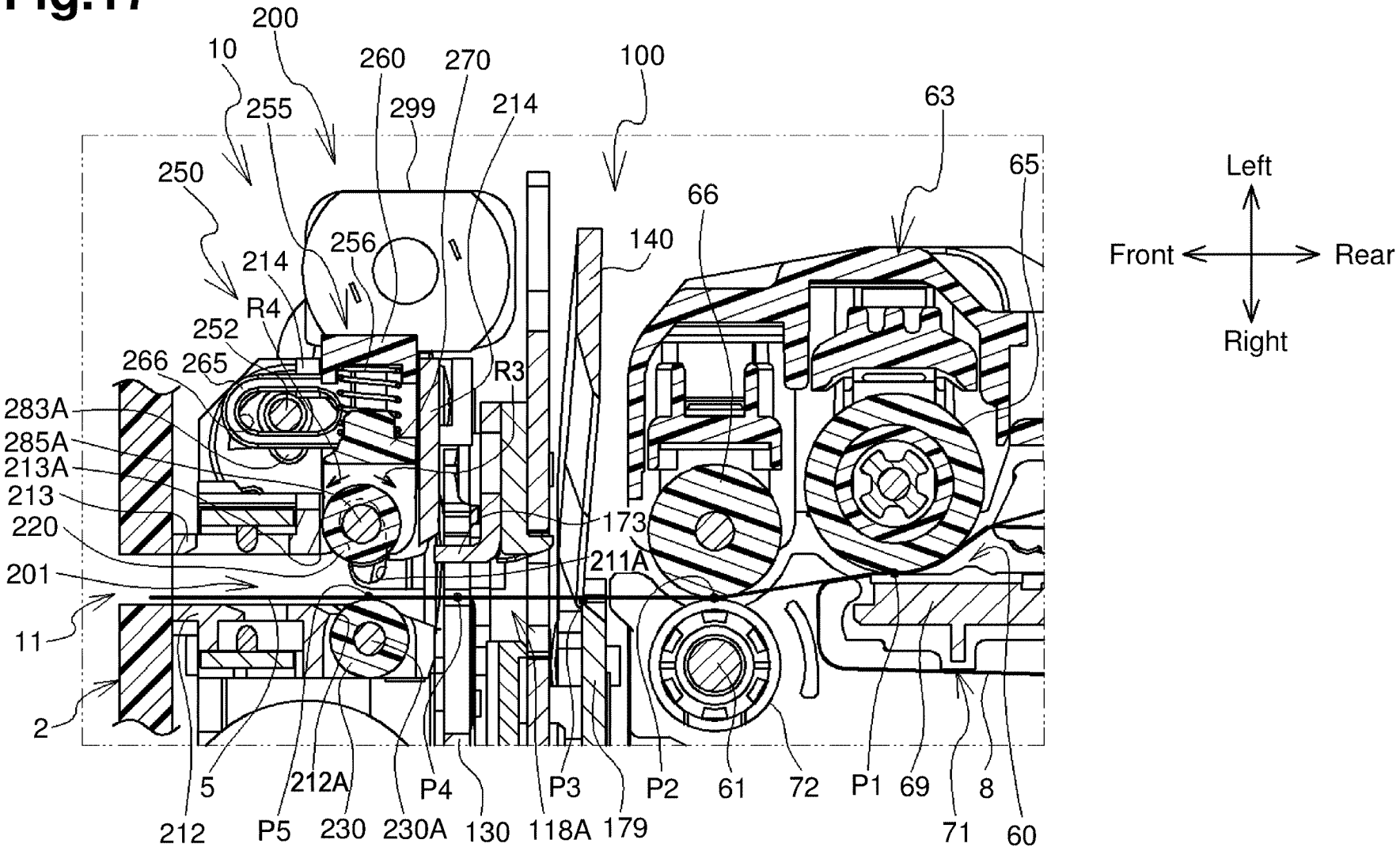
FIG. 17 is an enlarged view of the area W in FIG. 2 with the discharging roller at a release position.

The discharging roller 220 is on the left of the second slit 201 downstream from (in front of) the transport roller 66 and the tape driving shaft 61 in the transport direction (refer to FIGS. 16 and 17). More specifically, the discharging roller 220 faces the release paper 52 of the receptor tape 5. The discharging roller 220 is a cylindrical elastic member extending vertically and is arranged in a hole 213A (refer to FIGS. 16 and 17). The hole 213A extends through a rear end portion of the third frame 213 in the lateral direction, and is rectangular and long vertically in a side view.

The opposing rollers 230 are on the right of the second slit 201 downstream from (in front of) the transport roller 66 and the tape driving shaft 61 in the transport direction (refer to FIGS. 16 and 17). More specifically, the opposing rollers 230 face the backing 51 of the receptor tape 5. The opposing rollers 230 are on the right of the discharging roller 220 and oppose the discharging roller 220 with the second slit 201 between the roller 220 and the opposing rollers 230. The opposing rollers 230 are a plurality of cylindrical elastic members extending vertically and are arranged in a hole 212A. The plurality of cylindrical elastic members are vertically arranged at regular intervals. The hole 212A extends through the rear end portion of the second frame 212 in the lateral direction, and is rectangular and long vertically in a side view. A left end portion of each opposing roller 230 is located leftward beyond the left surface of the second frame 212. A rotation shaft 230A is rotatably received in a center hole of each opposing roller 230. The rotation shaft 230A is columnar and extends vertically. The two ends of the rotation shaft 230A are fixed to the inner walls above and below the hole 212A.

The discharge motor 299, which is a DC motor, is fixed to the left end portion of the first frame 211. The discharge motor 299 has an output shaft 299A extending downward in the discharge motor 299. The discharge motor 299 can rotate the output shaft 299A counterclockwise (arrow R1) and clockwise (arrow R2) in a bottom view. Rotating the output shaft 299A counterclockwise by the discharge motor 299 in a bottom view refers to forward rotation. Rotating the output shaft 299A clockwise by the discharge motor 299 in a bottom view refers to reverse rotation.

The first coupling mechanism 280 is arranged in a lower portion of the discharging unit 200 to couple the discharge motor 299 and the discharging roller 220 in a manner drivable together. The first coupling mechanism 280 includes coupling gears 281 to 284, a moving gear 285, and a rotation shaft 285A. The rotation axes of the coupling gears 281 to 284 and the moving gear 285 extend vertically. The coupling gear 281 is a spur gear fixed to a lower end portion of the output shaft 299A.

The coupling gear 282, which is a double gear including a large-diameter gear and a small-diameter gear, is on the front right of the coupling gear 281. The large-diameter gear of the coupling gear 282 has its rear left end meshing with a front right end of the coupling gear 281. A rotation shaft 282A is rotatably received in the center hole of the coupling gear 282. The rotation shaft 282A is cylindrical and fixed to the first frame 211 and extending downward from the first frame 211. The coupling gear 283, which is a double gear including a large-diameter gear and a small-diameter gear, is on the front right of the coupling gear 282. The large-diameter gear of the coupling gear 283 has its rear left end meshing with the front right end of the small-diameter gear of the coupling gear 282. A rotation shaft 283A has a lower end portion received and fixed in the center hole of the coupling gear 283. The rotation shaft 283A extends vertically and through the first frame 211. The rotation shaft 283A has an upper end portion extending upward from the upper surface of the first frame 211. The rotation shaft 283A is rotatably supported by the first frame 211. The rotation shaft 283A has a columnar portion above the first frame 211. The rotation shaft 283A has a D-shaped portion below the first frame 211.

The coupling gear 284, which is a double gear including a large-diameter gear and a small-diameter gear, is on the right of the coupling gear 283. The large-diameter gear of the coupling gear 284 has its left end meshing with a right end of the small-diameter gear of the coupling gear 283. A rotation shaft 284A is rotatably received in the center hole of the coupling gear 284. The rotation shaft 284A is columnar and fixed to the first frame 211 and extends downward from the first frame 211. The moving gear 285 is a spur gear arranged at the rear of the coupling gear 284. The moving gear 285 has its front end meshing with a rear end of the small-diameter gear of the coupling gear 284. The rotation shaft 285A extends parallel to the rotation shaft 230A. The rotation shaft 285A has a D-shaped lower end portion. The portion of the rotation shaft 285A other than the lower end portion is columnar. The lower end portion of the rotation shaft 285A extends downward from the first frame 211, and is received and fixed in the center hole of the moving gear 285. The rotation shaft 285A has an upper end portion extending to the upper end of the hole 213A, and is received and fixed in the center hole of the discharging roller 220.

The first frame 211 has a guide hole 211A. The guide hole 211A extends vertically through a portion of the first frame 211 at the rear of the coupling gear 284, and extends in an arc (refer to FIG. 17) along a peripheral surface 284B having the teeth of the coupling gear 284 in a plan view. In FIG. 17, the broken lines indicate a portion of the guide hole 211A covered by components including the discharging roller 220. The rotation shaft 285A has a portion received in the guide hole 211A above the moving gear 285. The rotation shaft 285A is movable inside and along the guide hole 211A.

The moving mechanism 250 moves the discharging roller 220 toward or away from the opposing rollers 230. In the present embodiment, the moving mechanism 250 moves the discharging roller 220 to a position on the left of and adjacent to the opposing rollers 230 (hereafter referred to as a nip position; refer to FIGS. 13 and 16) and to a position spaced leftward from the opposing rollers 230 (hereafter referred to as a release position; refer to FIGS. 14 and 17).

The moving mechanism 250 includes a rotator 251, an eccentric member 252, and a roller holder 255. The rotator 251 is cylindrical and arranged on the side of the first frame 211 opposite to the coupling gear 283. The upper end portion of the rotation shaft 283A is rotatably received in the center hole of the rotator 251. The eccentric member 252 is columnar and extends upward from a portion of the rotator 251 eccentric to the rotation shaft 283A. The eccentric member 252 thus rotates about the rotation shaft 283A in a plan view as the rotator 251 rotates.

An enlarged-diameter portion 253 is arranged on the lower end portion of the eccentric member 252 to fix the eccentric member 252 to the upper surface of the rotator 251. The enlarged-diameter portion 253 has a larger diameter than the eccentric member 252, and is semicircular in a plan view. The enlarged-diameter portion 253 has a recess 253A (refer to FIG. 13). The recess 253A is recessed from the arc of the enlarged-diameter portion 253 toward the rotation shaft 283A (or toward the rotation center of the eccentric member 252). An urging member 297 is engageable with the recess 253A. The urging member 297 is a torsion spring fixed to a fixing portion 213B. The fixing portion 213B is arranged on the upper surface of the third frame 213 adjacent to the upper front of the rotator 251. The urging member 297 has its two ends extending rearward. The enlarged-diameter portion 253 on the right of the rotation shaft 283A has the recess 253A open rightward, with which the end of the urging member 297 is engaged from the right (refer to FIG. 13). The enlarged-diameter portion 253 on the left of the rotation shaft 283A has the recess 253A open leftward, from which the end of the urging member 297 is spaced (not shown).

Figure 15:
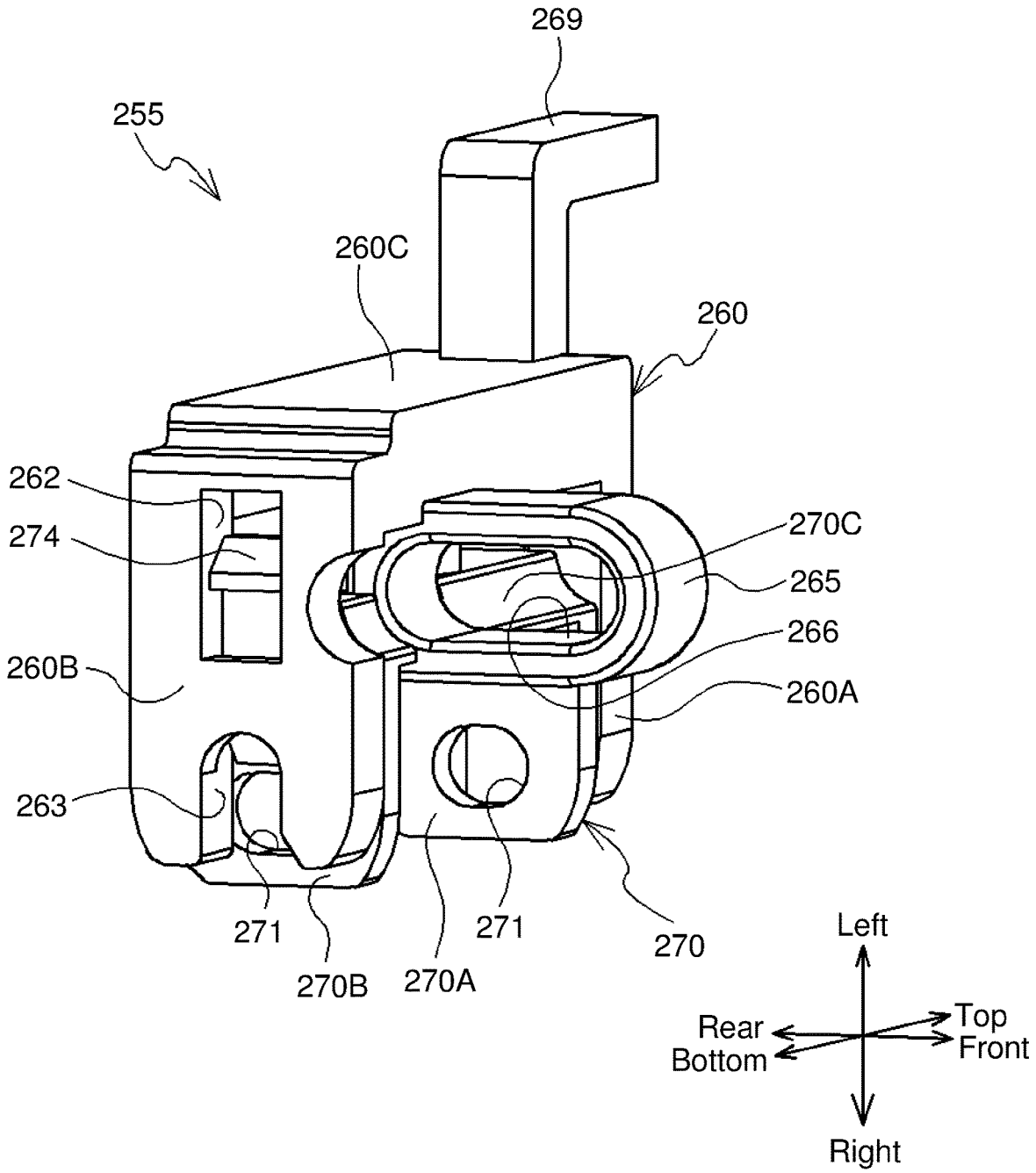
FIG. 15 is a perspective front view of a roller holder as viewed from left below.

As shown in FIG. 15, the roller holder 255 includes a first member 260, a second member 270, and an urging member 256 (refer to FIG. 14). The first member 260 is U-shaped, and open rightward in a front view. An upper wall 260A and a lower wall 260B of the first member 260 each have an engagement hole 262. The engagement hole 262 in the upper wall 260A is not shown. Each engagement hole 262 extends vertically through the left end portion of the wall 260A or 260B and is rectangular and long in the lateral direction in a plan view. The wall 260B has a recess 263. The recess 263 is recessed leftward from the right end of the wall 260B.

A protrusion 265 and a detection piece 269 are arranged on a left wall 260C of the first member 260. The protrusion 265 protrudes forward from the right end of the front surface of the wall 260C. The protrusion 265 has a first support hole 266. The first support hole 266 extends vertically through the protrusion 265 and is long in the front-rear direction. The eccentric member 252 (refer to FIG. 13) is received in the first support hole 266. The first support hole 266 supports the eccentric member 252 in a manner movable in the front-rear direction. The detection piece 269 extends leftward from the upper end of the left surface of the wall 260C and then upward.

The second member 270 is U-shaped, and open rightward in a front view, and smaller than the first member 260. The second member 270 is arranged in the recess of the first member 260. The discharging roller 220 (refer to FIG. 14) is arranged in the recess of the second member 270, or between an upper wall 270A and a lower wall 270B of the second member 270. The right end of the second member 270 is the right end of the roller holder 255. The right end of the discharging roller 220 is located rightward beyond the right end of the roller holder 255. The walls 270A and 270B each have a second support hole 271. The second support hole 271 extends vertically through the right end portion of the corresponding wall 270A or 270B, and is long in the front-rear direction. The rotation shaft 285A is received in the second support holes 271. The second support holes 271 support the rotation shaft 285A in a manner rotatable and movable in the front-rear direction.

Each of the walls 270A and 270B includes an engagement tab 274. The engagement tab 274 in the wall 270A is not shown. The engagement tabs 274 protrude leftward from the left ends of the walls 270A and 270B as hooks that face away from each other. The hook of each engagement tab 274 is engaged with the corresponding engagement hole 262 movably in the lateral direction. Thus, the second member 270 is supported by the first member 260 in a manner movable in the lateral direction (or toward or away from the opposing rollers 230).

As shown in FIG. 14, the urging member 256 is arranged between the right surface of the wall 260C and the left surface of a left wall 270C of the second member 270. The urging member 256 is a helical compression spring that urges the second member 270 rightward toward the opposing rollers 230 from the first member 260. The second member 270, while receiving no leftward force, is maintained by the urging force of the urging member 256 at the position at which the hook of each engagement tab 274 is in contact with the right end of the corresponding engagement hole 262.

As shown in FIGS. 13, 16, and 17, the roller holder 255 is arranged inside the guide frame 214 on a rear portion of the left surface of the third frame 213. The guide frame 214 extends leftward from the third frame 213, and is substantially rectangular conforming to the shape of the roller holder 255 in a left side view. The guide frame 214 has openings 214A and 214B. The opening 214A is open forward at a lower front corner of the guide frame 214. The protrusion 265 protrudes forward through the opening 214A. The opening 214B is open leftward at the left end of the guide frame 214. The detection piece 269 protrudes leftward through the opening 214B. The guide frame 214 guides the roller holder 255 to move linearly in the lateral direction.

As shown in FIGS. 13 and 14, the second coupling mechanism 240 is arranged in a lower portion of the discharging unit 200 to couple the discharge motor 299 and the moving mechanism 250 in a manner drivable together. The second coupling mechanism 240 includes a plurality of coupling gears 281 to 283, a rotation shaft 283A, and a one-way clutch 290. More specifically, the plurality of coupling gears 281 to 283 couple the discharge motor 299 and the discharging roller 220 in a manner drivable together, and couple the discharge motor 299 and the moving mechanism 250 in a manner drivable together.

The one-way clutch 290 is arranged between the inner wall of the rotator 251 and the upper end portion of the rotation shaft 283A. In FIG. 13, the broken lines indicate the portion of the rotation shaft 283A arranged inside the coupling gear 283, the first frame 211, and the rotator 251, and the one-way clutch 290.

The one-way clutch 290 couples the discharge motor 299 and the rotator 251 in a manner drivable together when the discharge motor 299 rotates reversely, and decouples the discharge motor 299 from the rotator 251 when the discharge motor 299 rotates forward. In the present embodiment, when the discharge motor 299 rotates reversely (arrow R2), the rotation shaft 283A is rotated clockwise in a bottom view via the coupling gears 281 to 283. The one-way clutch 290 rotates the rotator 251 together with the rotation shaft 283A as the rotation shaft 283A rotates clockwise in a bottom view. When the discharge motor 299 rotates forward (arrow R1), the rotation shaft 283A is rotated counterclockwise in a bottom view via the coupling gears 281 to 283. The one-way clutch 290 causes the rotator 251 to rotate without meshing with the rotation shaft 283A as the rotation shaft 283A is rotated counterclockwise in a bottom view.

As shown in FIG. 13, the position sensor 295 is fixed to the left surface of the third frame 213 above the guide frame 214. The position sensor 295 is a switch sensor and includes a movable piece 295A. The movable piece 295A is located on the right of the upper end portion of the detection piece 269. The movable piece 295A is constantly urged leftward and engaged at a predetermined engagement position. As the movable piece 295A swings rightward to a predetermined movable position, the position sensor 295 outputs a detection signal. The position sensor 295 detects whether the discharging roller 220 is at the nip position.

The operation of each component of the discharging unit 200 performed when the discharge motor 299 rotates forward will now be described with reference to FIGS. 13 and 14. The driving force in forward rotation (arrow R1) of the discharge motor 299 (hereafter referred to as a forward rotation force of the discharge motor 299) is transmitted by the first coupling mechanism 280 from the output shaft 299A via the coupling gears 281, 282, 283, and 284, the moving gear 285, and the rotation shaft 285A to the discharging roller 220 in this order. Thus, in the forward rotation of the discharge motor 299, the discharging roller 220 rotates counterclockwise (hereafter referred to as a discharge direction; indicated by arrow R3) in a bottom view. The tape is transported forward while being in contact with the discharging roller 220 rotating in the discharge direction.

The forward rotation force of the discharge motor 299 is further transmitted by the second coupling mechanism 240 from the output shaft 299A via the coupling gears 281, 282, and 283 to the rotation shaft 283A in this order. The one-way clutch 290 decouples the discharge motor 299 from the rotator 251, and thus the forward rotation force of the discharge motor 299 is not transmitted from the rotation shaft 283A to the rotator 251. Thus, the rotator 251 does not rotate when the discharge motor 299 rotates forward. Thus, the printing device 1 drives the discharge motor 299 forward to rotate the discharging roller 220 at the same position in the discharge direction. More specifically, the printing device 1 drives the discharge motor 299 forward to rotate the discharging roller 220 in the discharge direction without the discharging roller 220 moving between the nip position (refer to FIGS. 13 and 16) and the release position (refer to FIGS. 14 and 17).

The operation of each component of the discharging unit 200 when the discharge motor 299 rotates reversely will now be described with reference to FIGS. 13, 14, 16, and 17. As shown in FIGS. 13 and 14, the driving force in reverse rotation (arrow R2) of the discharge motor 299 (hereafter referred to as a reverse rotation force of the discharge motor 299) is transmitted by the first coupling mechanism 280 from the output shaft 299A via the coupling gears 281, 282, 283, and 284, the moving gear 285, and the rotation shaft 285A to the discharging roller 220 in this order. Thus, in the reverse rotation of the discharge motor 299, the discharging roller 220 rotates clockwise in a bottom view, or in the direction opposite to the discharge direction (hereafter referred to as a return direction; indicated by arrow R4).

The reverse rotation force of the discharge motor 299 is further transmitted by the second coupling mechanism 240 from the output shaft 299A via the coupling gears 281, 282, and 283 to the rotation shaft 283A in this order. The one-way clutch 290 couples the discharge motor 299 and the rotator 251 in a manner drivable together, and thus the reverse rotation force of the discharge motor 299 is transmitted from the rotation shaft 283A to the rotator 251. Thus, as the discharge motor 299 rotates reversely, the rotator 251 rotates clockwise about the rotation shaft 283A in a bottom view. The eccentric member 252 rotates clockwise about the rotation shaft 283A in a bottom view.

As shown in FIGS. 16 and 17, the eccentric member 252 presses the protrusion 265 leftward or rightward while moving in the first support hole 266 in the front-rear direction. Thus, the roller holder 255 moves leftward or rightward along the guide frame 214. As the roller holder 255 moves leftward or rightward, the inner wall of the second support hole 271 (refer to FIG. 15) or the recess 263 (refer to FIG. 15) presses the rotation shaft 285A leftward or rightward. As the rotation shaft 285A moves leftward or rightward, the discharging roller 220 moves between the nip position and the release position. Thus, the printing device 1 drives the discharge motor 299 reversely to move the discharging roller 220 to the nip position (refer to FIG. 16) or to the release position (refer to FIG. 17) by the moving mechanism 250.

When the discharging roller 220 moves between the nip position and the release position, the rotation shaft 285A moves along the guide hole 211A in the second support hole 271 (refer to FIG. 15) in the front-rear direction. More specifically, the rotation shaft 285A moves along the peripheral surface 284B of the coupling gear 284. When the discharging roller 220 moves from the release position to the nip position, the discharging roller 220 approaches the opposing rollers 230 slightly obliquely from the left front (refer to FIG. 17). The moving gear 285 moves along the peripheral surface 284B of the coupling gear 284 together with the rotation shaft 285A. Thus, the moving gear 285 moves while meshing with the coupling gear 284. Thus, the discharging roller 220 moves between the nip position and the release position while the discharge motor 299 remains coupled to the discharging roller 220 by the first coupling mechanism 280 in a manner drivable together. More specifically, the discharge motor 299 is coupled to the discharging roller 220 by the first coupling mechanism 280 in a manner drivable together when the discharging roller 220 is at either the nip position or the release position.

The discharging roller 220 at the nip position holds the tape between the discharging roller 220 and the opposing rollers 230. Without the tape, the discharging roller 220 comes in contact with the opposing rollers 230. The discharging roller 220 may oppose the opposing rollers 230 with a distance smaller than the thickness of the tape between the roller 220 and the opposing rollers 230. The discharging roller 220 at the release position is spaced leftward from the tape. The position of the discharging roller 220 in the transport direction at which the discharging roller 220 holds the tape between the roller 220 and the opposing rollers 230 is referred to as a second holding position P5. The load with which the discharging roller 220 holds the tape between the roller 220 and the opposing rollers 230 is referred to as a holding load at the second holding position P5. The second holding position P5 is downstream from the second cut position P4 in the transport direction. The holding load at the second holding position P5 is smaller than the holding load at the first holding position P2.

More specifically, as shown in FIG. 17, the eccentric member 252 on the left of the rotation shaft 283A is at the left end of the movable range of the eccentric member 252 in the lateral direction. The roller holder 255 is at the left end of the movable range of the roller holder 255 in the lateral direction, and the discharging roller 220 is at the release position. In this state, as the eccentric member 252 rotates counterclockwise about the rotation shaft 283A in a plan view, the eccentric member 252 presses the protrusion 265 rightward while moving rearward in the first support hole 266. The first member 260, the second member 270, and the discharging roller 220 move integrally rightward until the discharging roller 220 is at the nip position, or until the discharging roller 220 is positioned to hold the tape between the roller 220 and the opposing rollers 230.

As shown in FIG. 16, in the present embodiment, before the eccentric member 252 is located at the right end of the movable range of the eccentric member 252 in the lateral direction, the discharging roller 220 is at the position (nip position) to hold the tape between the roller 220 and the opposing rollers 230. When the eccentric member 252 further moves to the right end of the movable range of the eccentric member 252 in the lateral direction after the discharging roller 220 is positioned at the nip position, the first member 260 moves rightward. The second member 270 and the discharging roller 220 are restricted by the opposing rollers 230 moving rightward. More specifically, the first member 260 moves toward the second member 270 and the discharging roller 220 against the urging force of the urging member 256. When the eccentric member 252 moves between the left and right ends of the movable range of the eccentric member 252 in the lateral direction, the first member 260 moves by a longer distance in the lateral direction than the discharging roller 220 and the second member 270 in the lateral direction.

When the first member 260 moves toward the second member 270 and the discharging roller 220 against the urging force of the urging member 256, the urging member 256 applies a greater urging force to the discharging roller 220 toward the opposing rollers 230. Thus, the printing device 1 can adjust the holding load at the second holding position P5 in accordance with the position of the eccentric member 252 in the lateral direction. When the discharging roller 220 is at the nip position, the opposing rollers 230 moves toward or away from the first member 260 in accordance with the thickness of the tape. In this case, the second member 270 moves closer to the first member 260 as the tape has a larger thickness, and the urging member 256 applies a greater urging force accordingly. Thus, the printing device 1 can change the holding load at the second holding position P5 in accordance with the thickness of the tape.

As shown in FIG. 13, when the discharging roller 220 is at the nip position, the enlarged-diameter portion 253 is located on the right of the rotation shaft 283A. Thus, the urging member 297 is engaged with the recess 253A. In this case, the urging member 297 urges the enlarged-diameter portion 253 obliquely to the left front. More specifically, the urging member 297 urges the rotator 251 counterclockwise in a bottom view. The urging member 297 restricts the discharging roller 220 moving from the nip position to the release position with the rotator 251 rotating clockwise in a bottom view. The urging force of the urging member 297 is smaller than the force used to rotate the rotator 251 counterclockwise in a bottom view. This maintains the discharging roller 220 at the nip position under the urging force of the urging member 297.

When the discharging roller 220 is at the release position, the detection piece 269 is spaced leftward from the movable piece 295A (not shown). While the discharging roller 220 is moving from the release position to the nip position, the detection piece 269 presses the movable piece 295A rightward. When the discharging roller 220 moves to the nip position, the movable piece 295A swings to the movable position while being pressed rightward by the detection piece 269. In the present embodiment, when the eccentric member 252 is located on the right end of the movable range of the eccentric member 252 in the lateral direction, the detection piece 269 is arranged at the right end of the movable range of the detection piece 269 in the lateral direction. In this state, the movable piece 295A is at the movable position. The position sensor 295 can thus detect whether the discharging roller 220 is at the nip position by detecting whether the detection piece 269 (or the first member 260) is at the right end of the movable range of the detection piece 269 in the lateral direction.

Figure 18:
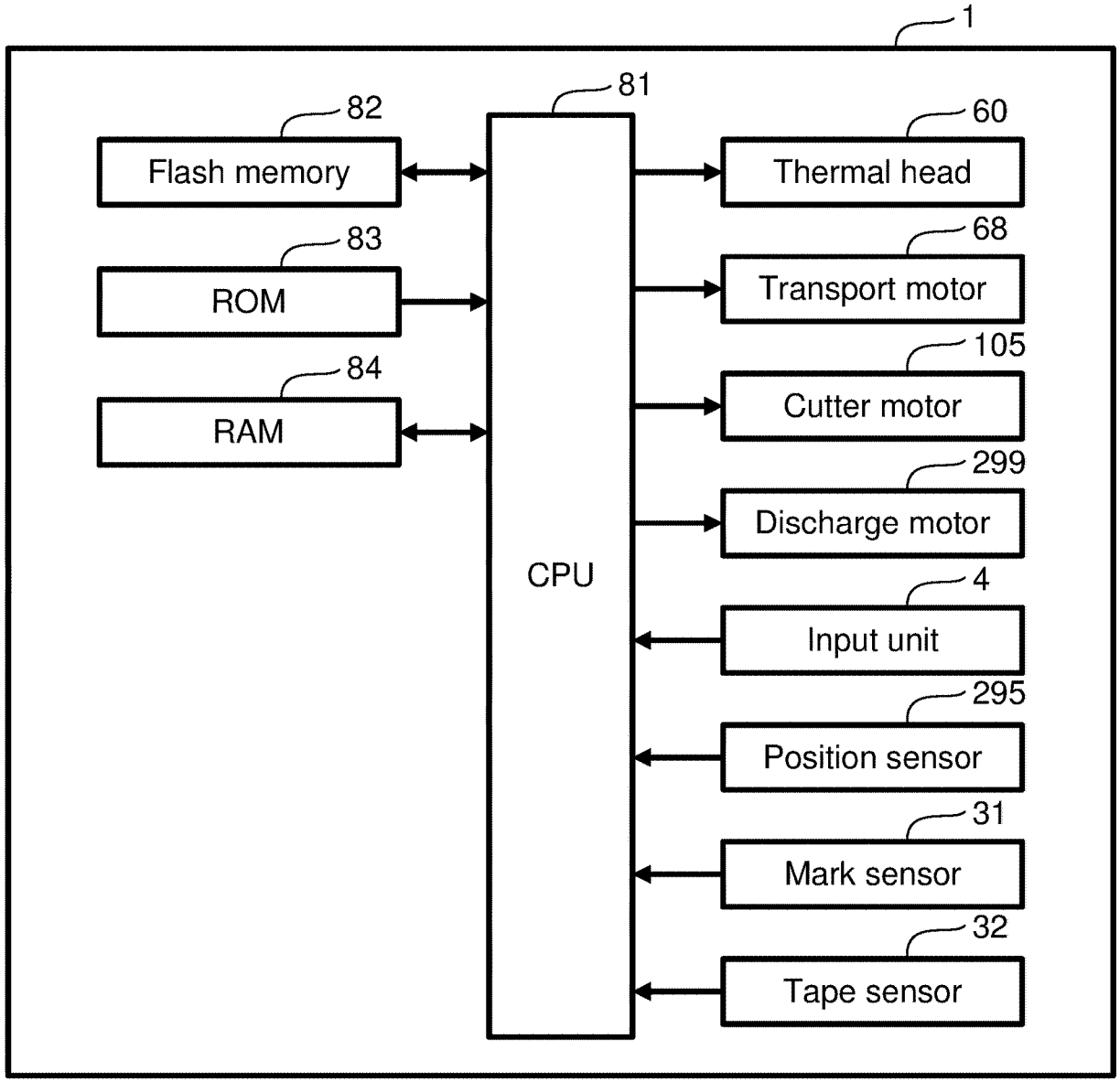
FIG. 18 is a block diagram of the printing device.

The electrical configuration of the printing device 1 will now be described with reference to FIG. 18. The printing device 1 includes a central processing unit (CPU) 81. The CPU 81 functions as a processor that performs main processing (described later) to collectively control the printing device 1. The CPU 81 is connected to a flash memory 82, a read-only memory (ROM) 83, a random-access memory (RAM) 84, the thermal head 60, the transport motor 68, the cutter motor 105, the discharge motor 299, the input unit 4, the position sensor 295, the mark sensor 31, and a tape sensor 32. The flash memory 82 is a non-transitory storage medium that stores, for example, a program to be executed by the CPU 81 to implement the main processing. The ROM 83 is a non-transitory storage medium that stores a variety of parameters used by the CPU 81 to execute various programs. The RAM 84 is a temporary storage medium, and stores temporary data from, for example, a timer or a counter.

The tape sensor 32 is located downstream from the tape driving shaft 61 and the transport roller 66 and upstream from the discharging roller 220 in the transport direction. The tape sensor 32 is a transmissive photosensor that detects whether the tape is located at a predetermined detection position (not shown) between the first holding position P2 and the second holding position P5 in the transport direction. The tape sensor 32 outputs a detection signal when detecting a tape at the detection position.

The main processing will now be described with reference to FIGS. 19 to 24. A user sets the printing device 1 in a print-ready state, and powers on the printing device 1. When the printing device 1 is powered on, the CPU 81 starts the main processing by loading the program stored in the flash memory 82 into the RAM 84.

Figure 19:
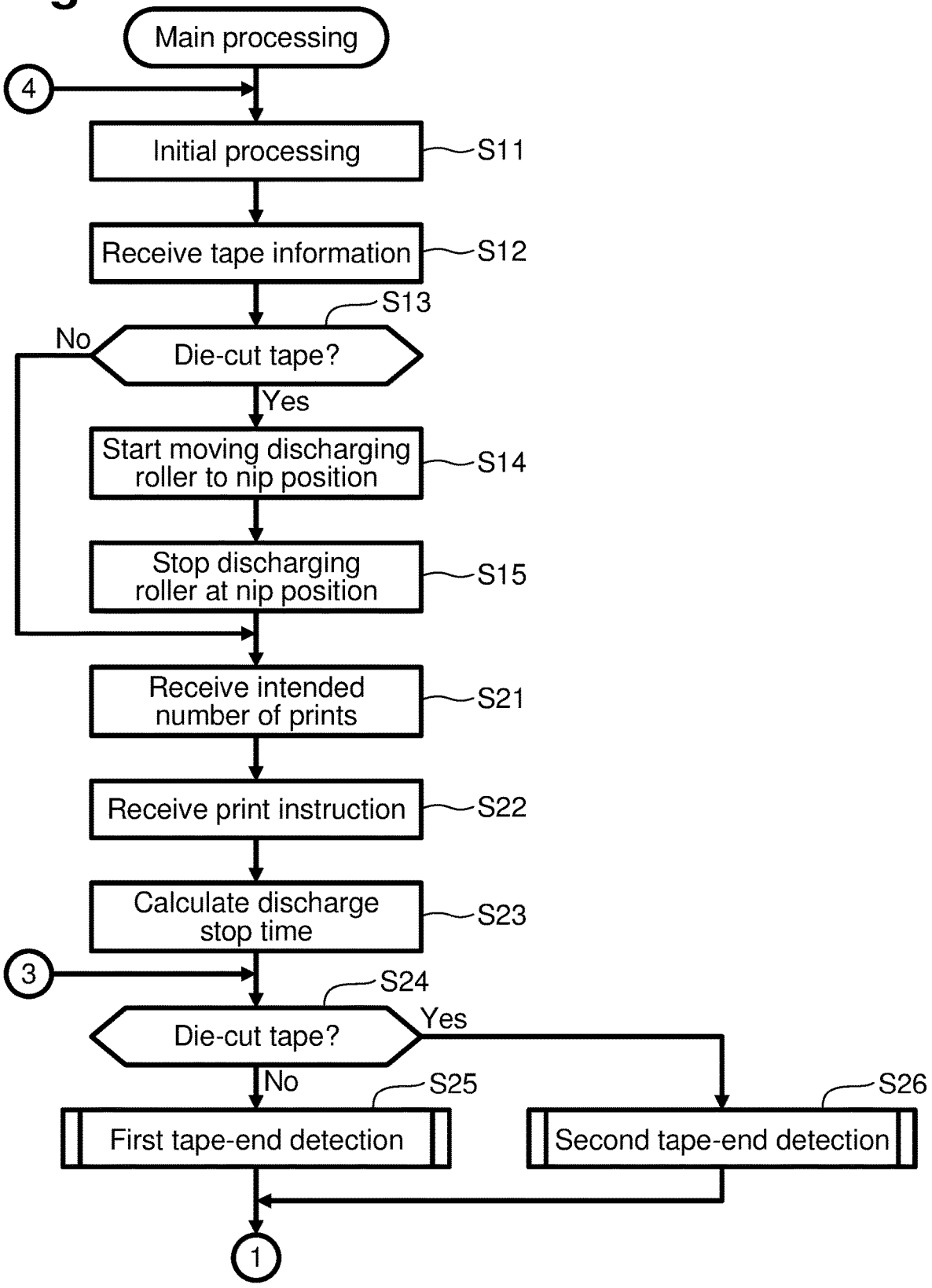
FIG. 19 is a flowchart of a portion of a main process.

As shown in FIG. 19, the CPU 81 performs initial processing (S11). In the initial processing, the CPU 81 controls the cutter motor 105 to set the cutter unit 100 to an initial state. The CPU 81 drives the discharge motor 299 reversely to set the discharging unit 200 to the initial state. When the discharging unit 200 is in the initial state, the discharging roller 220 is at the release position. The CPU 81 determines that the discharging unit 200 is in the initial state in response to no detection signal output from the position sensor 295. The discharging roller 220 at the nip position may be defined as the discharging unit 200 in the initial state. The CPU 81 clears the information stored in the RAM 84. In particular, the CPU 81 sets zero as a value K of a counter indicating the print count. The counter indicating the print count is stored into the RAM 84 and counts the number of times the printing is performed.

The CPU 81 receives tape information (S12). The tape information indicating the tape type (selected from the receptor tape 5, the die-cut tape 9, a thermal tape, a transparent film tape, or a double-sided adhesive tape) is input by the user to the CPU 81 through the input unit 4. The user inputs the tape information associated with the type of the tape accommodated in the cassette used. The received tape information is stored into the RAM 84.

The CPU 81 determines whether the tape indicated by the received tape information is the die-cut tape 9 (S13). When the tape is not the die-cut tape 9 (No in S13), the CPU 81 advances to S21.

The die-cut tape 9 has different thicknesses between its portions including the backings 91 and its portions including no backings 91 in the longitudinal direction (transport direction), and thus has steps between the portions including the backings 91 and the portions including no backings 91. When the die-cut tape 9 has its front end (downstream end in the transport direction) swinging in the thickness direction in the cassette attached to the receiving unit 6, the edge 179C or another part of the fixed blade 179 may come into contact with any of the steps of the die-cut tape 9. When the edge 179C or another part of the fixed blade 179 comes in contact with the adhesive layer 93 exposed to the step of the die-cut tape 9, the backing 91 may separate from the release paper 92. The die-cut tape 9 may thus be unintendedly discharged from the cassette with its weight when the printing device 1 does not drive the transport motor 68 forward.

For the die-cut tape 9 (Yes in S13), the CPU 81 starts driving the discharge motor 299 reversely to start moving the discharging roller 220 to the nip position (refer to FIG. 16) (S14). In response to a detection signal from the position sensor 295, the CPU 81 stops driving the discharge motor 299 reversely to stop the discharging roller 220 at the nip position (S15). Thus, the printing device 1 prevents the front end of the die-cut tape 9 from swinging by holding the die-cut tape 9 between the discharging roller 220 and the opposing rollers 230. The printing device 1 thus prevents the backings 91 in the die-cut tape 9 from separating from the release paper 92. The printing device 1 can restrict the die-cut tape 9 moving downstream in the transport direction by holding the die-cut tape 9 at the second holding position P5 between the discharging roller 220 and the opposing rollers 230. Thus, the printing device 1 prevents the die-cut tape 9 from being unintendedly discharged from the cassette. As described above, the position sensor 295 outputs a detection signal when the discharging roller 220 is at the nip position. Thus, the CPU 81 can reliably stop the discharging roller 220 at the nip position based on the detection signal from the position sensor 295.

The CPU 81 receives an intended number of prints (S21). The intended number of prints refers to the number of times the printing is to be repeated. The intended number of prints is input to the CPU 81 by a user through the input unit 4. The received intended number of prints is stored into the RAM 84. The CPU 81 receives a print instruction (S22). The print instruction is input to the CPU 81 by a user through the input unit 4. The print instruction includes print data. The CPU 81 calculates a discharge stop time based on the print data (S23). The discharge stop time is a time difference between the printing time taken from the start to the end of the printing and a predetermined reference time. The reference time is shorter than a motor driving time. The motor driving time is a period of time for which the discharge motor 299 rotates reversely to move the discharging roller 220 from the nip position to the release position. Specifically, the motor driving time is a period of time for which the discharge motor 299 rotates reversely to allow the eccentric member 252 to move from the right end to the left end (or from the left end to the right end) within a movable range of the eccentric member 252 in the lateral direction. The reference time and the motor driving time are prestored in the ROM 83. The reference time may be changeable within the length of the motor driving time. The calculated discharge stop time is stored into the RAM 84.

The CPU 81 determines whether the type of the tape indicated by the tape information received in S12 is the die-cut tape 9 (S24). When the tape is determined not to be the die-cut tape 9 (No in S24), the CPU 81 performs first tape-end detection (S25). When the tape is determined to be the die-cut tape 9 (Yes in S24), the CPU 81 performs second tape-end detection (S26). After performing the first tape-end detection or the second tape-end detection, the CPU 81 advances to S61 (refer to FIG. 20).

Figure 22:
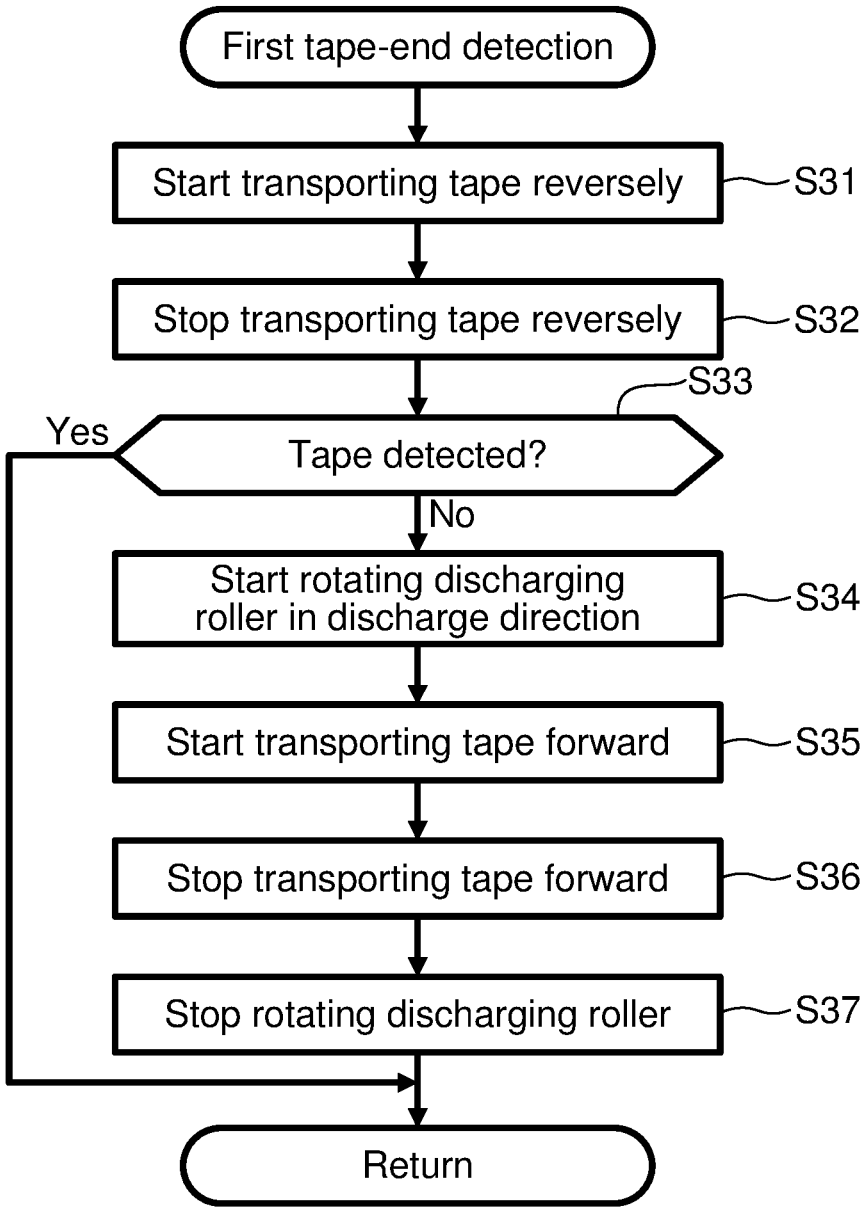
FIG. 22 is a flowchart of a first tape-end detection.

The first tape-end detection will now be described with reference to FIG. 22. In the first tape-end detection, the end of the tape other than the die-cut tape 9 (e.g., the receptor tape 5, a thermal tape, a stencil tape, or a laminate tape) is detected.

The CPU 81 starts driving the transport motor 68 reversely to start transporting the tape reversely (S31). This shortens a portion of the tape located downstream from the thermal head 60 in the transport direction. After transporting the tape reversely by a predetermined amount, the CPU 81 stops driving the transport motor 68 to stop transporting the tape reversely (S32). The CPU 81 determines whether the tape is at the detection position based on the detection signal from the tape sensor 32 (S33). When the tape has its front end (downstream end in the transport direction) located downstream from the detection position in the transport direction, the tape sensor 32 outputs a detection signal (Yes in S33). The CPU 81 returns to the main processing (refer to FIG. 19).

When the tape has its front end located upstream from the detection position in the transport direction, the tape sensor 32 does not output a detection signal (No in S33). The CPU 81 starts driving the discharge motor 299 forward to start rotating the discharging roller 220 in the discharge direction (S34). Thus, the discharging roller 220 at the release position rotates in the discharge direction (arrow R3; refer to FIG. 17). The tape held at the first holding position P2 is prevented from being transported forward when coming in contact with the discharging roller 220.

The CPU 81 starts driving the transport motor 68 forward to start transporting the tape forward (S35). The tape is not prevented from being transported forward when coming in contact with the discharging roller 220 rotating in the discharge direction (arrow R3; refer to FIG. 17). The CPU 81 stops driving the transport motor 68 in response to the detection signal from the tape sensor 32 to stop transporting the tape forward (S36). Thus, the tape has its front end located at the detection position of the tape sensor 32 or downstream from the detection position in the transport direction. The CPU 81 stops driving the discharge motor 299 forward to stop rotating the discharging roller 220 (S37). The CPU 81 returns to the main processing.

The first tape-end detection shortens a portion of the tape located downstream from the print position P1 in the transport direction. The printing device 1 can thus reduce the area of the tape with no characters to be printed. The front end of the tape is located at least at the detection position of the tape sensor 32 or downstream from the detection position in the transport direction. The detection position is downstream from the first holding position P2 in the transport direction. Thus, the printing device 1 can reduce tape transport errors caused by the tape failing to be held at the first holding position P2.

Figure 23:
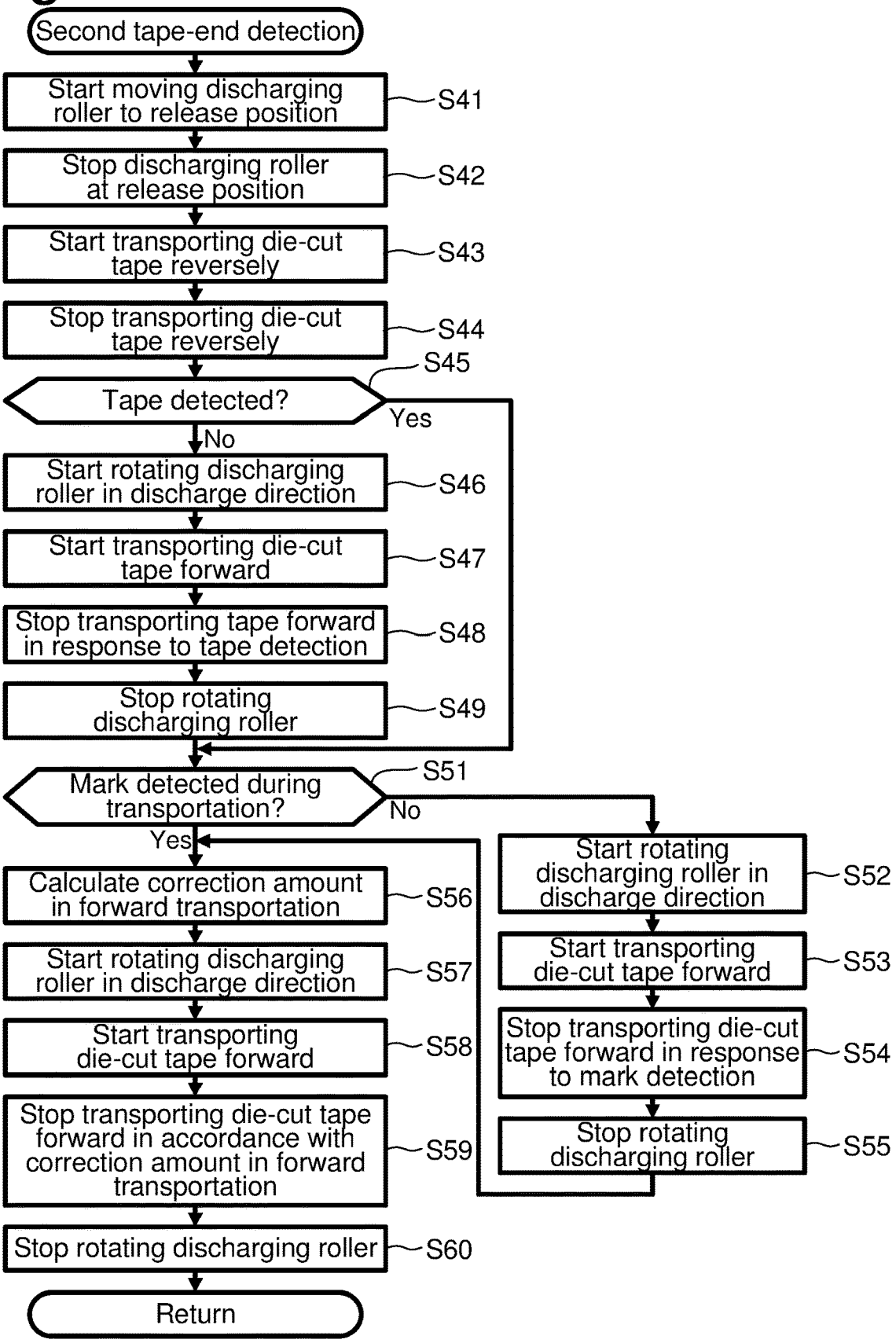
FIG. 23 is a flowchart of a second tape-end detection.

The second tape-end detection will now be described with reference to FIG. 23. In the second tape-end detection, the end of the die-cut tape 9 is detected. Processing of the second tape-end detection different from the first tape-end detection will be mainly described.

The CPU 81 starts driving the discharge motor 299 reversely to start moving the discharging roller 220 to the release position (S41). The CPU 81 drives the discharge motor 299 reversely for the motor driving time, and then stops driving the discharge motor 299 reversely to stop the discharging roller 220 at the release position (S42). The discharge motor 299 may be a stepping motor. The CPU 81 can stop the discharging roller 220 at the release position by controlling the amount of rotation of the reversely driven discharge motor 299 when the discharging roller 220 is at the nip position.

The processing in S43 to S49 is the same as the processing in S31 to S37. The CPU 81 determines whether the mark sensor 31 has detected the mark 99 (S51) during transportation of the die-cut tape 9, or during reverse transportation of the die-cut tape 9 (S43 and S44) or forward transportation of the die-cut tape 9 (S47 and S48). The mark sensor 31 outputs a detection signal when detecting the mark 99. When the CPU 81 has received a detection signal from the mark sensor 31 during transportation of the die-cut tape 9 (Yes in S51), the CPU 81 advances to S56.

When the CPU 81 receives no detection signal from the mark sensor 31 during transportation of the die-cut tape 9 (No in S51), the CPU 81 starts driving the discharge motor 299 forward to start rotating the discharging roller 220 in the discharge direction (S52). Thus, the discharging roller 220 at the release position rotates in the discharge direction (arrow R3; refer to FIG. 17). The CPU 81 starts driving the transport motor 68 forward to start transporting the die-cut tape 9 forward (S53). In response to a detection signal from the mark sensor 31, the CPU 81 stops driving the transport motor 68 forward to stop transporting the die-cut tape 9 forward (S54). The CPU 81 stops driving the discharge motor 299 forward to stop rotating the discharging roller 220 (S55).

The CPU 81 calculates a correction amount in forward transportation (S56). The correction amount in forward transportation is the amount of the die-cut tape 9 to be transported forward to place any of the backings 91 in the die-cut tape 9 at the print position P1. The backings 91 and the marks 99 in the die-cut tape 9 are arranged at regular intervals. Thus, the CPU 81 can calculate the correction amount in forward transportation with respect to the position of the die-cut tape 9 in the transport direction when the mark 99 is detected by the mark sensor 31. The calculated correction amount in forward transportation is stored into the RAM 84.

The CPU 81 starts driving the discharge motor 299 forward to start rotating the discharging roller 220 in the discharge direction (S57). Thus, the discharging roller 220 at the release position rotates in the discharge direction (arrow R3; refer to FIG. 17). The CPU 81 starts driving the transport motor 68 forward to start transporting the die-cut tape 9 forward (S58). The CPU 81 transports the die-cut tape 9 forward by the correction amount in forward transportation calculated in S56, and then stops driving the transport motor 68 to stop transporting the die-cut tape 9 forward (S59). Thus, one of the backings 91 in the die-cut tape 9 is located at the print position P1. A portion between adjacent backings 91 in the die-cut tape 9 (or the release paper 92) is thus prevented from having characters printed. The CPU 81 stops driving the discharge motor 299 forward to stop rotating the discharging roller 220 (S60). The CPU 81 returns to the main processing (refer to FIG. 19).

Figure 20:
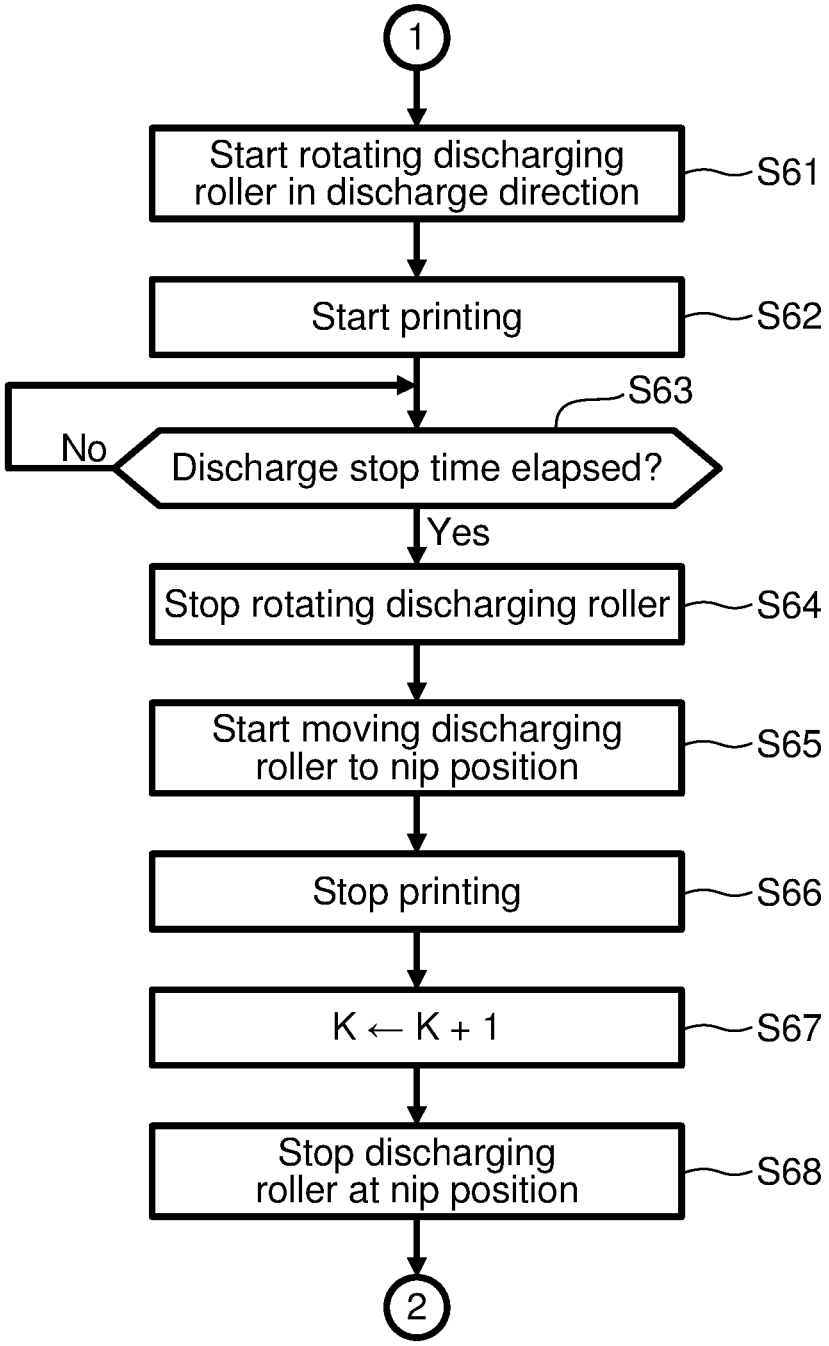
FIG. 20 is a flowchart of a portion of the main process continued from FIG. 19.

As shown in FIG. 20, the CPU 81 starts driving the discharge motor 299 forward to start rotating the discharging roller 220 in the discharge direction (S61). Thus, the discharging roller 220 at the release position rotates in the discharge direction (arrow R3; refer to FIG. 17). In this state, the CPU 81 starts the printing (S62). Specifically, the CPU 81 starts driving the transport motor 68 forward. The CPU 81 selectively heats a plurality of heater elements in the thermal head 60. Thus, the tape has characters printed per line while being transported forward.

The CPU 81 determines whether the discharge stop time calculated in S23 has elapsed after the start of the printing in S62 (S63). When the discharge stop time has not elapsed (No in S63), the CPU 81 waits until the discharge stop time elapses. After the discharge stop time elapses (Yes in S63), the CPU 81 stops driving the discharge motor 299 forward to stop rotating the discharging roller 220 (S64). Thus, the discharging roller 220 stops rotating in the discharge direction during the printing. The CPU 81 starts driving the discharge motor 299 reversely to start moving the discharging roller 220 to the nip position (refer to FIG. 16; S65). Specifically, the discharging roller 220 starts moving to the nip position during the printing. The discharging roller 220 does not move to the nip position during the printing with the reference time shorter than the motor driving time.

The CPU 81 stops the printing (S66). Specifically, the CPU 81 stops driving the transport motor 68 after stopping the control over the thermal head 60. This stops the printing on the tape and then stops the forward transportation of the tape. More specifically, for full-cutting after the printing, the CPU 81 stops transporting the tape forward to place a portion of the tape to be cut at the first cut position P3. For partial-cutting after the printing, the CPU 81 stops transporting the tape forward to place a portion of the tape to be cut at the second cut position P4. For full-cutting after the printing for the die-cut tape 9, the CPU 81 determines the position of the mark 99 in the transport direction based on the detection signal from the mark sensor 31. The CPU 81 stops transporting the die-cut tape 9 forward to place a portion of the die-cut tape 9 to be cut between adjacent backings 91 at the first cut position P3 based on the determined mark 99 in the transport direction.

The CPU 81 increments the value K of the counter indicating the print count by one (S67). In response to a detection signal from the position sensor 295, the CPU 81 stops driving the discharge motor 299 reversely to stop the discharging roller 220 at the nip position (S68).

Figure 21:
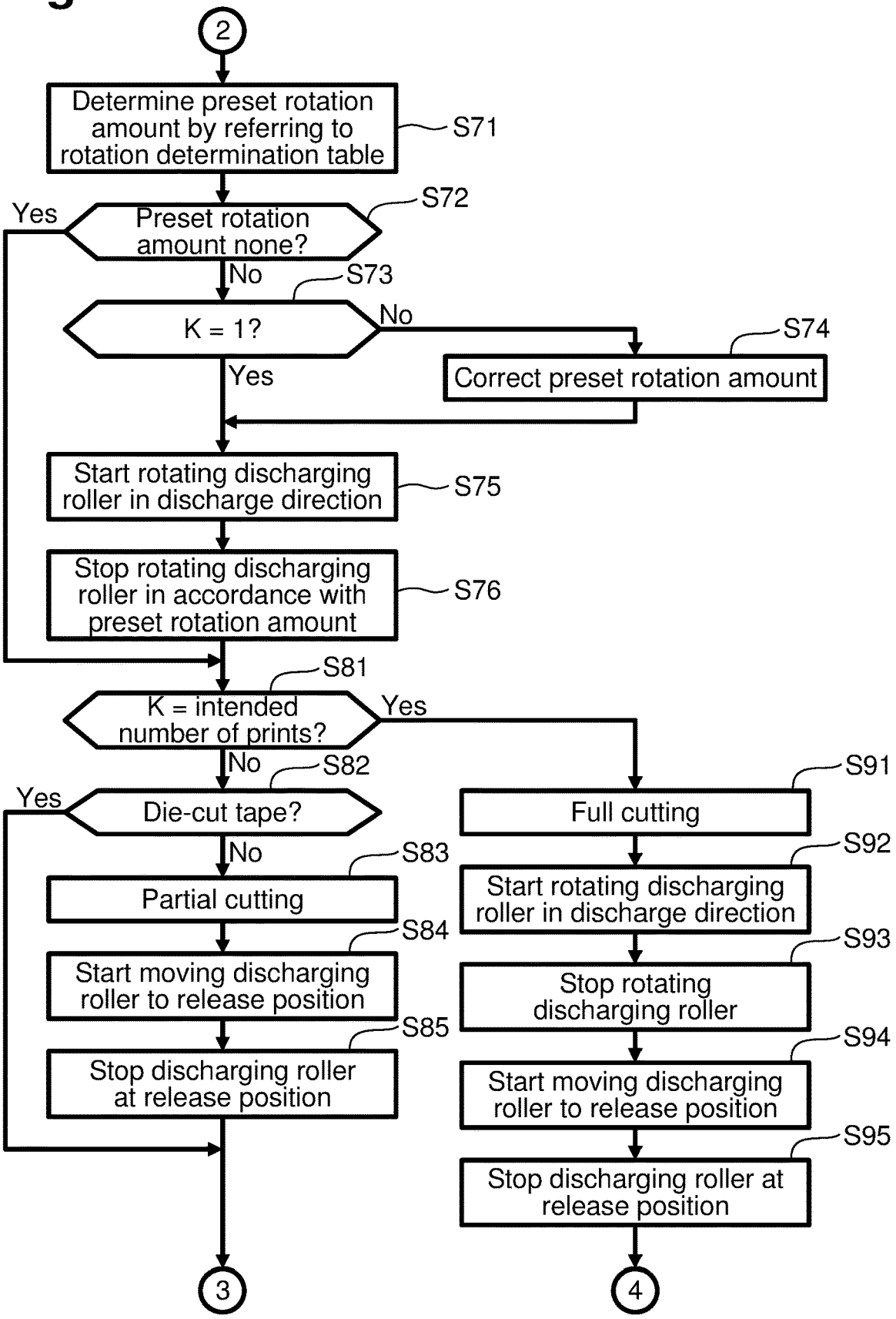
FIG. 21 is a flowchart of a portion of the main process continued from FIG. 20.

As shown in FIG. 21, the CPU 81 determines a preset rotation amount of the discharging roller 220 by referring to a rotation determination table 30 (refer to FIG. 24; S71). The preset rotation amount of the discharging roller 220 is the amount by which the discharging roller 220 rotates in S75 and S76 (described later).

As shown in FIG. 24, the rotation determination table 30 shows the preset rotation amount of the discharging roller 220 associated with the type of each tape. For convenience, FIG. 24 shows the preset rotation amount of the discharging roller 220 labeled either as large, intermediate, small, and none. The preset rotation amount of the discharging roller 220 decreases in the order of large, intermediate, and small. The small amount is greater than zero. The amount labeled as none refers to the preset rotation amount of the discharging roller 220 being zero, meaning no control being performed to rotate the discharging roller 220.

In the present embodiment, the receptor tape 5 and the thermal tape are labeled as large. The laminate tape is labeled as intermediate. The stencil tape is labeled as small. The die-cut tape 9 is labeled as none. Specifically, the rotation determination table 30 has a larger preset rotation amount of the discharging roller 220 for a more flexible tape, except the die-cut tape 9. In S71, the CPU 81 refers to the rotation determination table 30 to determine the preset rotation amount of the discharging roller 220 associated with the type of the tape based on the tape information received in S12. The determined preset rotation amount of the discharging roller 220 is stored into the RAM 84.

As shown in FIG. 21, the CPU 81 determines whether the preset rotation amount of the discharging roller 220 is determined to be none in S71 (S72). For example, the preset rotation amount of the discharging roller 220 for the die-cut tape 9 is determined to be none (Yes in S72). The CPU 81 advances to S81.

For example, the preset rotation amount of the discharging roller 220 for the receptor tape 5, a thermal tape, a stencil tape, and a laminate tape is not determined to be none (No in S72). Then, the CPU 81 determines whether the value K of the counter indicating the print count is one (S73). As described above, the value K of the counter indicating the print count is incremented by one in S67 (refer to FIG. 20) every after a single printing operation. Thus, the value K of the counter indicating the print count is one after the first printing and before the second printing (Yes in S73). The CPU 81 advances to S75.

After the second printing, the value K of the counter indicating the print count is larger than or equal to two (No in S73). The CPU 81 corrects the preset rotation amount of the discharging roller 220 (S74). Specifically, the CPU 81 sets a rotation amount that is a predetermined amount smaller than the preset rotation amount of the discharging roller 220 determined in S71. The predetermined amounts associated with large, intermediate, and small are prestored in the ROM 83. The predetermined amounts associated with large, intermediate, and small are smaller than the preset rotation amounts associated with large, intermediate, and small. The corrected rotation amount is stored into the RAM 84 as the preset rotation amount of the discharging roller 220.

The CPU 81 starts driving the discharge motor 299 forward to start rotating the discharging roller 220 in the discharge direction (S75). Thus, the discharging roller 220 at the nip position rotates in the discharge direction (arrow R3; refer to FIG. 16). The tape is not transported forward because the holding load at the second holding position P5 is smaller than the holding load at the first holding position P2. Thus, the tape creased in S68 (refer to FIG. 20) is held under tension applied downstream in the transport direction and held between the discharging roller 220 and the opposing rollers 230, and thus is smoothed. The tape thus has its width in the vertical direction, and is cut accurately by the printing device 1 in S83 or S91 (described later). For the die-cut tape 9, as described above, the processing in S75 and S76 is not performed. The die-cut tape 9 has the release paper 92 cut between adjacent backings 91, and thus accurate cutting may not be needed. The die-cut tape 9 thus allows creases that may not be smoothed.

The CPU 81 rotates the discharging roller 220 by the preset rotation amount determined in S71 and corrected in S74 (or the preset rotation amount stored in the RAM 84), and then stops driving the discharge motor 299 forward to stop rotating the discharging roller 220 (S76).

The CPU 81 determines whether the value K of the counter indicating the print count is equal to the intended number of prints received in S21 (refer to FIG. 19; S81). Before the printing is repeated by the intended number of prints, the value K of the counter indicating the print count is smaller than the intended number of prints (No in S81). The CPU 81 determines whether the type of the tape indicated by the tape information received in S12 (refer to FIG. 19) is the die-cut tape 9 (S82). When the tape is the die-cut tape 9 (Yes in S82), the CPU 81 returns to S24 (refer to FIG. 19).

When the tape is not the die-cut tape 9 (No in S82), the CPU 81 controls the cutter motor 105 to partially cut the tape (S83). The tape is partially cut between the discharging roller 220 and the opposing rollers 230. The CPU 81 starts driving the discharge motor 299 reversely to start moving the discharging roller 220 to the release position (S84). After driving the discharge motor 299 reversely for the motor driving time, the CPU 81 stops driving the discharge motor 299 reversely to stop the discharging roller 220 at the release position (S85). The CPU 81 returns to S24. Thus, the processing in S24 to S76 is performed repeatedly until the value K of the counter indicating the print count reaches the intended number of prints, or before the printing is repeated by the intended number of prints.

In S81, when the printing is repeated by the intended number of prints, the value K of the counter indicating the print count reaches the intended number of prints (Yes in S81). The CPU 81 controls the cutter motor 105 to fully cut the tape (S91). The tape is fully cut between the discharging roller 220 and the opposing rollers 230. The cut tape (tape piece cut from the original roll) at the second holding position P5 downstream from the first cut position P3 in the transport direction is held between the discharging roller 220 and the opposing rollers 230. The CPU 81 starts driving the discharge motor 299 forward to start rotating the discharging roller 220 in the discharge direction (S92). Thus, the discharging roller 220 at the nip position rotates in the discharge direction (arrow R3; refer to FIG. 16). The cut tape is thus transported forward and discharged out of the printing device 1 through the outlet slit 11.

In accordance with the length of the cut tape, the CPU 81 stops driving the discharge motor 299 forward to stop rotating the discharging roller 220 (S93). Specifically, when the cut tape has its upstream end in the transport direction at the second holding position P5, the CPU 81 stops driving the discharge motor 299 forward. Thus, the cut tape has its upstream end in the transport direction held between the discharging roller 220 and the opposing rollers 230. Thus, the cut tape has its front end (downstream end in the transporting direction) coming out of the outlet slit 11 without falling off the printing device 1 through the outlet slit 11.

The CPU 81 starts driving the discharge motor 299 to rotate reversely to start moving the discharging roller 220 to the release position (S94). After driving the discharge motor 299 to rotate reversely for the motor driving time, the CPU 81 stops driving the discharge motor 299 reversely to stop the discharging roller 220 at the release position (S95). Thus, the cut tape falls off the printing device 1 through the outlet slit 11. After S93 and before S94, the user may remove the cut tape having its front end (downstream end in the transport direction) coming out of the outlet slit 11. The CPU 81 returns to S11 (refer to FIG. 19).

As described above, the printing device 1 includes the transport roller 66, the thermal head 60, the discharging roller 220, the opposing rollers 230, the discharge motor 299, the first coupling mechanism 280, the moving mechanism 250, and the second coupling mechanism 240. The transport roller 66 transports a tape. The thermal head 60 prints on the tape transported by the transport roller 66. The discharging roller 220 is located downstream from the thermal head 60 in the tape transport direction. The opposing rollers 230 oppose the discharging roller 220. The discharge motor 299 rotates forward (arrow R1) and reversely (arrow R2). The reverse direction and the forward direction are opposite to each other. The first coupling mechanism 280 couples the discharge motor 299 and the discharging roller 220 in a manner drivable together. The first coupling mechanism 280 rotates the discharging roller 220 in the discharge direction (arrow R3) when the discharge motor 299 rotates forward. The discharge direction is the rotation direction in which the tape is transported downstream in the transport direction. The moving mechanism 250 moves the discharging roller 220 to the nip position and the release position. The discharging roller 220 at the nip position holds the tape between the roller 220 and the opposing rollers 230. The discharging roller 220 at the release position is spaced from the tape. The second coupling mechanism 240 couples the discharge motor 299 and the moving mechanism 250 in a manner drivable together. The second coupling mechanism 240 includes the one-way clutch 290. The one-way clutch 290 couples the discharge motor 299 and the moving mechanism 250 in a manner drivable together when the discharge motor 299 rotates reversely. The second coupling mechanism 240 decouples the discharge motor 299 from the moving mechanism 250 when the discharge motor 299 rotates forward.

The one-way clutch 290 decouples the discharge motor 299 from the moving mechanism 250 when the discharge motor 299 rotates forward. Thus, the moving mechanism 250 restricts the discharging roller 220 moving between the nip position and the release position. Thus, the printing device 1 can rotate the discharging roller 220 at a predetermined position in the discharge direction (arrow R3). Specifically, the printing device 1 controls the rotation direction of the single discharge motor 299 to control rotation of the discharging roller 220 in the discharge direction and the movement of the discharging roller 220 between the nip position and the release position. Thus, the printing device 1 may not include two motors for rotating the discharging roller 220 in the discharge direction and for moving the discharging roller 220 to the nip position and the release position. The sizing requirements of the printing device 1 may therefore be reduced.

The first coupling mechanism 280 includes the coupling gear 284 and the moving gear 285. The coupling gear 284 is coupled to and drivable together with the discharge motor 299. The moving gear 285 is arranged on the rotation shaft 285A of the discharging roller 220 and meshes with the coupling gear 284. To move the discharging roller 220 to the nip position and the release position, the moving mechanism 250 moves the rotation shaft 285A of the discharging roller 220 along the toothed peripheral surface 284B of the coupling gear 284. Thus, the discharging roller 220 moves to the nip position and the release position while the moving gear 285 is meshing with the coupling gear 284. Thus, the driving force of the discharge motor 299 is transmitted to the discharging roller 220 at the nip position or the release position via the coupling gear 284 and the moving gear 285 in this order. The printing device 1 can thus rotate the discharging roller 220 at the nip position or the release position in the discharge direction (arrow R3) by driving the discharge motor 299.

The printing device 1 includes the first frame 211. The first frame 211 has the guide hole 211A. The guide hole 211A extends along the peripheral surface 284B. The rotation shaft 285A of the discharging roller 220 is received in the guide hole 211A. Thus, while moving to the nip position and the release position, the discharging roller 220 has the rotation shaft 285A guided by the guide hole 211A along the peripheral surface 284B of the coupling gear 284. Thus, whether the discharging roller 220 is at the nip position or the release position, the printing device 1 can reliably maintain the moving gear 285 meshing with the coupling gear 284.

The moving mechanism 250 includes the rotator 251, the eccentric member 252, and the roller holder 255. The rotator 251 is coupled to the discharge motor 299 by the second coupling mechanism 240. The eccentric member 252 is fixed to the rotator 251 in a manner eccentric to the rotation shaft 283A of the rotator 251. The roller holder 255 has the first support hole 266 and the second support hole 271. The first support hole 266 supports the eccentric member 252. The second support hole 271 rotatably supports the rotation shaft 285A of the discharging roller 220. Thus, the roller holder 255 supports the discharging roller 220. When the rotator 251 is rotated by the discharge motor 299, the eccentric member 252 moves laterally. Thus, the eccentric member 252 moves the roller holder 255 laterally. As the roller holder 255 moves laterally, the discharging roller 220 also moves laterally. Thus, the moving mechanism 250 can move the discharging roller 220 to the nip position and the release position.

The first support hole 266 supports the eccentric member 252 in a manner movable in the front-rear direction. The second support hole 271 supports the rotation shaft 285A of the discharging roller 220 in a manner movable in the front-rear direction. The front-rear direction of the printing device 1 is perpendicular to the direction in which the rotation shaft 283A of the rotator 251 extends (vertical direction of the printing device 1) and the direction in which the roller holder 255 moves (lateral direction of the printing device 1). Thus, the rotation shaft 283A of the rotator 251 and the rotation shaft 285A of the discharging roller 220 can move in the front-rear direction with respect to the roller holder 255 when the eccentric member 252 rotates about the rotation shaft 283A and when the rotation shaft 285A of the discharging roller 220 rotates about the rotation shaft 284A of the coupling gear 284. To move the discharging roller 220 between the nip position and the release position, the printing device 1 does not change the manner of moving the roller holder 255 in accordance with the manner of moving the discharging roller 220 and the eccentric member 252. The printing device 1 thus has increased design freedom of the roller holder 255.

The printing device 1 includes the guide frame 214. The guide frame 214 guides the roller holder 255 to move linearly in the lateral direction when the discharging roller 220 moves to the nip position and the release position. The printing device 1 can thus reduce the distance by which the roller holder 255 moves when the discharging roller 220 moves to the nip position and the release position. Thus, the sizing requirements of the printing device 1 may therefore be reduced.

The printing device 1 includes the urging member 297. The urging member 297 urges the rotator 251 to maintain the discharging roller 220 at the nip position. The printing device 1 can maintain the discharging roller 220 at the nip position under the urging force of the urging member 297 when receiving a reverse driving force of the discharge motor 299 transmitted to the rotator 251.

In the printing device 1, the roller holder 255 includes the first member 260, the second member 270, and the urging member 256. The first member 260 has the first support hole 266. The second member 270 has the second support hole 271. The second member 270 is supported by the first member 260 in a manner movable in the direction toward or away from the opposing rollers 230 (lateral direction of the printing device 1). The urging member 256 is arranged between the first member 260 and the second member 270, and urges the first member 260 toward the opposing rollers 230. As the tape has a larger thickness, the second member 270 moves closer to the first member 260, and the urging member 256 urges the first member 260 with a greater urging force. Thus, the printing device 1 can change the holding load at the second holding position P5 in accordance with the thickness of the tape. Thus, the printing device 1 can adjust the holding load at the second holding position P5 in accordance with the thickness of the tape under the urging force of the urging member 256.

The printing device 1 includes the position sensor 295. The position sensor 295 detects the discharging roller 220 at the nip position by detecting the position of the first member 260. In response to a detection signal from the position sensor 295, the printing device 1 can reliably determine that the discharging roller 220 is at the nip position. When the discharging roller 220 moves to the nip position and the release position, the first member 260 moves by a longer distance than the discharging roller 220. Thus, the printing device 1 can detect the position of the discharging roller 220 by detecting the position of the first member 260 more easily than when directly detecting the position of the discharging roller 220.

The above embodiment also has the advantages described below. The printing device (printing device 1) includes a transporting unit (transport roller 66) that transports a print medium (tape), a printing unit (thermal head 60) that prints on a tape transported by the transport roller 66, a roller (discharging roller 220) located downstream from the thermal head 60 in a transport direction of the tape, an opposing member (opposing rollers 230) opposing the discharging roller 220, a motor (discharge motor 299), a coupling mechanism (first coupling mechanism 280) that couples the discharge motor 299 and the discharging roller 220 in a manner drivable together, and rotates the discharging roller 220 in a first direction (discharge direction indicated by arrow R3) that is a rotation direction in which the tape is transported downstream in the transport direction when the discharge motor 299 is driven, and a moving mechanism (moving mechanism 250) that moves the discharging roller 220 to a first position (nip position) and a second position (release position). The discharging roller 220 at the nip position is coupled to the discharge motor 299 by the first coupling mechanism 280 in a manner drivable together and holds the tape between the discharging roller 220 and the opposing rollers 230. The discharging roller 220 at the release position is coupled to the discharge motor 299 by the first coupling mechanism 280 in a manner drivable together and is spaced from the tape.

In this structure, the discharging roller 220 at the nip position or the release position is coupled to the discharge motor 299 by the first coupling mechanism 280 in a manner drivable together. Specifically, the discharge motor 299 can rotate the discharging roller 220 at the nip position or the release position in the discharge direction. Thus, the tape remains transported downstream in the transport direction when coming in contact with the discharging roller 220 rotating in the discharge direction at, for example, the release position. The tape is not prevented from being transported forward. The printing device 1 thus reduces jamming of the tape.

The printing device 1 includes a first control unit (CPU 81 implementing S62) that controls printing in which the thermal head 60 prints on the tape transported by the transport roller 66 while the discharging roller 220 is at the release position, and a second control unit (CPU 81 implementing S61) that drives the discharge motor 299 to rotate the discharging roller 220 in the discharge direction (arrow R3) when printing is performed in S62. Thus, the discharging roller 220 rotates in the discharge direction at the release position during printing. Thus, the tape is not prevented from being transported forward when moving up and coming in contact with the discharging roller 220. The printing device 1 thus reduces jamming of the tape during printing.

In the above embodiment, the tape corresponds to a print medium; the transport roller 66 corresponds to a transporting unit; the thermal head 60 corresponds to a printing unit; the discharging roller 220 corresponds to a roller; the opposing rollers 230 each correspond to an opposing member; the forward rotation direction (arrow R1) corresponds to a forward rotation direction; the reverse rotation direction (arrow R2) corresponds to a reverse rotation direction; the discharge motor 299 corresponds to a motor; the discharge direction (arrow R3) corresponds to a first direction; the first coupling mechanism 280 corresponds to a first coupling mechanism; the nip position corresponds to a first position; the release position corresponds to a second position; the moving mechanism 250 corresponds to a moving mechanism; the one-way clutch 290 corresponds to a first switching mechanism; and the second coupling mechanism 240 corresponds to a second coupling mechanism.

The coupling gear 284 corresponds to a first gear. The rotation shaft 285A corresponds to a rotation shaft of the roller. The moving gear 285 corresponds to a second gear. The peripheral surface 284B corresponds to a peripheral surface. The guide hole 211A corresponds to a guide hole. The first frame 211 corresponds to a first guide. The rotator 251 corresponds to a rotator. The rotation shaft 283A corresponds to a rotation shaft of the rotator. The eccentric member 252 corresponds to an eccentric member. The first support hole 266 corresponds to a first support. The second support hole 271 corresponds to a second support. The roller holder 255 corresponds to a holder. The front-rear direction of the printing device 1 corresponds to a second direction. The guide frame 214 corresponds to a second guide. The urging member 297 corresponds to a first urging member. The first member 260 corresponds to a first member. The second member 270 corresponds to a second member. The urging member 256 corresponds to a third urging member. The position sensor 295 corresponds to a detection unit.

The print device according to the present disclosure can be variously modified from the above embodiment. For example, when the discharging roller 220 moves between the nip position and the release position in the above embodiment, the rotation shaft 285A moves along the peripheral surface 284B of the coupling gear 284. In some embodiments, the rotation shaft 285A may not move along the peripheral surface 284B when the discharging roller 220 moves between the nip position and the release position. A discharging unit 200A according to a first modification will now be described with reference to FIG. 25. The components with the same shapes and functions as those in the above embodiment and also the same processes as in the above embodiment are given the same or corresponding reference numerals, and will not be described or will be described briefly. In the first modification, the printing device 1 includes the same components as in the above embodiment except the discharging unit 200A (the same applies to second, third, fourth, and fifth modifications described later).

The discharging unit 200A differs from the discharging unit 200 of the above embodiment in including a first coupling mechanism 280A in place of the first coupling mechanism 280. The first coupling mechanism 280A is arranged in a lower portion of the discharging unit 200A to couple the discharge motor 299 and the discharging roller 220 in a manner drivable together. The first coupling mechanism 280A includes coupling gears 281 to 284, a moving gear 285, a rotation shaft 285A, and further a coupling gear 286. The rotation axes of the coupling gears 281 to 284 and 286, and the moving gear 285 extend vertically.

The coupling gear 286 is arranged at the rear of the coupling gear 283 and is a double gear including a large-diameter gear and a small-diameter gear. The large-diameter gear of the coupling gear 286 has its front end meshing with the rear end of the small-diameter gear of the coupling gear 283. A rotation shaft 286A is rotatably received in the center hole of the coupling gear 286. The rotation shaft 286A is columnar and extends downward from a fourth frame 215. The fourth frame 215 extends rearward from the left end of the first frame 211. The moving gear 285 is arranged at the rear of the coupling gear 284 and rightward from the coupling gear 286.

The first frame 211 has a guide hole 211B replacing the guide hole 211A of the above embodiment. The guide hole 211B extends vertically through a portion of the first frame 211 at the rear of the coupling gear 284, and is long in the lateral direction. The rotation shaft 285A has a portion received in the guide hole 211B above the moving gear 285. The rotation shaft 285A is movable inside and along the guide hole 211B in the lateral direction.

Figure 25:
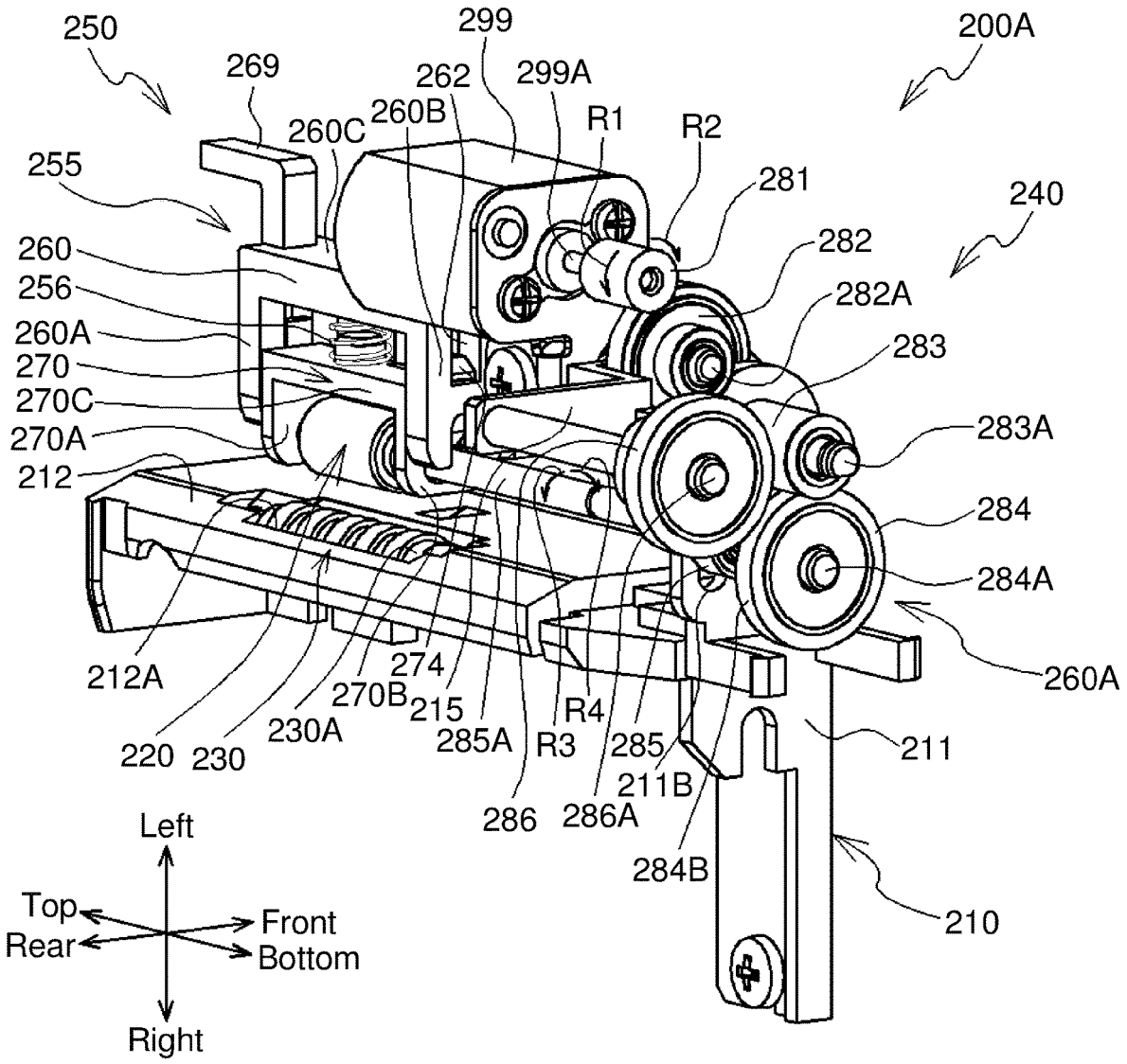
FIG. 25 is a perspective rear view of a discharging unit according to a first modification as viewed from left below.

When the rotation shaft 285A is at the right end of the guide hole 211B, the front end of the moving gear 285 meshes with the rear end of the small-diameter gear of the coupling gear 284 (refer to FIG. 25). The moving gear 285 is spaced rightward from the small-diameter gear of the coupling gear 286. More specifically, the left end of the moving gear 285 does not mesh with the right end of the small-diameter gear of the coupling gear 286. When the rotation shaft 285A is at the left end of the guide hole 211B, the left end of the moving gear 285 meshes with the right end of the small-diameter gear of the coupling gear 286 (not shown). The moving gear 285 is spaced from the small-diameter gear of the coupling gear 284. More specifically, when the rotation shaft 285A is at the left end of the guide hole 211B, the front end of the moving gear 285 does not mesh with the rear end of the small-diameter gear of the coupling gear 284.

The operation of each component of the discharging unit 200A performed when the discharge motor 299 rotates forward will now be described focusing on its differences from the above embodiment. When the front end of the moving gear 285 meshes with the rear end of the small-diameter gear of the coupling gear 284, the forward rotation force of the discharge motor 299 is transmitted by the first coupling mechanism 280A from the output shaft 299A via the coupling gears 281, 282, 283, and 284, the moving gear 285, and the rotation shaft 285A to the discharging roller 220 in this order. This rotates the discharging roller 220 in the discharge direction (arrow R3). When the left end of the moving gear 285 meshes with the right end of the small-diameter gear of the coupling gear 286, the forward rotation force of the discharge motor 299 is transmitted by the first coupling mechanism 280A from the output shaft 299A via the coupling gears 281, 282, 283, and 286, the moving gear 285, and the rotation shaft 285A to the discharging roller 220 in this order. This rotates the discharging roller 220 in the discharge direction (arrow R3).

The operation of each component of the discharging unit 200A performed when the discharge motor 299 rotates reversely will now be described focusing on its differences from above embodiment. When the front end of the moving gear 285 meshes with the rear end of the small-diameter gear of the coupling gear 284, the reverse rotation force of the discharge motor 299 is transmitted by the first coupling mechanism 280A from the output shaft 299A via the coupling gears 281, 282, 283, and 284, the moving gear 285, and the rotation shaft 285A to the discharging roller 220 in this order. This rotates the discharging roller 220 clockwise in a bottom view, or in the return direction (arrow R4).

The reverse rotation force of the discharge motor 299 is also transmitted, as in the above embodiment, by the second coupling mechanism 240 from the output shaft 299A via the coupling gears 281, 282, and 283 to the rotation shaft 283A in this order. Thus, the moving mechanism 250 moves the discharging roller 220 to the nip position (not shown) or to the release position (refer to FIG. 25), as in the above embodiment.

When the discharging roller 220 moves between the nip position and the release position, the rotation shaft 285A moves along the guide hole 211B in the lateral direction. When the discharging roller 220 moves from the release position to the nip position, the discharging roller 220 approaches the opposing rollers 230 from the left (or in a direction perpendicular to the transport direction). The moving gear 285 moves in the lateral direction together with the rotation shaft 285A. When the discharging roller 220 is at the nip position, the rotation shaft 285A is at the right end of the guide hole 211B. When the discharging roller 220 is at the release position, the rotation shaft 285A is at the left end of the guide hole 211B. Thus, when the discharging roller 220 moves between the nip position and the release position, the moving gear 285 moves between the position at which the moving gear 285 meshes with the coupling gear 284 and the position at which the moving gear 285 meshes with the coupling gear 286. The first coupling mechanism 280A couples the discharge motor 299 and the discharging roller 220 in a manner drivable together when the discharging roller 220 is at either the nip position or the release position.

For the discharging unit 200A, when the discharging roller 220 moves between the nip position and the release position, the rotation shaft 285A moves linearly in the lateral direction. The second support hole 271 thus may not be long in the front-rear direction. More specifically, the second support hole 271 may simply rotatably support the rotation shaft 285A.

In the first modification, the first coupling mechanism 280A may include no coupling gear 286. In this example, when the discharging roller 220 is at the release position, the moving gear 285 meshes with none of the coupling gears. Thus, the discharging roller 220 does not rotate when the discharge motor 299 is driven.

In the above embodiment, the single discharge motor 299 is switched between the forward rotation and the reverse rotation to switch both the rotation of the discharging roller 220 and the movement of the discharging roller 220 between the nip position and the release position. In some embodiments, different motors may be used to rotate the discharging roller 220 and move the discharging roller 220 between the nip position and the release position. A discharging unit 200B according to a second embodiment will now be described with reference to FIG. 26. The discharging unit 200B differs from the discharging unit 200 of the above embodiment in further including a discharge motor 298, a first coupling mechanism 280B replacing the first coupling mechanism 280, and a second coupling mechanism 240B replacing the second coupling mechanism 240. The discharge motor 298 is fixed to the right side of the second frame 212 at the right end of the first frame 211 to connect to the CPU 81 (refer to FIG. 18). The discharge motor 298 has an output shaft 298A extending downward from the discharge motor 298. The discharge motor 298 can rotate the output shaft 298A clockwise (arrow R5) and counterclockwise (arrow R6) in a bottom view.

The first coupling mechanism 280B is arranged in a lower portion of the discharging unit 200B to couple the discharge motor 298 and the discharging roller 220 in a manner drivable together. The first coupling mechanism 280B includes the coupling gear 284, the moving gear 285, the rotation shaft 285A, and further coupling gears 287 to 289 replacing the coupling gears 281 to 283. The rotation axes of the coupling gears 284 and 287 to 289, and the moving gear 285 extend vertically. The coupling gear 287 is a spur gear fixed to a lower end portion of the output shaft 298A.

The coupling gear 288, which is a spur gear, is arranged on the left rear of the coupling gear 287. The coupling gear 288 has its front right end meshing with a rear left end of the coupling gear 287. A rotation shaft 288A is rotatably received in the center hole of the coupling gear 288. The rotation shaft 288A is columnar and fixed to the first frame 211 and extends downward from the first frame 211. The coupling gear 289, which is a spur gear, is arranged on the left front of the coupling gear 288. The coupling gear 289 has its rear right end meshing with a front left end of the coupling gear 288. A rotation shaft 289A is rotatably received in the center hole of the coupling gear 289. The rotation shaft 289A is columnar and fixed to the first frame 211 and extends downward from the first frame 211. The coupling gear 284 is arranged on the left of the coupling gear 289. The coupling gear 284 has its right end meshing with the left end of the coupling gear 289.

Figure 26:
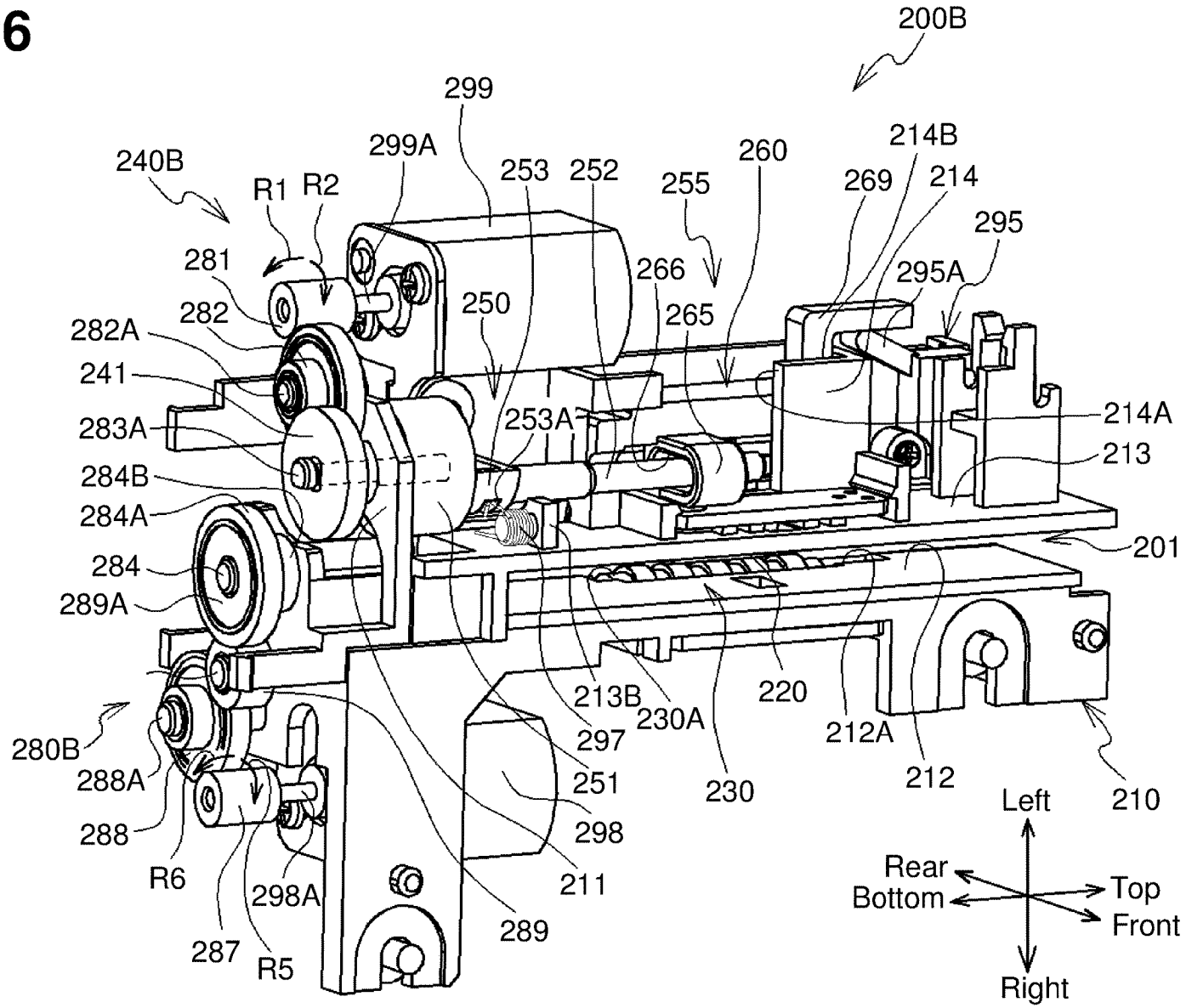
FIG. 26 is a perspective front view of a discharging unit according to a second modification as viewed from left below.

Although not shown in FIG. 26, the moving gear 285 is arranged at the rear of the coupling gear 284 as in the above embodiment. The rotation shaft 285A has the lower end portion received and fixed in the coupling gear 284. The first frame 211 has the guide hole 211A.

The second coupling mechanism 240B is arranged in a lower portion of the discharging unit 200B to couple the discharge motor 299 and the moving mechanism 250 in a manner drivable together. The second coupling mechanism 240B includes a plurality of coupling gears 281 and 282, the rotation shaft 283A, and a coupling gear 241 replacing the coupling gear 283. The second coupling mechanism 240B includes no one-way clutch 290. The coupling gear 241, which is a spur gear, is arranged on the right front of the coupling gear 282. The coupling gear 241 has its rear left end meshing with the front right end of the small-diameter gear of the coupling gear 282. The rotation shaft 283A has the lower end portion received and fixed in the center hole of the coupling gear 241. Unlike the coupling gear 283 in the above embodiment, the coupling gear 241 does not mesh with the coupling gear 284.

The operation of each component of the discharging unit 200B performed when the discharge motor 298 is driven will now be described. The driving force of the discharge motor 298 is transmitted by the first coupling mechanism 280B from the output shaft 298A via the coupling gears 287, 288, 289, and 284, the moving gear 285, and the rotation shaft 285A to the discharging roller 220 in this order. Thus, when the discharge motor 298 rotates clockwise (arrow R5) in a bottom view, the discharging roller 220 rotates in the discharge direction (arrow R3). When the discharge motor 298 rotates counterclockwise (arrow R6) in a bottom view, the discharging roller 220 rotates in the return direction (arrow R4). The printing device 1 drives the discharge motor 298 to rotate the discharging roller 220 at the same position in the discharge direction and in the return direction. More specifically, the printing device 1 drives the discharge motor 298 to rotate the discharging roller 220 in the discharge direction and in the return direction without the discharging roller 220 moving between the nip position and the release position.

The operation of each component of the discharging unit 200B performed when the discharge motor 299 is driven will now be described. The driving force of the discharge motor 299 is transmitted by the second coupling mechanism 240B from the output shaft 299A via the coupling gears 281, 282, and 241, and the rotation shaft 283A to the rotator 251 in this order. Thus, when the discharge motor 299 rotates reversely (arrow R2), the rotator 251 rotates clockwise about the rotation shaft 283A in a bottom view. The moving mechanism 250 moves the discharging roller 220 to the nip position or the release position, as in the above embodiment.

The printing device 1 including the discharging unit 200B according to the second modification drives the discharge motors 298 and 299 at the same time to rotate the discharging roller 220 in the discharge direction and in the return direction when the discharging roller 220 moves between the nip position and the release position. In this case, the CPU 81 according to the second modification may perform first tape-end detection described below in place of the first tape-end detection performed in the above embodiment.

Figure 27:
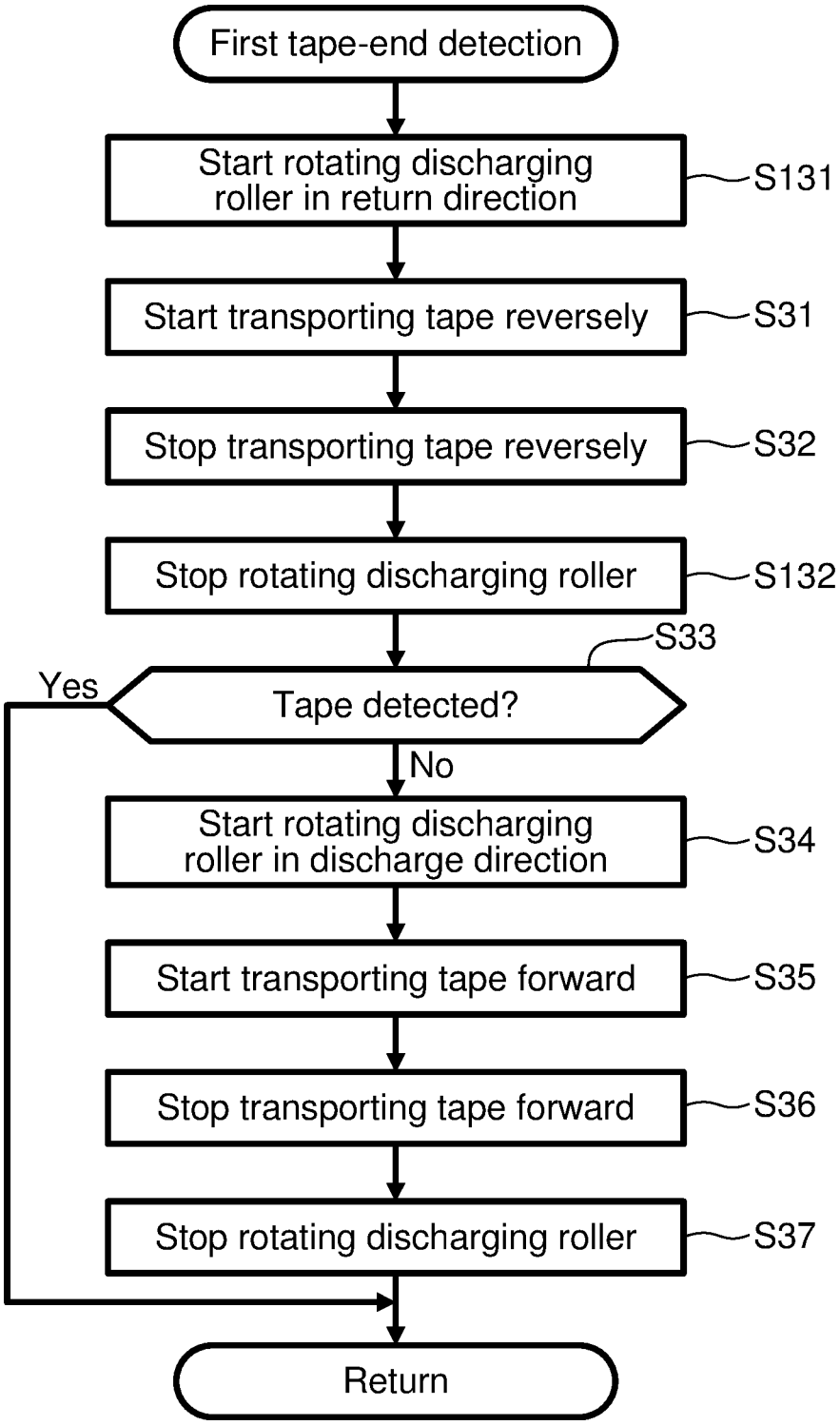
FIG. 27 is a flowchart of a first tape-end detection according to the second modification.

The first tape-end detection according to the second modification will now be described with reference to FIG. 27. The CPU 81 starts driving the discharge motor 298 counterclockwise (arrow R6) in a bottom view to start rotating the discharging roller 220 in the return direction (arrow R4) (S131). The CPU 81 starts driving the transport motor 68 reversely to start transporting the tape reversely (S31). The CPU 81 stops driving the transport motor 68 to stop transporting the tape reversely (S32). The CPU 81 stops driving the discharge motor 298 to stop rotating the discharging roller 220 (S132). The processing in S33 and subsequent steps is the same as the processing in the first tape-end detection according to the above embodiment, and will not be described. In the second tape-end detection, the CPU 81 may perform the same processing as in S131 after S42 and before S43, and the same processing as in S132 after S44 and before S45.

In the first tape-end detection according to the second modification, the discharging roller 220 rotates in the return direction during the reverse transport. The tape in contact with the discharging roller 220 during the reverse transport is not prevented from being transported reversely. The printing device 1 thus reduces jamming of the tape during the reverse transport.

The moving mechanism 250 according to the second modification may include a rack and pinion mechanism in place of the rotator 251 and the eccentric member 252. For example, a pinion may be arranged on the upper end portion of the rotation shaft 283A. A rack extends in the lateral direction to mesh with the pinion. The rack includes a vertical rod, which is received in the first support hole 266. The printing device 1 switches the discharge motor 299 between the forward rotation and the reverse rotation to move the roller holder 255 in the lateral direction with the rack and pinion mechanism. The first support hole 266 may not be long in the front-rear direction.

In the above embodiment, the discharging roller 220 is moved to the nip position or the release position, and is driven to rotate by the discharge motor 299. In some embodiments, the discharging roller 220 may not be driven to rotate by the discharge motor 299. A discharging unit 200C according to a third modification will now be described with reference to FIG. 28. The discharging unit 200C differs from the discharging unit 200 of the above embodiment in further including a discharge motor 296, a first coupling mechanism 280C replacing the first coupling mechanism 280, and a second coupling mechanism 240C replacing the second coupling mechanism 240. The discharge motor 296 is fixed to the right side of the second frame 212 at the right end of the first frame 211 to connect to the CPU 81 (refer to FIG. 18). The discharge motor 296 has an output shaft 296A extending downward from the discharge motor 296. The discharge motor 296 can rotate the output shaft 296A clockwise (arrow R7) and counterclockwise (arrow R8) in a bottom view.

The first coupling mechanism 280C is arranged in a lower portion of the discharging unit 200C to couple the discharge motor 296 and the opposing rollers 230 in a manner drivable together. The first coupling mechanism 280C includes coupling gears 243 to 246 and a rotation shaft 230B. The rotation axes of the coupling gears 243 to 246 extend vertically. The coupling gear 243 is a spur gear fixed to a lower end portion of the output shaft 296A.

The coupling gear 244, which is a spur gear, is arranged on the left rear of the coupling gear 243. The coupling gear 244 has its front right end meshing with a rear left end of the coupling gear 243. A rotation shaft 244A is rotatably received in the center hole of the coupling gear 244. The rotation shaft 244A is columnar and fixed to the first frame 211 and extending downward from the first frame 211. The coupling gear 245, which is a double gear including a large-diameter gear and a small-diameter gear, is arranged on the left front of the coupling gear 244. The small-diameter gear of the coupling gear 245 has its rear right end meshing with a front left end of the coupling gear 244. A rotation shaft 245A is rotatably received in the center hole of the coupling gear 245. The rotation shaft 245A is columnar and fixed to the first frame 211 and extending downward from the first frame 211. The coupling gear 246, which is a spur gear, is arranged on the left front of the coupling gear 245. The coupling gear 246 has its rear right end meshing with a front left end of the large-diameter gear of the coupling gear 245.

Figure 28:
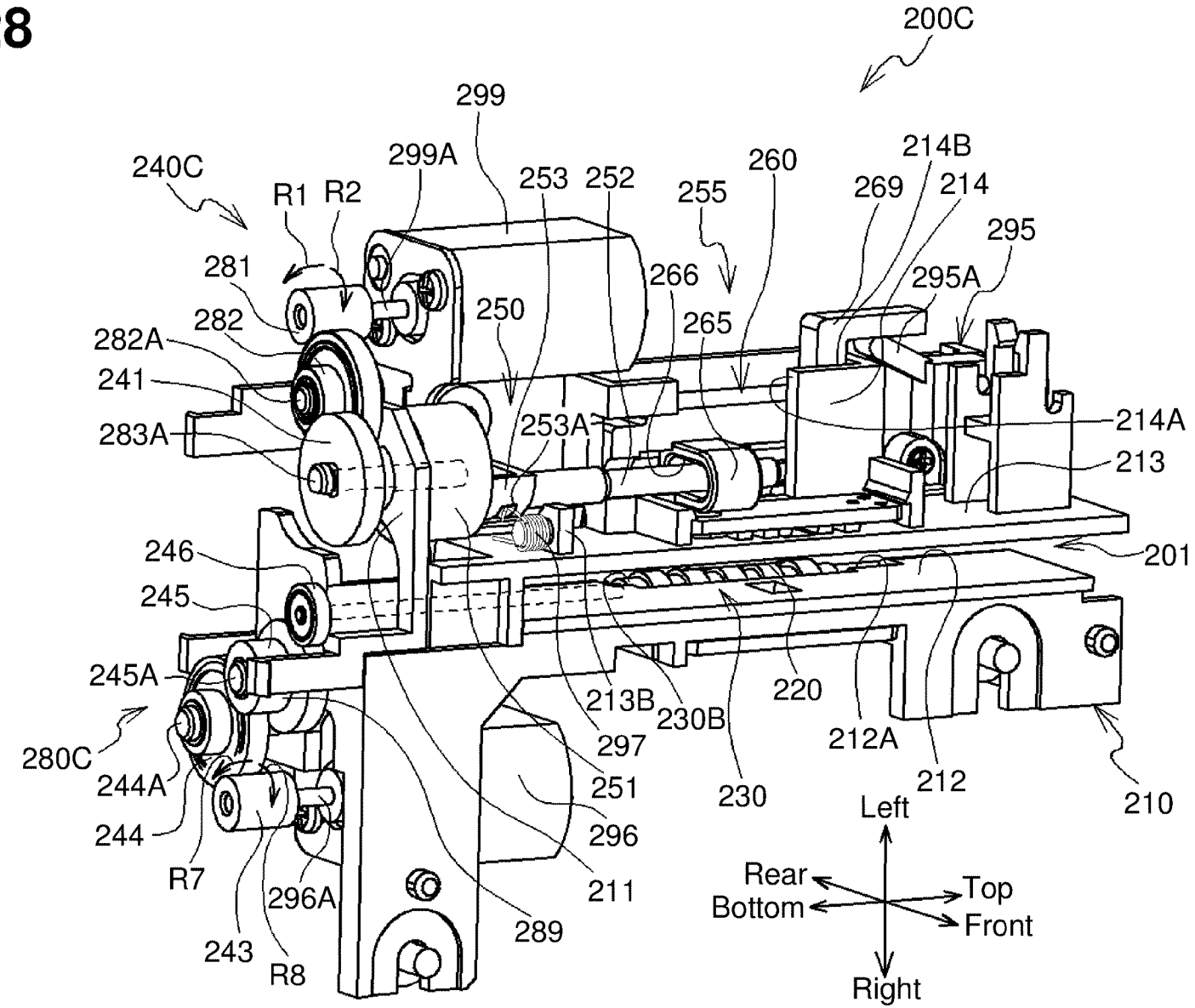
FIG. 28 is a perspective front view of a discharging unit according to a third modification as viewed from left below.

The rotation shaft 230B is used in place of the rotation shaft 230A of the above embodiment. The rotation shaft 230B extends parallel to the rotation shaft 285A. In FIG. 28, the broken lines indicate a portion of the rotation shaft 230B below the lower end of the opposing rollers 230. The rotation shaft 230B has a D-shaped lower end portion. The portion of the rotation shaft 230B other than the lower end portion is columnar. The rotation shaft 230B has a lower end portion extending below the first frame 211, and received and fixed in the center hole of the coupling gear 246. The rotation shaft 230B has an upper end portion extending to the upper end of the hole 212A, and received and fixed in the center hole of the opposing rollers 230. The rotation shaft 230B is rotatably supported by the inner walls above and below the hole 212A. The second coupling mechanism 240C has the same mechanism as the second coupling mechanism 240B according to the second modification, and will not be described.

The operation of each component of the discharging unit 200C performed when the discharge motor 296 is driven will now be described. The driving force of the discharge motor 296 is transmitted by the first coupling mechanism 280C from the output shaft 296A via the coupling gears 243, 244, 245 and 246, and the rotation shaft 230B to the opposing rollers 230 in this order. Thus, when the discharge motor 296 rotates counterclockwise (arrow R7) in a bottom view, the opposing rollers 230 rotate counterclockwise in a bottom view. The tape is transported forward while being in contact with the opposing rollers 230 rotating counterclockwise in a bottom view. When the discharge motor 296 rotates clockwise (arrow R8) in a bottom view, the opposing rollers 230 rotate clockwise in a bottom view. The tape is transported reversely while being in contact with the opposing rollers 230 rotating clockwise in a bottom view. The operation of each component of the discharging unit 200C performed when the discharge motor 299 is driven is the same as the operation of each component of the discharging unit 200B performed when the discharge motor 299 is driven, and will not be described.

In the above embodiment, the eccentric member 252 at the left end of the movable range of the eccentric member 252 in the lateral direction is spaced from the tape. More specifically, the discharging roller 220 is at the release position. In some embodiments, the discharging roller 220 is not moved to the release position. More specifically, when the eccentric member 252 is at the left end of the movable range of the eccentric member 252 in the lateral direction, the discharging roller 220 may hold the tape between the discharging roller 220 and the opposing rollers 230. A discharging unit according to a fourth modification (not shown) will now be described. The discharging unit according to the fourth modification may have the eccentric member 252 at a radially smaller distance to the rotation shaft 283A than the eccentric member 252 of the above embodiment. More specifically, when the eccentric member 252 is at the left end of the movable range of the eccentric member 252 in the lateral direction, the distance between the right end of the discharging roller 220 and the left ends of the opposing rollers 230 may be smaller than the thickness of the tape. When the eccentric member 252 is at the left end of the movable range of the eccentric member 252 in the lateral direction, the right end of the discharging roller 220 and the left ends of the opposing rollers 230 may come in contact with each other with no tape being held.

The above structure allows the printing device 1 according to the fourth modification to adjust the holding load at the second holding position P5 in accordance with the position of the eccentric member 252 in the lateral direction. The printing device 1 can adjust the holding load at the second holding position P5 to one of three levels, namely, a first load, a third load, and a fourth load. The third load and the fourth load may be hereafter collectively referred to as a second load. The printing device 1 may adjust the holding load at the second holding position P5 to one of the two levels including the first load and the second load, or to one of at least four levels.

The second load is smaller than the first load. The fourth load is smaller than the third load. For the printing device 1 according to the fourth modification, the first load is a holding load at the second holding position P5 applied when the eccentric member 252 is at the right end of the movable range of the eccentric member 252 in the lateral direction. The third load is a holding load at the second holding position P5 applied when the eccentric member 252 is at the center of the movable range of the eccentric member 252 in the lateral direction. The fourth load is a holding load at the second holding position P5 applied when the eccentric member 252 is at the left end of the movable range of the eccentric member 252. In this modification, the CPU 81 may perform main processing described below.

The main processing according to the fourth modification will now be described with reference to FIGS. 29 to 33 focusing on its differences from the above embodiment.

Figure 29:
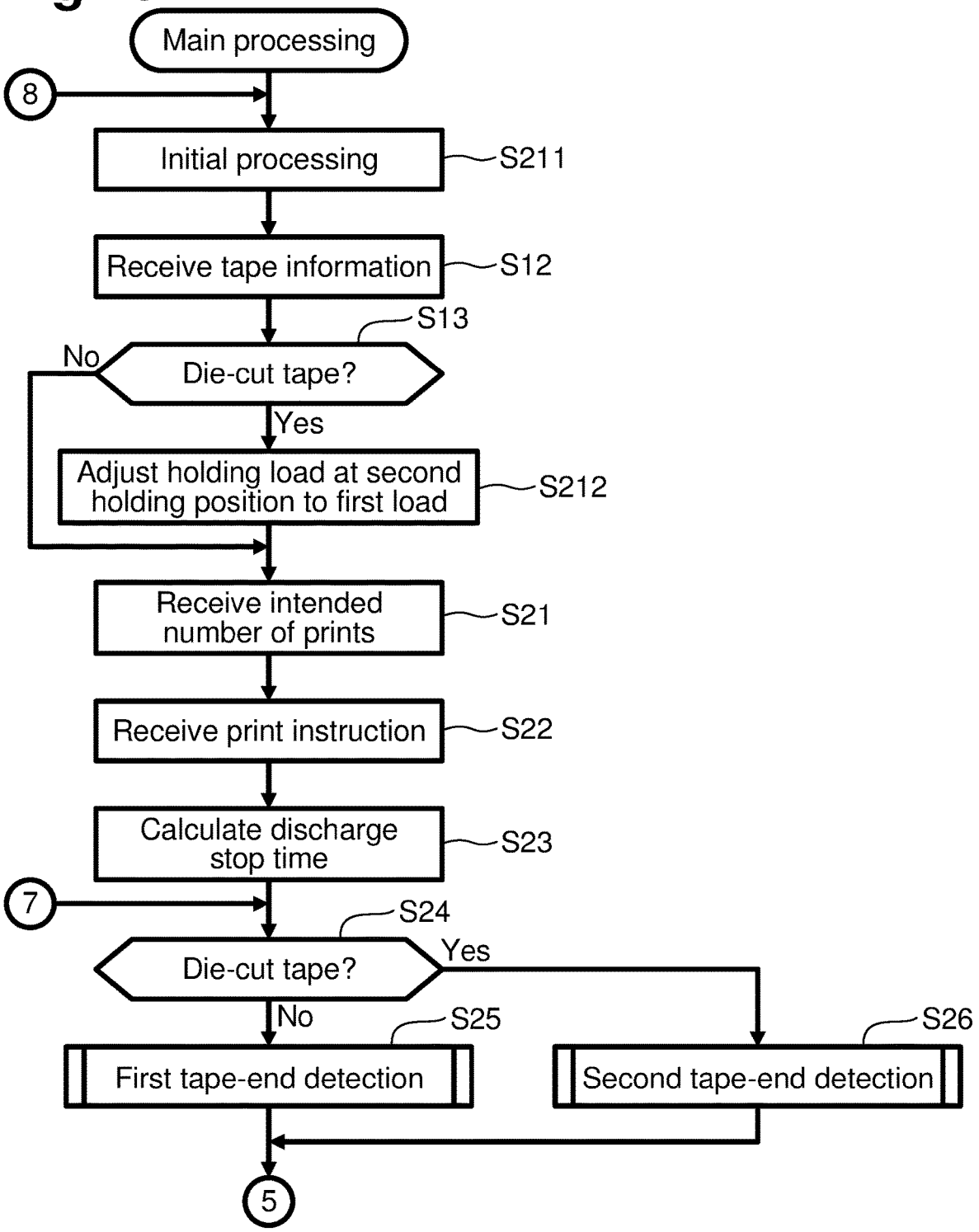
FIG. 29 is a flowchart of a portion of a main process according to a fourth modification.

As shown in FIG. 29, the CPU 81 performs initial processing (S211). The initial processing S211 differs from the initial processing in the above embodiment (S11) in adjusting the holding load at the second holding position P5 to the fourth load. More specifically, the CPU 81 drives the discharge motor 299 reversely to move the eccentric member 252 to the left end of the movable range of the eccentric member 252 in the lateral direction. The CPU 81 advances to S12.

In S13, when the tape is the die-cut tape 9 (Yes in S13), the CPU 81 adjusts the holding load at the second holding position P5 to the first load (S212). More specifically, the CPU 81 drives the discharge motor 299 reversely until receiving a detection signal from the position sensor 295. This moves the eccentric member 252 to the right end of the movable range of the eccentric member 252 in the lateral direction. The CPU 81 advances to S21. In S25 and S26, first tape-end detection and second tape-end detection described below will be performed.

Figure 32:
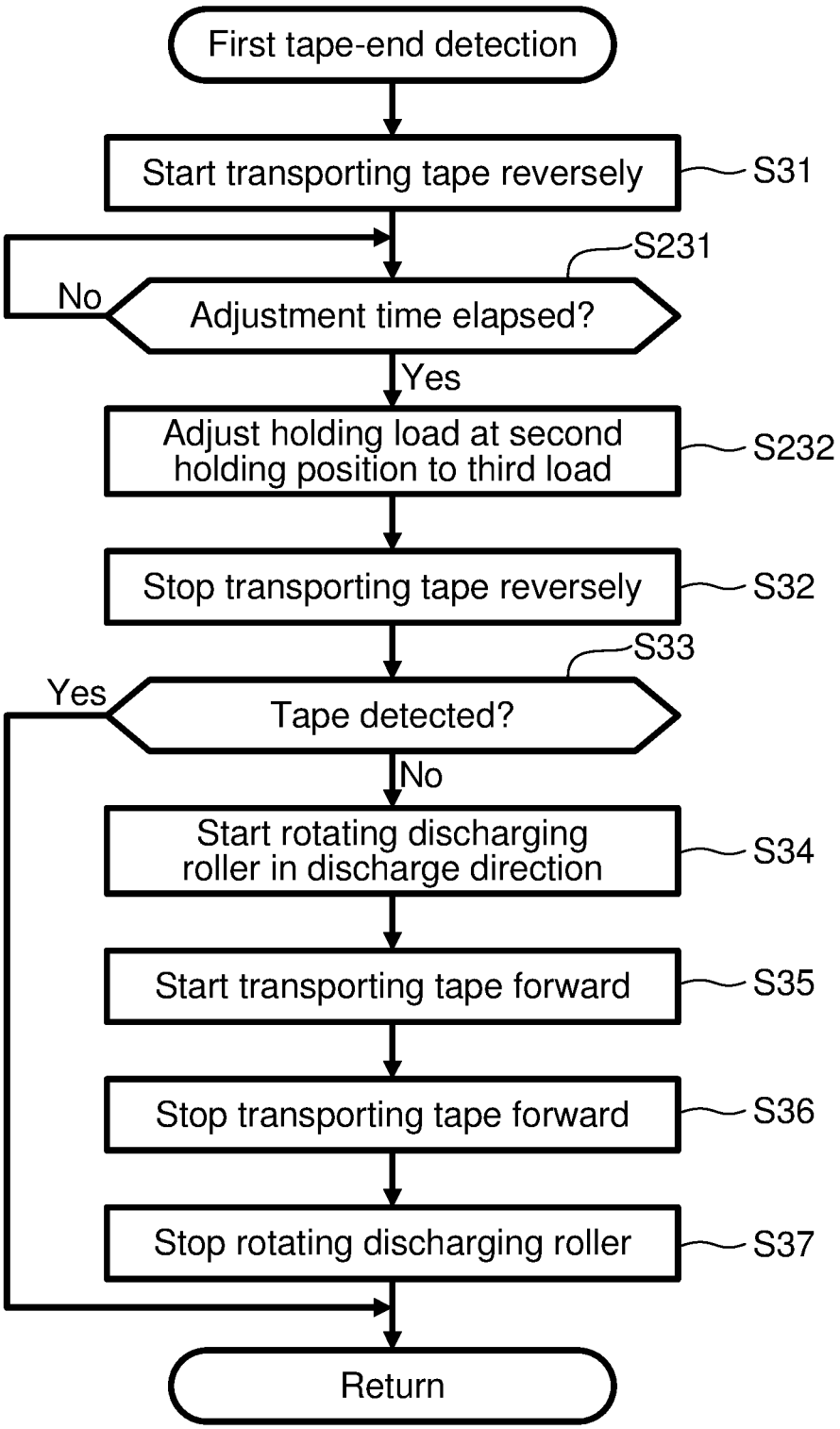
FIG. 32 is a flowchart of a first tape-end detection according to the fourth modification.

The first tape-end detection according to the fourth modification will now be described with reference to FIG. 32. The CPU 81 starts driving the transport motor 68 to rotate reversely to start transporting the tape reversely (S31). This transports the tape reversely under the fourth load as the holding load at the second holding position P5. The CPU 81 determines whether an adjustment time has elapsed (S231). The adjustment time is prestored in the ROM 83. The adjustment time is shorter than the time taken to transport the tape reversely (specifically, the time taken before S32 after S31). When the adjustment time has not elapsed (No in S231), the CPU 81 waits until the adjustment time elapses.

When the adjustment time has elapsed (Yes in S231), the CPU 81 adjusts the holding load at the second holding position P5 to the third load (S232). More specifically, the CPU 81 drives the discharge motor 299 reversely for a predetermined time to move the eccentric member 252 to the center of the movable range of the eccentric member 252 in the lateral direction. This transports the tape reversely under the third load as the holding load at the second holding position P5. The CPU 81 stops driving the transport motor 68 to stop transporting the tape reversely (S32).

Figure 33:
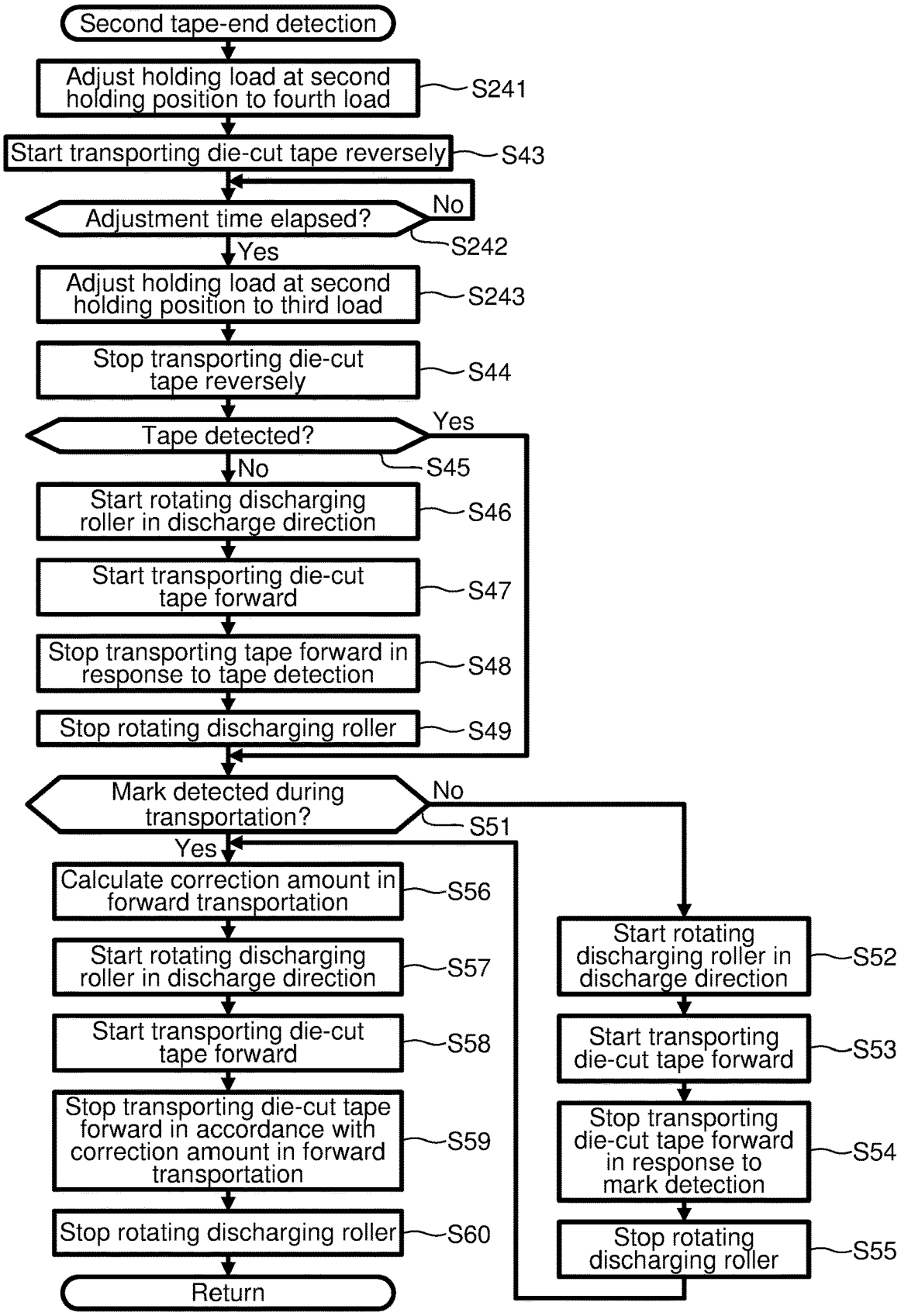
FIG. 33 is a flowchart of a second tape-end detection according to the fourth modification.

The second tape-end detection according to the fourth modification will now be described with reference to FIG. 33. The CPU 81 adjusts the holding load at the second holding position P5 to the fourth load (S241). More specifically, the CPU 81 drives the discharge motor 299 reversely for a predetermined time to move the eccentric member 252 to the left end of the movable range of the eccentric member 252 in the lateral direction. The processing in S242 is the same as the processing in S231, and the processing in S243 is the same as the processing in S232.

Figure 30:
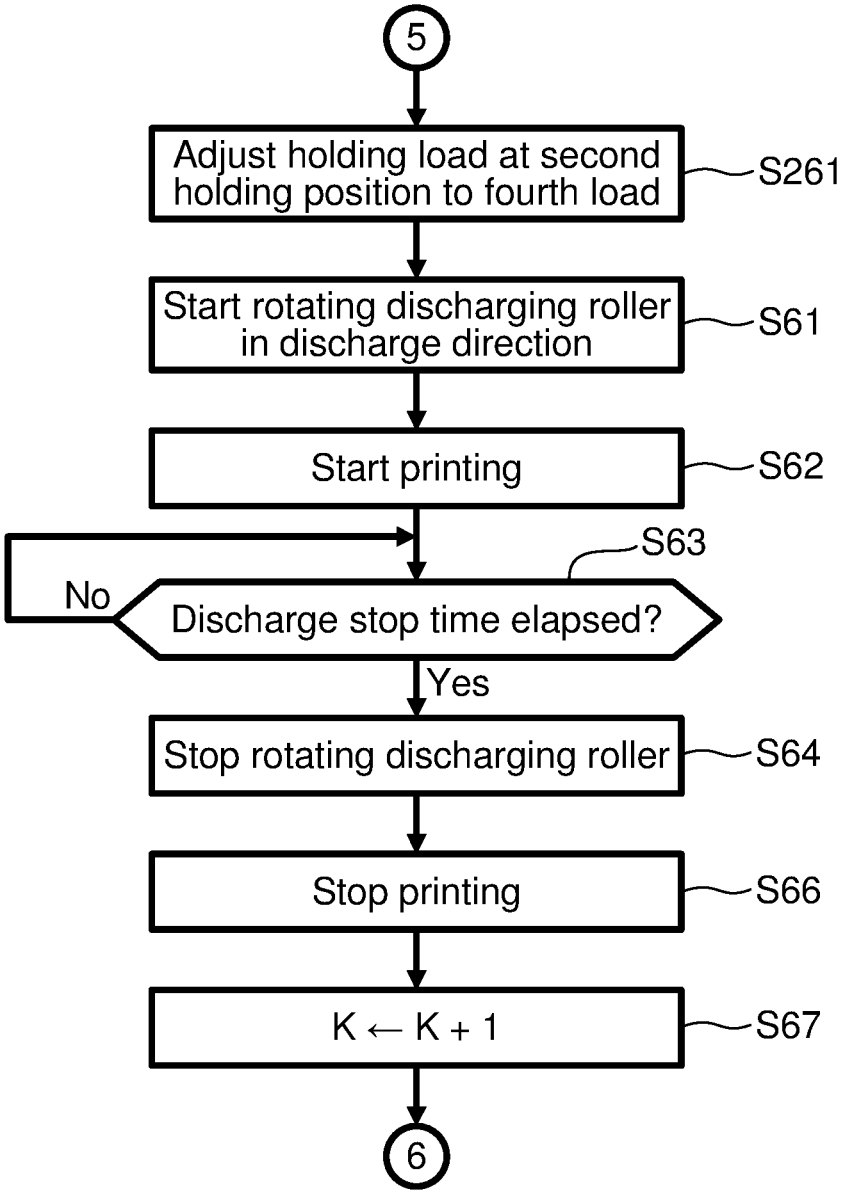
FIG. 30 is a flowchart of a portion of the main process according to the fourth modification continued from FIG. 29.

As shown in FIG. 30, subsequent to the first tape-end detection or the second tape-end detection, the CPU 81 drives the discharge motor 299 reversely to adjust the holding load at the second holding position P5 to the fourth load (S261). The CPU 81 performs the processing in S64, S66, and S67 in this order before advancing to S271 (refer to FIG. 31). In other words, the CPU 81 skips the processing in S65 and S68 (refer to FIG. 20) in the main processing according to the above embodiment.

Figure 31:
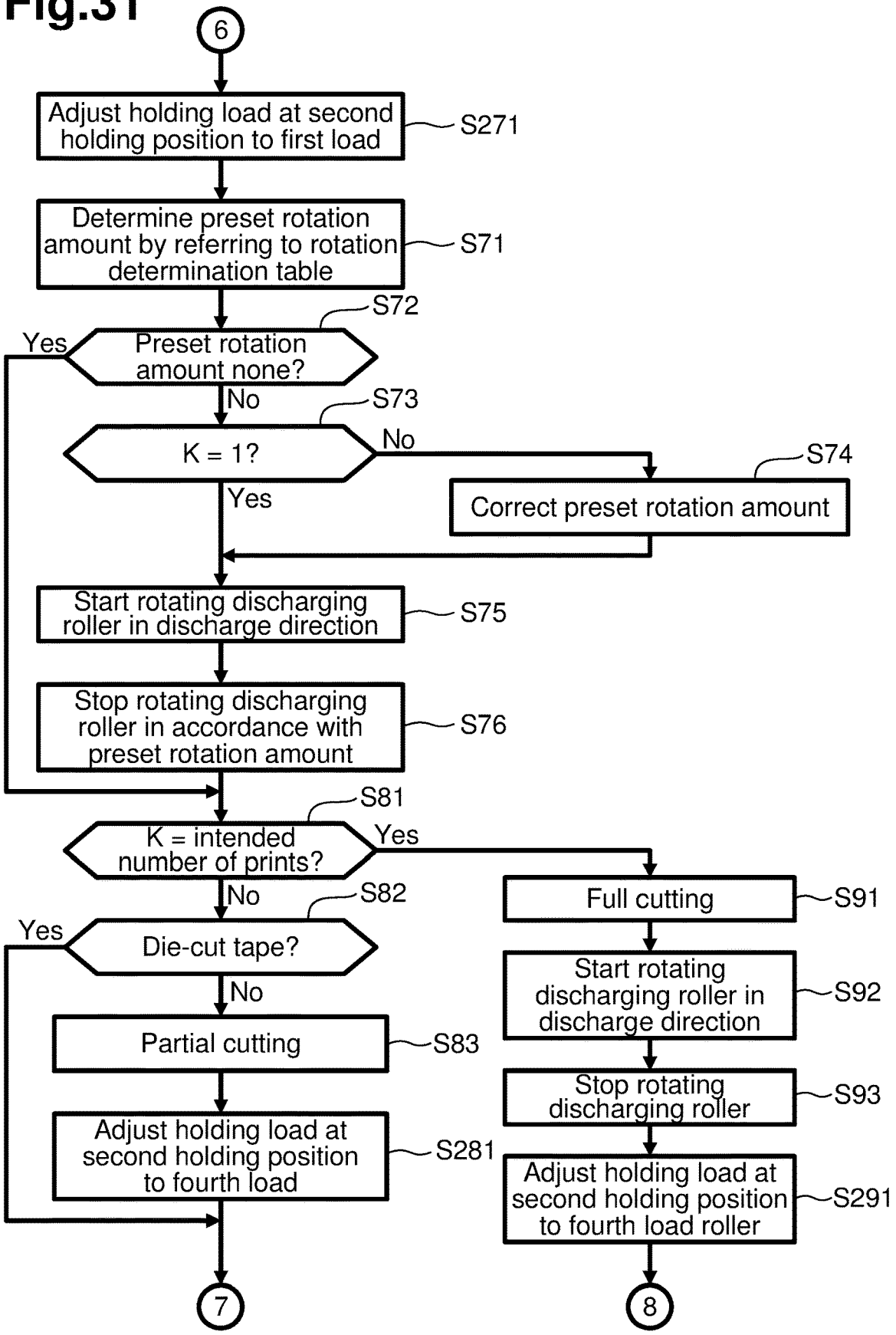
FIG. 31 is a flowchart of a portion of the main process according to the fourth modification continued from FIG. 30.

As shown in FIG. 31, the CPU 81 drives the discharge motor 299 reversely to adjust the holding load at the second holding position P5 to the first load (S271). The CPU 81 advances to S71. After S83, the CPU 81 drives the discharge motor 299 reversely to adjust the holding load at the second holding position P5 to the fourth load (S281). The CPU 81 returns to S24 (refer to FIG. 29). After S93, the CPU 81 drives the discharge motor 299 reversely to adjust the holding load at the second holding position P5 to the fourth load (S291). The CPU 81 returns to S211 (refer to FIG. 29).

Figure 34:
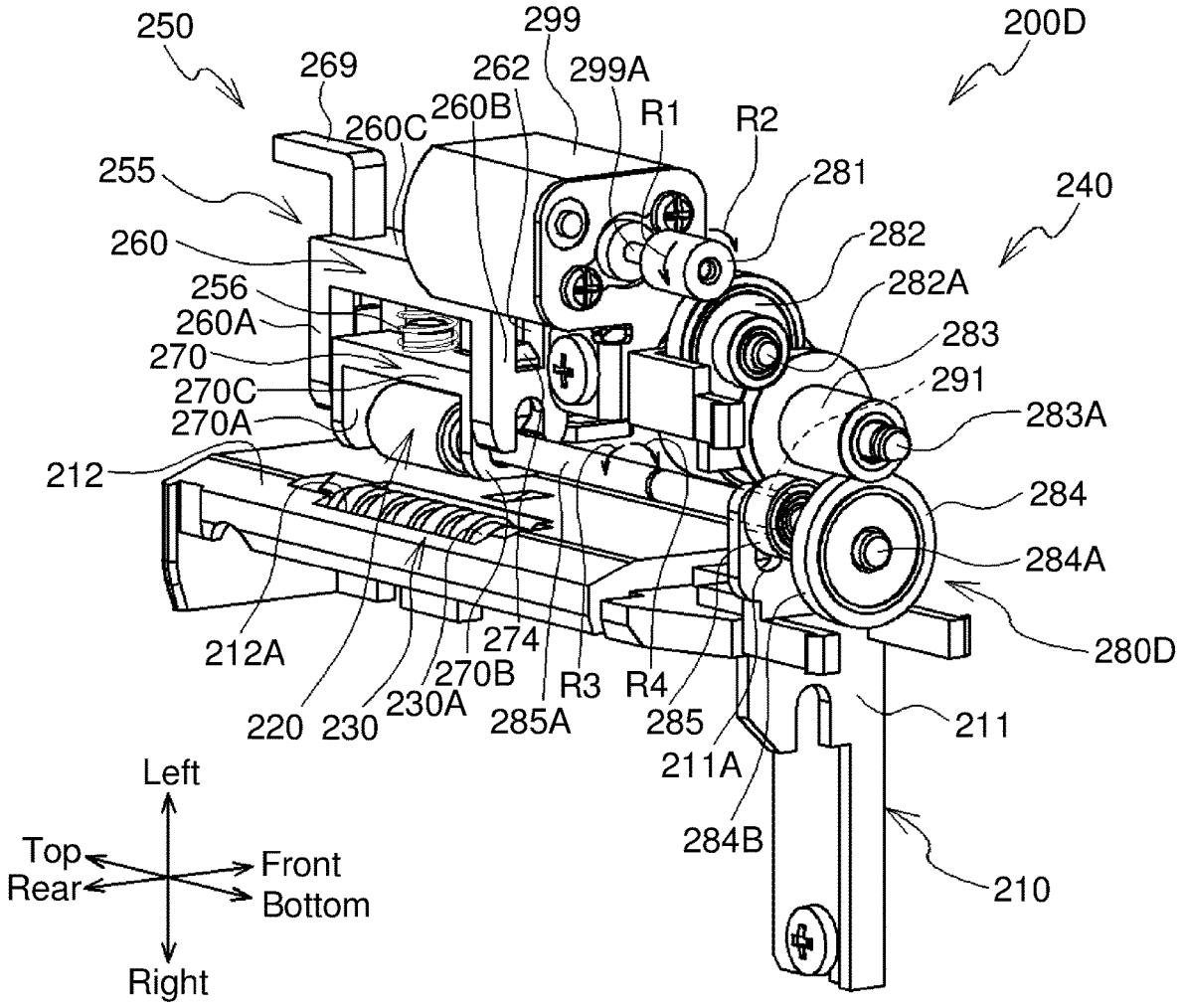
FIG. 34 is a perspective rear view of a discharging unit according to a fifth modification as viewed from left below.

A discharging unit 200D according to a fifth modification will now be described with reference to FIG. 34. The discharging unit 200D differs from the above embodiment in including a first coupling mechanism 280D in place of the first coupling mechanism 280. The first coupling mechanism 280D includes the coupling gears 281 to 284, the moving gear 285, the rotation shaft 285A, and further a one-way clutch 291. The one-way clutch 291 is arranged between the center hole of the moving gear 285 and the lower end portion of the rotation shaft 285A. In FIG. 34, the broken lines indicate the portion of the rotation shaft 285A arranged inside the moving gear 285 and the first frame 211, and the one-way clutch 291. The rotation shaft 285A has the lower end portion rotatably received in the center hole of the moving gear 285. The one-way clutch 291 may be arranged between the upper end portion of the rotation shaft 285A and the center hole of the discharging roller 220.

The one-way clutch 291 couples the discharge motor 299 and the rotation shaft 285A (discharging roller 220) in a manner drivable together when the discharge motor 299 rotates forward, and decouples the discharge motor 299 from the rotation shaft 285A (discharging roller 220) when the discharge motor 299 rotates reversely. When the discharge motor 299 rotates forward (arrow R1), the moving gear 285 is rotated counterclockwise in a bottom view via the coupling gears 281 to 284. The one-way clutch 291 rotates the rotation shaft 285A together with the moving gear 285 as the moving gear 285 rotates counterclockwise in a bottom view. When the discharge motor 299 rotates reversely (arrow R2), the moving gear 285 is rotated clockwise in a bottom view via the coupling gears 281 to 284. The one-way clutch 291 causes the rotation shaft 285A to rotate without meshing with the moving gear 285 as the moving gear 285 rotates clockwise in a bottom view.

The first coupling mechanism 280D includes a second switching mechanism (one-way clutch 291) that couples the discharge motor 299 and the discharging roller 220 in a manner drivable together when the discharge motor 299 rotates forward, and decouples the discharge motor 299 from the discharging roller 220 when the discharge motor 299 rotates reversely.

In this case, the reverse rotation force of the discharge motor 299 is not transmitted from the moving gear 285 to the discharging roller 220. Thus, the discharging roller 220 does not rotate in the return direction (arrow R4) when the discharge motor 299 rotates reversely. Thus, the printing device 1 drives the discharge motor 299 reversely to move the discharging roller 220 to the nip position or the release position while the discharging roller 220 stops rotating. The printing device 1 according to the fifth modification prevents the tape from being transported reversely when the tape comes in contact with the discharging roller 220 that is moving to the nip position and the release position. The one-way clutch 291 corresponds to the second switching mechanism.

The above embodiment may further be modified in the following forms. For example, the urging member 297, which is a torsion spring in the above embodiment, may be a different spring, such as a helical compression spring, a disc spring, and a leaf spring, or an elastic member such as a rubber member. The urging member 256, which is a helical compression spring, may be a different spring, such as a disc spring and a leaf spring, or an elastic member such as a rubber member.

The printing device 1 may include another urging member (not shown). The urging member is, for example, a torsion spring fixed to a fixing portion. Similarly to the urging member 297, this urging member is not limited to a torsion spring. The fixing portion is arranged around the lower rear of the rotator 251. The urging member has its two ends extending frontward. When the discharging roller 220 is at the nip position, the enlarged-diameter portion 253 is located on the right of the rotation shaft 283A. At this position, the recess 253A is open rightward, and is spaced from the end of the urging member. When the discharging roller 220 is at the release position, the enlarged-diameter portion 253 is located on the left of the rotation shaft 283A. At this position, the recess 253A is open leftward, with which the end of the urging member is engaged from the left. The urging member urges the enlarged-diameter portion 253 obliquely to the right rear. More specifically, the urging member urges the rotator 251 counterclockwise in a bottom view. The urging member restricts the discharging roller 220 moving from the release position to the nip position with the rotator 251 rotating counterclockwise in a bottom view. The urging force of the urging member is smaller than the force to rotate the rotator 251 counterclockwise in a bottom view. This maintains the discharging roller 220 at the release position under the urging force of the urging member. In other words, the printing device 1 may include an urging member that urges the rotator 251 to maintain the discharging roller 220 at the release position. In this case, the printing device 1 prevents the discharging roller 220 from unintendedly moving from the release position to the nip position. The urging member corresponds to a second urging member. This urging member and the urging member 297 may be integral. More specifically, the urging member 297 may urge the rotator 251 to maintain the discharging roller 220 at the release position.

The structure of the cutter unit 100 is not limited to the structure described in the above embodiment. For example, the cutter unit 100 may perform either full cutting or partial cutting. The cutter unit 100 may include a single cut-blade that can fully or partially cut the tape. The cutter unit 100 may be a disk-shaped rotary cutter that rotates to cut a tape. The cutter unit 100 may be a slide cutter that moves in the width direction of a tape to cut the tape. The cutter unit 100 may include no cutter motor 105, but may include a manual cutter. The cutter unit 100 may perforate the tape in the width direction for partial cutting.

The number of coupling gears 281 to 284 is not limited to the number in the above embodiment. The first coupling mechanism 280 and the second coupling mechanism 240 may each include, for example, a belt or a pulley. The printing device 1 may use, for example, a belt in place of the transport roller 66 to transport the tape.

In the above embodiment, the roller holder 255 moves linearly in the lateral direction along the guide frame 214. In some embodiments, the printing device 1 may include, in place of the guide frame 214, a member that guides the roller holder 255 to move along the peripheral surface 284B of the coupling gear 284. In this case, the second support hole 271 may not be long in the front-rear direction. More specifically, the second support hole 271 may simply rotatably support the rotation shaft 285A.

The first frame 211 may be located below the moving gear 285. In this case, the first frame 211 may have a guide groove in place of the guide hole 211A. The guide groove is recessed downward from the first frame 211. The lower end portion of the rotation shaft 285A slides in the guide groove. The first support hole 266 and the second support hole 271 may be each replaced by protrusions. In this case, the eccentric member 252 and the rotation shaft 285A may each have their upper ends recessed. The recesses receive the protrusions to support the eccentric member 252 and the rotation shaft 285A.

In the above embodiment, the holding load at the second holding position P5 is smaller than the holding load at the first holding position P2. The holding load at the first holding position P2 is smaller than the holding load at the print position P1. In some embodiments, the holding load at the second holding position P5 may be equal to or greater than the holding load at the first holding position P2 or the holding load at the print position P1. The holding load at the first holding position P2 may be equal to or greater than the holding load at the print position P1.

The mark sensor 31 and the tape sensor 32, which are transmissive photosensors in the above embodiment, may include reflective photosensors or other sensors. The position sensor 295, which is a switch sensor in the above embodiment, may be a photosensor or another sensor. In the above embodiment, the position sensor 295 detects the discharging roller 220 at the nip position by detecting the position of the first member 260. In some embodiments, the position sensor 295 may directly detect the position of the discharging roller 220. For example, the position sensor 295 may have the movable piece 295A located on a pathway along which the rotation shaft 285A moves. The position sensor 295 may detect the discharging roller 220 at the release position. The marks 99 are not limited to through-holes, and may include any marks, such as irregularity, colored portions, detectable by the mark sensor 31. The marks 99 may not be on the release paper 92 between the adjacent backings 91, and may be on the backings 91 or on the side of the release paper 92 opposite to the backings 91.

The plurality of cylindrical opposing rollers 230 may be replaced by a single cylindrical opposing roller. The single cylindrical discharging roller 220 may be replaced by a plurality of cylindrical discharging rollers. The elastic discharging roller 220 and the opposing rollers 230 may be replaced by nonelastic members made of, for example, metal. The opposing rollers 230 may be nonrotatable, and may be replaced by, for example, an elastic plate.

The printing device 1 may be operable without the discharge motor 299. More specifically, the discharging roller 220 and the opposing rollers 230 may rotate while in contact with the tape being transported. The discharging roller 220 may be manually moved to the nip position or the release position.

In the above embodiment, the rotation determination table 30 shows four levels of the preset rotation amount of the discharging roller 220, namely, large, intermediate, small, and none. The preset rotation amount may also be one of five or more levels or three or less levels. For example, the die-cut tape 9 may be associated with a level other than none, and the tapes other than the die-cut tape 9 may be associated with none. The rotation determination table 30 may include the preset rotation amount of the discharging roller 220 associated with other types of tape (e.g., a tube tape).

In the above embodiment, the printing device 1 is a general-purpose printing device that can receive a variety of cassettes. In some embodiments, the printing device 1 may be a special-purpose printing device that can receive one specific type of cassette. In this case, the printing device 1 may not obtain tape information. For example, the CPU 81 included in the printing device dedicated to a cassette accommodating the die-cut tape 9 may move the discharging roller 220 to the nip position in the initial processing. The printing device 1 more reliably prevents the backings 91 in the die-cut tape 9 from separating from the release paper 92. The printing device 1 more reliably prevents the die-cut tape 9 from being unintendedly discharged from the cassette.

In the above embodiment, the CPU 81 obtains the tape information input through the input unit 4. In some embodiments, the CPU 81 may obtain the tape information input through an external terminal to the printing device 1. The cassette 7 may include an identifier indicating tape information. The printing device 1 may include a sensor for reading the tape information from the identifier. Examples of the identifier include, for example, irregularity including a pattern associated with a tape type, a quick response (QR)

code (registered trademark), and an integrated circuit (IC) chip. The CPU 81 may obtain the tape information read by the sensor.

In the above embodiment, the CPU 81 receives the print instruction input through the input unit 4. In some embodiments, the CPU 81 may receive the print instruction input to the printing device 1 through an external terminal.

The printing device 1 may print on a tape while transporting the tape reversely. In this case, the printing device 1 may have the discharging roller 220 at the release position to print on a tape while transporting the tape reversely.

In the above embodiment, the preset rotation amount of the discharging roller 220 is smaller when the value K of the print counter is two or more than when the value K is one. In some embodiments, the preset rotation amount of the discharging roller 220 may be the same when the value K is two or more and when the value K is one, or may be larger when the value K is two or more than when the value K is one. More specifically, the printing device 1 may skip S73 and S74.

In the above embodiment, the CPU 81 starts rotating the discharging roller 220 in the discharge direction in S61 before starting printing in S62. In some embodiments, the CPU 81 may start rotating the discharging roller 220 in the discharge direction after starting printing in S62 and determining that the tape has the front end transported forward to the second holding position P5. When the tape has its front end upstream from the second holding position P5 in the transport direction, the tape does not come in contact with the discharging roller 220. In this case, the printing device 1 may not drive the discharge motor 299 to reduce power consumption.

In the above embodiment, the CPU 81 stops printing in S66 after starting to move the discharging roller 220 to the nip position in S65. In some embodiments, the CPU 81 may stop printing in S66 before starting to move the discharging roller 220 to the nip position. In this case, the printing device 1 holds the tape so as not to be transported between the discharging roller 220 and the opposing rollers 230. Thus, the printing device 1 prevents the tape from coming in contact with the discharging roller 220 during transportation, and thus the tape is not prevented from being transported. In this case, the CPU 81 may stop rotating the discharging roller 220 in the discharge direction before starting to move the discharging roller 220 to the nip position after stopping the printing in S66. This rotates the discharging roller 220 in the discharge direction during the printing. Thus, the printing device 1 does not prevent transporting of the tape in contact with the discharging roller 220 during printing.

In the above embodiment, after the discharge stop time elapses (Yes in S63), the CPU 81 stops rotating the discharging roller 220 (S64). The discharging roller 220 during the printing may be stopped at any other time point. For example, the CPU 81 may stop rotating the discharging roller 220 after stopping controlling the thermal head 60 and before stopping rotating the transport motor 68. To print a plurality of characters, the CPU 81 may stop rotating the discharging roller 220 once completely printing a character (s) with a predetermined number of characters remaining unprinted before the last character. The CPU 81 may stop rotating the discharging roller 220 after printing a line(s) with a predetermined number of lines remaining unprinted before the last line of total lines. For example, the CPU 81 may perform printing with a lower transportation speed in the middle of printing. The printing with a lower transportation speed refers to printing on a tape by controlling the transport motor 68 to lower the transportation speed of the tape and thus by controlling the thermal head 60. The CPU 81 may stop rotating the discharging roller 220 in response to the start of such printing with a lower transportation speed.

The CPU 81 transports the die-cut tape 9 forward until detecting the mark 99 in S54. In some embodiments, the CPU 81 may transport the die-cut tape 9 forward by a predetermined amount. In this modification, the CPU 81 may determine whether the mark sensor 31 has outputted the detection signal after transporting the die-cut tape 9 forward by the predetermined amount. When receiving no detection signal from the mark sensor 31, the CPU 81 may notify an error message through, for example, a speaker (not shown) or a display screen (not shown).

In the second tape-end detection according to the above embodiment, the CPU 81 moves the discharging roller 220 to the release position in S41 and S42 before transporting the die-cut tape 9 reversely in S43 and S44. In some embodiments, the CPU 81 may transport the die-cut tape 9 reversely before moving the discharging roller 220 to the release position. In other words, the CPU 81 may start the second tape-end detection in the order of S43, S44, S41, and S42. The tape is not limited to the die-cut tape 9. The CPU 81 may determine, in accordance with the type of the tape, whether to move the discharging roller 220 to the release position before transporting the tape reversely. For example, the CPU 81 may not determine to move the discharging roller 220 to the release position before reversely transporting the tape that is less flexible.

The CPU 81 may be replaced by a processor such as a microcomputer, an application specific integrated circuit (ASIC), or a field programmable gate array (FPGA). The main processing may be performed by a plurality of processors in a distributed manner. The non-transitory storage medium is a storage medium that can simply store information for any duration. The non-transitory storage medium may not include a transitory storage medium (e.g., transmission signals). The program may be downloaded from, for example, a server connected to the network (specifically, transmitted as transmission signals) and stored in the flash memory 82. The programs may be stored simply in a non-transitory storage medium, such as a hard disk drive included in the server.

What is claimed is:

1. A printing device, comprising:

a transporting unit configured to transport a print medium in a transport direction;

a printing unit configured to print on the print medium;

a roller located downstream from the printing unit in the transport direction;

an opposing member opposing the roller;

a motor rotatable in a first rotation direction and a second rotation direction opposite to the first rotation direction;

a coupling mechanism configured to drivably couple the motor and the roller, wherein the coupling mechanism is configured to rotate the roller in a first direction when the motor rotates in the first rotation direction, the first direction being a rotation direction in which the print medium is transported downstream in the transport direction;

a moving mechanism configured to move the roller to a first position at which the roller holds the print medium between the roller and the opposing member, and to a second position at which the roller is spaced from the print medium; and a first switching mechanism configured to drivably couple the motor and the moving mechanism when the motor rotates in the second rotation direction and to decouple the motor from the moving mechanism when the motor rotates in the first rotation direction.

2. The printing device according to claim 1, wherein the coupling mechanism includes:

a first gear drivably coupled to the motor; and a second gear located on a rotation shaft of the roller and meshable with the first gear, and wherein the moving mechanism is configured to move the rotation shaft of the roller along a toothed peripheral surface of the first gear to move the roller to one of: the first position and the second position.

3. The printing device according to claim 2, further comprising:

a first guide having one of: a guide hole extending along the toothed peripheral surface, or a guide groove configured to receive the rotation shaft of the roller.

4. The printing device according to claim 2, wherein the moving mechanism includes:

a rotator coupled to the motor by the first switching mechanism, an eccentric member eccentrically fixed to a rotation shaft of the rotator, and a holder including a first support supporting the eccentric member and a second support rotatably supporting the rotation shaft of the roller.

5. The printing device according to claim 4, wherein the first support includes a hole configured to movably support the eccentric member in a second direction perpendicular to a direction in which the rotation shaft of the rotator extends and perpendicular to a direction in which the holder moves, and wherein the second support includes a hole configured to movably support the rotation shaft of the roller in the second direction.

6. The printing device according to claim 4, further comprising:

a second guide configured to guide the holder to move linearly when the roller moves to one of: the first position and the second position.

7. The printing device according to claim 4, further comprising:

a first urging member configured to urge the rotator to maintain the roller at the first position.

8. The printing device according to claim 7, further comprising:

a second urging member configured to urge the rotator to maintain the roller at the second position.

9. The printing device according to claim 7, wherein the first urging member urges the rotator to maintain the roller at the second position.

10. The printing device according to claim 4, wherein the holder includes:

a first member including the first support;

a second member including the second support, the second member being movably supported by the first member toward and away from the opposing member; and a third urging member located between the first member and the second member, the third urging member being configured to urge the first member toward the opposing member.

11. The printing device according to claim 10, further comprising:

a detection unit configured to detect the roller being at the first position or at the second position, wherein the detection unit detects the roller being at the first position or at the second position by detecting a position of the first member.

12. The printing device according to claim 1, further comprising:

a detection unit configured to detect the roller being at the first position or at the second position.

13. The printing device according to claim 1, wherein the coupling mechanism includes a second switching mechanism configured to drivably couple the motor and the roller when the motor rotates in the first rotation direction, and to decouple the motor from the roller when the motor rotates in the second rotation direction.

14. The printing device according to claim 1, wherein the first rotation direction corresponds to a counterclockwise direction from a bottom view of the printing device, and the second rotation direction corresponds to a clockwise direction from the bottom view of the printing device.

* * * * *